US007983590B2

(12) United States Patent
Sakuma

(10) Patent No.: US 7,983,590 B2
(45) Date of Patent: Jul. 19, 2011

(54) DEVELOPER CARTRIDGE AND DEVELOPING UNIT HAVING SHUTTER FOR CONTROLLING SUPPLY OF DEVELOPER THEREBETWEEN

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 286 days.

(21) Appl. No.: 12/210,758

(22) Filed: Sep. 15, 2008

(65) Prior Publication Data

US 2009/0087215 A1 Apr. 2, 2009

(30) Foreign Application Priority Data

Oct. 2, 2007 (JP) ..... 2007-258313
Apr. 30, 2008 (JP) ..... 2008-118622
Apr. 30, 2008 (JP) ..... 2008-118623

(51) Int. Cl.
*G03G 15/08* (2006.01)

(52) U.S. Cl. ..... 399/102; 399/103; 399/105; 399/106; 399/119; 399/262

(58) Field of Classification Search ..... 399/102, 399/103, 105, 106, 119, 258, 262
See application file for complete search history.

(56) References Cited

U.S. PATENT DOCUMENTS 6,438,345 B1 * 8/2002 Ban et al. ..... 399/262
7,783,234 B2 * 8/2010 Okamoto et al. ..... 399/260
2005/0169672 A1 * 8/2005 Ban et al. ..... 399/258
2006/0104673 A1 * 5/2006 Sasae et al. ..... 399/262
2007/0223971 A1 * 9/2007 Takagi ..... 399/258
2008/0298837 A1 * 12/2008 Mase ..... 399/119
2009/0297226 A1 * 12/2009 Nagashima et al. ..... 399/258

FOREIGN PATENT DOCUMENTS

EP 1041454 A1 10/2000
EP 1659455 A2 5/2006
JP 09-319202 12/1997
JP 2005-331617 A 12/2005
JP 2006-235306 A 9/2006
JP 2007-072234 A 3/2007

OTHER PUBLICATIONS

Partial EP Search Report dtd Apr. 4, 2011 EP Appin. 08016246.4.

* cited by examiner

*Primary Examiner* — David M Gray
*Assistant Examiner* — G. M. Hyder
(74) *Attorney, Agent, or Firm* — Banner & Witcoff, Ltd.

(57) ABSTRACT

A developing unit includes a developer cartridge for accommodating developer and including a first opening for enabling communication between an inside of the developer cartridge and an outside of the developer cartridge, a housing including a cartridge housing part and a second opening provided in a position opposite to the first opening and formed toward the cartridge housing part, a shutter including a third opening and being movable between an open position and a closed position, and a protruding portion provided at an upstream end portion of the third opening in a movement direction of the shutter from the open position to the closed position and including a first end at a side close to the first opening and a second end at a side close to the second opening. The first end protrudes more downstream in the movement direction than the second end.

28 Claims, 24 Drawing Sheets

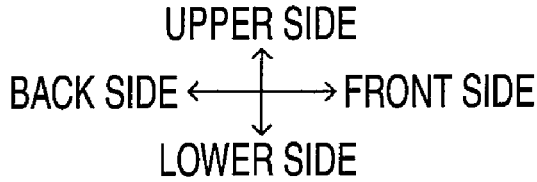
FIG. 11A
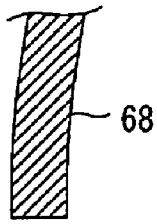
FIG. 11B
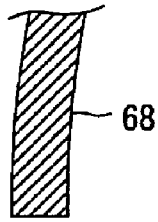
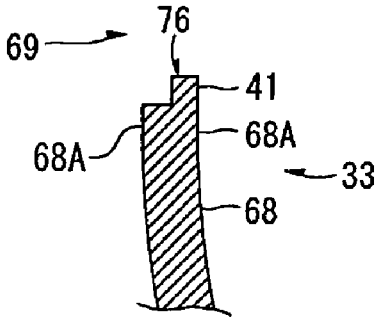
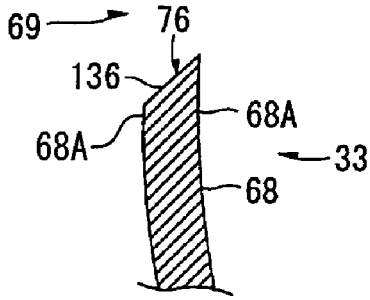

UPPER SIDE
RIGHT SIDE
FRONT SIDE
LOWER SIDE
BACK SIDE
LEFT SIDE
17
X

UPPER SIDE
RIGHT SIDE
FRONT SIDE
BACK SIDE
LEFT SIDE
LOWER SIDE

X
Y

DEVELOPER CARTRIDGE AND DEVELOPING UNIT HAVING SHUTTER FOR CONTROLLING SUPPLY OF DEVELOPER THEREBETWEEN

CROSS-REFERENCE TO RELATED APPLICATIONS

This application claims priority from Japanese Patent Application No. 2007-258313 filed on Oct. 2, 2007, Japanese Patent Application No. 2008-118622 filed on Apr. 30, 2008 and Japanese Patent Application No. 2008-118623 filed on Apr. 30, 2008, the entire subject matter of which is incorporated herein by reference.

TECHNICAL FIELD

Aspects of the present invention relate to a developer cartridge and a developing unit mounted on an image forming apparatus.

BACKGROUND

For example, as a developing unit, JP-A-9-319202 discloses a related developing device, in which a developer cartridge accommodating developer is removably mounted to a frame. In the related developing device, a hole formed in one side portion of the developer cartridge and a hole formed in the frame form a developer supply opening, and a hole formed in the other side portion of the developer cartridge and a hole formed in the frame form a developer receiving opening.

The developer accommodated in the developer cartridge is supplied to the frame through the developer supply opening, but a part of the developer is returned to the developer cartridge through the developer receiving opening. Accordingly, the developer is circulated between the frame and the developer cartridge.

The developer cartridge has a double structure of the first frame accommodating developer and the second frame that is provided outside the first frame.

SUMMARY

One aspect of the invention provides a developing unit capable of preventing developer attached to the circumference of an opening of a shutter from being scattered to the outside.

Another aspect of the invention provides a developer cartridge in which a first opening of a first frame accommodating developer is opened or closed by a second frame that is provided outside the first frame and which can prevent the developer attached to the second frame or an end portion of the second frame from being scattered to the outside, and a developing unit including the developer cartridge.

According to a first aspect of the invention, there is provided a developing unit comprising: a developer cartridge that is configured to accommodate developer and comprises a first opening for enabling communication between an inside of the developer cartridge and an outside of the developer cartridge; a housing comprising: a cartridge housing part for housing the developer cartridge; and a second opening that is provided in a position opposite to the first opening and is formed toward the cartridge housing part; a shutter that comprises a third opening and is movable between an open position where the third opening is located at a position between the first opening and the second opening and a closed position where the third opening gets apart from the position between the first opening and the second opening; and a protruding portion that is provided at an upstream end portion of the third opening in a movement direction of the shutter from the open position to the closed position and comprises a first end at a side close to the first opening and a second end at a side close to the second opening, the first end protruding more downstream in the movement direction than the second end.

According to a second aspect of the invention, there is provided a developer cartridge comprising: a first frame that is configured to accommodate developer and comprises a first opening for enabling communication between an inside of the first frame and an outside of the first frame; a second frame that is provided the outside of the first frame and is movable between an open position where the first opening is opened and a closed position where the first opening is closed, the second frame comprising an end portion at an upstream side in a movement direction of the second frame from the open position to the closed position; and a protruding portion that is provided at the end portion of the second frame and comprises: a first end provided at a side close to the first opening; and a second end that is provided in a position getting more apart from the first opening than the first end and protrudes more downstream in the movement direction than the first end.

According to a third aspect of the invention, there is provided a developing unit comprising: the developer cartridge comprising: a first frame that is configured to accommodate developer and comprises a first opening for enabling communication between an inside of the first frame and an outside of the first frame; a second frame that is provided the outside of the first frame and is movable between an open position where the first opening is opened and a closed position where the first opening is closed, the second frame comprising an end portion at an upstream side in a movement direction of the second frame from the open position to the closed position; and a protruding portion that is provided at the end portion of the second frame and comprises: a first end provided at a side close to the first opening; and a second end that is provided in a position getting more apart from the first opening than the first end and protrudes more downstream in the movement direction than the first end, wherein the protruding portion comprises a flexible sheet that is provided in the position getting more apart from the first opening than the first end and protrudes from the upstream side to the downstream side in the movement direction; a housing comprising: a cartridge housing part for housing the developer cartridge; and a second opening that is provided in a position opposite to the first opening and is formed toward the cartridge housing part; and a shutter that is provided in the cartridge housing part and is movable together with the second frame so as to open and close the second opening, wherein the sheet is capable of filling a gap between the shutter and the second frame.

According to a fourth aspect of the invention, there is provided a developing unit comprising: the developer cartridge comprising: a first frame that is configured to accommodate developer and comprises a first opening for enabling communication between an inside of the first frame and an outside of the first frame; a second frame that is provided the outside of the first frame and is movable between an open position where the first opening is opened and a closed position where the first opening is closed, the second frame comprising an end portion at an upstream side in a movement direction of the second frame from the open position to the closed position; and a protruding portion that is provided at the end portion of the second frame and comprises: a first end provided at a side close to the first opening; and a second end that is provided in a position getting more apart from the first opening than the first end and protrudes more downstream in the movement direction than the first end; a housing comprising: a cartridge housing part for housing the developer cartridge; and a second opening that is provided in a position opposite to the first opening and is formed toward the cartridge housing part; a shutter that is provided in the cartridge housing part and is movable together with the second frame so as to open the second opening when the second frame is located at the open position and close the second opening when the second frame is located at the closed position; a second seal member that is provided around the second opening between the housing and the shutter for preventing the developer from leaking from the second opening; a second seal-side opposite portion that is provided in the second seal member and is opposed to the second frame and the shutter when the second frame moves from the open position to the closed position; and a second guide surface that is provided in the second seal-side opposite portion and is inclined to the second opening as approaching from the downstream side to the upstream side in the movement direction.

According to a fifth aspect of the invention, there is provided a developing unit comprising: the developer cartridge comprising: a first frame that is configured to accommodate developer and comprises a first opening for enabling communication between an inside of the first frame and an outside of the first frame; a second frame that is provided the outside of the first frame and is movable between an open position where the first opening is opened and a closed position where the first opening is closed, the second frame comprising an end portion at an upstream side in a movement direction of the second frame from the open position to the closed position; and a protruding portion that is provided at the end portion of the second frame and comprises: a first end provided at a side close to the first opening; and a second end that is provided in a position getting more apart from the first opening than the first end and protrudes more downstream in the movement direction than the first end; a housing comprising: a cartridge housing part for housing the developer cartridge; and a second opening that is provided in a position opposite to the first opening and is formed toward the cartridge housing part; a shutter that is provided in the cartridge housing part and is movable together with the second frame so as to open the second opening when the second frame is located at the open position and close the second opening when the second frame is located at the closed position; a second seal member that is provided around the second opening between the housing and the shutter for prevent the developer from leaking from the second opening; a second seal-side opposite portion that is provided in the second seal member and is opposed to the second frame and the shutter when the second frame moves from the open position to the closed position; and a second protective member for protecting the second seal member, the second protective member having an elastic modulus higher than that of the second seal member and provided between the second seal-side opposite portion and a group of the second frame and the shutter.

According to a sixth aspect of the invention, there is provided a developer cartridge comprising: a first frame that is configured to accommodate developer and comprises a first opening for enabling communication between an inside of the first frame and an outside of the first frame; a second frame that is provided the outside of the first frame and is movable between an open position where the first opening is opened and a closed position where the first opening is closed; and a first seal member that is provided around the first opening on an outer surface of the first frame for preventing the developer from leaking from the first opening, the first seal member comprising: a first contact portion that is slide contactable with the second frame moved from the open position to the closed position; and a second contact portion that is slide contactable with the second frame moved from the open position to the closed position at a contact pressure higher than that of the first contact portion.

According to a seventh aspect of the invention, there is provided a developing unit comprising: the developer cartridge comprising: a first frame that is configured to accommodate developer and comprises a first opening for enabling communication between an inside of the first frame and an outside of the first frame; a second frame that is provided the outside of the first frame and is movable between an open position where the first opening is opened and a closed position where the first opening is closed; and a first seal member that is provided around the first opening on an outer surface of the first frame for preventing the developer from leaking from the first opening, the first seal member comprising: a first contact portion that is slide contactable with the second frame moved from the open position to the closed position; and a second contact portion that is slide contactable with the second frame moved from the open position to the closed position at a contact pressure higher than that of the first contact portion; a housing comprising: a cartridge housing part for housing the developer cartridge; and a second opening that is provided in a position opposite to the first opening and is formed toward the cartridge housing part; a shutter that is provided in the cartridge housing part and is movable together with the second frame so as to open the second opening when the second frame is located at the open position and close the second opening when the second frame is located at the closed position; and a second seal member that is provided around the second opening between the housing and the shutter for preventing the developer from leaking from the second opening, the second seal member comprising: a third contact portion that is slide contactable with the shutter when the second frame moves from the open position to the closed position; and a fourth contact portion that is slide contactable with the shutter when the second frame moves from the open position to the closed position at a contact pressure higher than that of the third contact portion.

According to the first aspect of the invention, when the shutter is disposed at the open position with the developer cartridge being accommodated in the cartridge housing part of the housing, the first opening of the developer cartridge and the second opening of the housing are opposed to each other with the third opening of the shutter interposed therebetween, such that they communicate with each other. In this way, the developer accommodated in the developer cartridge can be moved between the developer cartridge and the housing through the first opening, the second opening, and the third opening. In contrast, when the shutter is disposed at the closed position, the third opening deviates from the first opening and the second opening. Therefore, the first opening and the second opening do not communicate with each other, and it is possible to regulate the movement of the developer between the developer cartridge and the housing.

When the shutter is moved from the open position to the closed position, the developer that is being moved between the developer cartridge and the housing may be attached to an upstream end portion of the third opening in the movement direction of the shutter from the open position to the closed position (hereinafter, simply referred to as a "movement direction"), and it may leak to the cartridge housing part with the movement of the shutter and be scattered to the outside.

However, a protruding portion is provided in a portion of the shutter above the third opening. In the protruding portion, an end portion (a side that is close to the cartridge housing part) that is close to the first opening protrudes to the downstream side of the second opening in the movement direction (a side that is far away from the cartridge housing part than the first opening). Therefore, even when developer is attached to the upstream end portion of the third opening, the protruding portion prevents the developer from leaking from the first opening. As a result, it is possible to prevent the developer from leaking to the cartridge housing part and from being scattered to the outside.

According to the second aspect of the invention, in the developer cartridge, the second frame that is provided outside the first frame accommodating developer is movable between the open position where the first opening of the first frame is opened and the closed position where the first opening is closed.

In addition, a protruding portion is provided on an end portion (hereinafter, simply referred to an "end portion") of the second frame that initially crosses the first opening when the second frame is moved in a movement direction from the open position to the closed position (hereinafter, simply referred to a "movement direction"). The protruding portion includes the first end that is close to the first opening and the second end that protrudes to the downstream side of the first end in the movement direction at a position that is further away from the first opening than the first end (that is, the outside position).

Therefore, even when the developer in the first opening is attached to the end portion of the second frame when the second frame is moved from the open position to the closed position, the second end of the protruding portion prevents the developer from leaking to the outside. As a result, it is possible to prevent the developer from being scattered to the outside.

According to the third aspect of the invention, in the housing of the developing unit, when the developer cartridge is accommodated in the cartridge housing part, the second opening of the housing can be opposed to the first opening of the developer cartridge. Therefore, it is possible to supply the developer accommodated in the developer cartridge to the housing through the first and second openings.

The shutter is arranged in the cartridge housing part. The shutter is moved together with the second frame of the developer cartridge to open or close the second opening. Therefore, when the second frame is moved to close or open the first opening, the second opening is also closed or opened. As a result, it is possible to improve operability.

The sheet is included in the protruding portion that is provided in an end portion of the second frame of the developer cartridge. The sheet can preventing the leakage of developer between the shutter and the second frame by filling a gap therebetween, in addition to preventing the developer attached to the end portion of the second frame from being scattered to the outside when the second frame is moved from the open position to the closed position.

According to the fourth aspect of the invention, in the housing of the developing unit, when the developer cartridge is accommodated in the cartridge housing part, the second opening of the housing can be opposed to the first opening of the developer cartridge. Therefore, it is possible to supply the developer accommodated in the developer cartridge to the housing through the first and second openings.

The shutter is arranged in the cartridge housing part. The shutter is moved together with the second frame of the developer cartridge to open or close the second opening. Specifically, the shutter opens the second opening when the second frame is located at the open position, and closes the second opening when the second frame is located at the closed position. Therefore, when the second frame is moved to close or open the first opening, the second opening is also closed or opened. As a result, it is possible to improve operability.

Further, the second seal member is provided around the second opening between the housing and the shutter. The second seal member includes the second seal-side opposite portion that is opposed to the second frame and the shutter when the second frame is moved from the open position to the closed position. The second frame and the shutter that are moved from the open position to the closed position can come into contact with the second seal-side opposite portion.

The second guide surface that is inclined toward the second opening as it extends from the downstream side to the upstream side in the movement direction is formed in the second seal-side opposite portion. Therefore, even when the second frame comes into contact with the second seal-side opposite portion while being moved from the open position to the closed position, the second frame and shutter are guided by the second guide surface in the direction in which they are separated from the second opening (the direction in which they deviate from the second seal member). Therefore, the second frame and the shutter are not caught by the second seal-side opposite portion. As a result, the second frame can be smoothly moved to the closed position, and the shutter can also be smoothly moved together with the second frame.

According to the fifth aspect of the invention, in the housing of the developing unit, when the developer cartridge is accommodated in the cartridge housing part, the second opening of the housing can be opposed to the first opening of the developer cartridge. Therefore, it is possible to supply the developer accommodated in the developer cartridge to the housing through the first and second openings.

The shutter is arranged in the cartridge housing part. The shutter is moved together with the second frame of the developer cartridge to open or close the second opening. Specifically, the shutter opens the second opening when the second frame is located at the open position, and closes the second opening when the second frame is located at the closed position. Therefore, when the second frame is moved to close or open the first opening, the second opening is also closed or opened. As a result, it is possible to improve operability.

The second seal member is provided around the second opening between the housing and the shutter. The second seal member includes the second seal-side opposite portion that is opposed to the second frame and the shutter when the second frame is moved from the open position to the closed position. In this case, the second frame and the shutter that are moved from the open position to the closed position tightly contact the second seal-side opposite portion, which may cause the second seal-side opposite portion of the second seal member to be damaged.

However, the developing unit includes the second protective member having an elastic modulus that is higher than that of the second seal member (high rigidity). Therefore, when the second frame is moved from the open position to the closed position, the second protective member is arranged between the second seal-side opposite portion, and the second frame and the shutter. In this way, the second protective member can prevent the second frame and the shutter from contacting the second seal-side opposite portion, thereby protecting the second seal member.

As a result, when the second frame is moved from the open position to the closed position, it is possible to prevent the second seal-side opposite portion of the second seal member from being damaged.

According to the sixth aspect of the invention, in the developer cartridge, the second frame is provided outside the first frame that accommodates developer, and is movable between the open position where the first opening is opened and the closed position where the first opening is closed.

The first seal member that is provided around the first opening on the outer surface of the first frame is disposed between the first frame and the second frame provided outside the first frame.

The first seal member includes the first and second contact portions that come into slide contact with the second frame which is moved from the open position to the closed position.

The second contact portion comes into slide contact with the second frame with a higher contact pressure than the first contact portion. Therefore, even when the developer in the first opening is attached to the second frame while the second frame that is moved from the open position to the closed position crosses the first opening, the developer is removed from the second frame by the second contact portion. In this way, it is possible to prevent the developer attached to the second frame from being scattered.

According to the seventh aspect of the invention, in the housing of the developing unit, when the developer cartridge is accommodated in the cartridge housing part, the second opening of the housing can be opposed to the first opening of the developer cartridge. Therefore, it is possible to supply the developer accommodated in the developer cartridge to the housing through the first and second openings.

The shutter is arranged in the cartridge housing part. The shutter is moved together with the second frame of the developer cartridge to open or close the second opening. Specifically, the shutter opens the second opening when the second frame is located at the open position, and closes the second opening when the second frame is located at the closed position. Therefore, when the second frame is moved to close or open the first opening, the second opening is also closed or opened. As a result, it is possible to improve operability.

Further, the second seal member is provided around the second opening between the housing and the shutter. The second seal member includes the third and fourth contact portions that come into slide contact with the shutter when the second frame is moved from the open position to the closed position.

The fourth contact portion comes into slide contact with the shutter with a higher contact pressure than the third contact portion. Therefore, even when the developer in the second opening is attached to the shutter while the shutter crosses the second opening with the movement of the second frame from the open position to the closed position, the developer is removed from the shutter by the fourth contact portion. In this way, it is possible to prevent the developer attached to the shutter from being scattered.

BRIEF DESCRIPTION OF THE DRAWINGS

FIGS. 11A and 11B show a protruding portion according to a fifth modification to the exemplary embodiments, where FIG. 11A shows a first aspect thereof and FIG. 11B shows a second aspect thereof;

FIG. 26A shows a first aspect thereof, FIG. 26B shows a second aspect thereof, FIG. 26C shows a third aspect thereof, FIG. 26D shows a fourth aspect thereof, FIG. 26E shows a fifth aspect thereof, and FIG. 26F shows a sixth aspect thereof.

DETAILED DESCRIPTION

Figure 1:
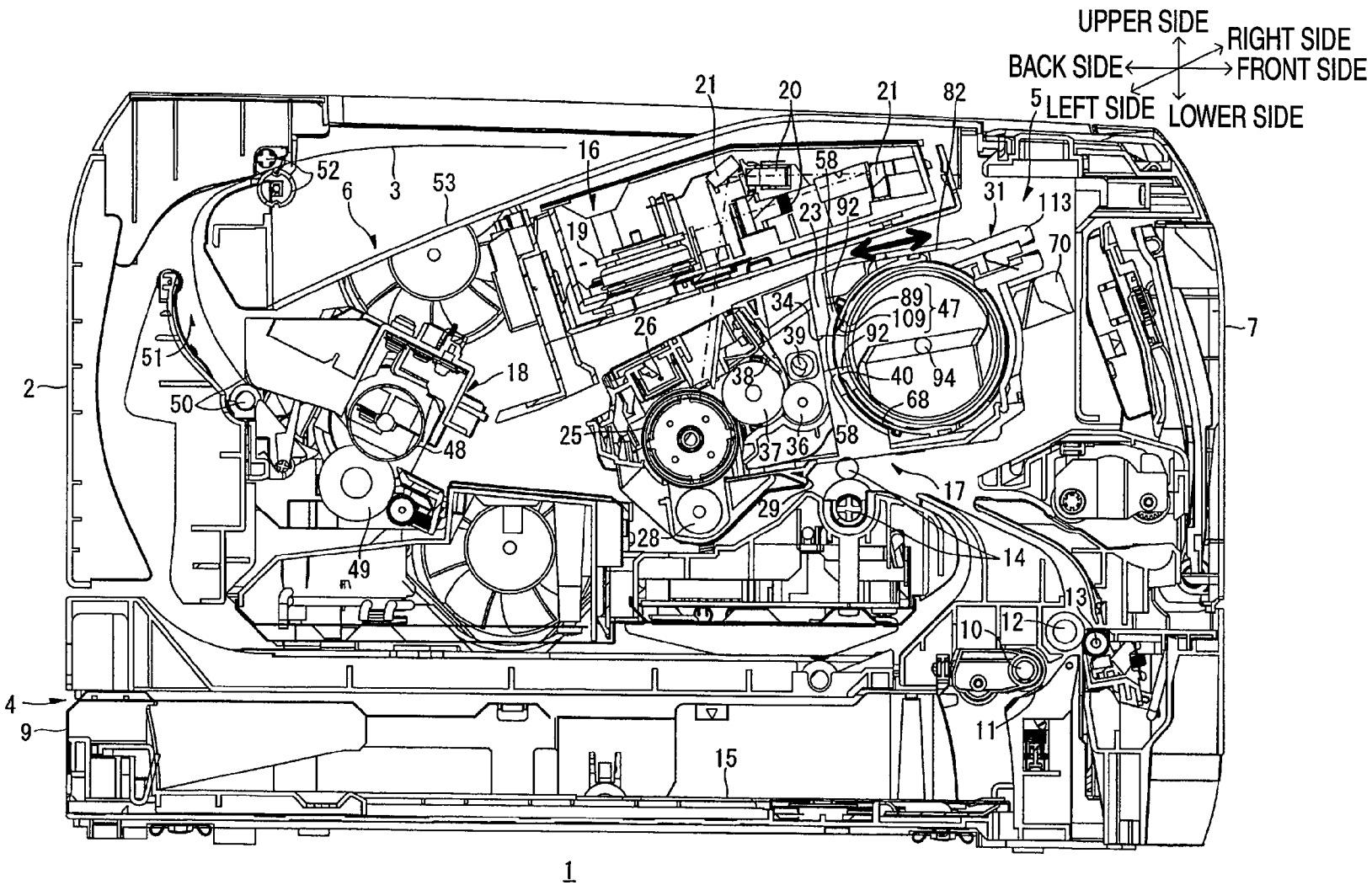
FIG. 1 is a left side sectional view showing an image forming apparatus according to a first exemplary embodiment of the invention.

In the related developing device, it can be considered to provide a shutter for opening and closing the developer supply opening and the developer receiving opening between the frame and the developer cartridge. Passage holes corresponding to the developer supply opening and the developer receiving opening are formed in the shutter. Here, when the corresponding passage hole of the shutter is disposed between the holes forming the developer supply opening in the frame and the developer cartridge, the developer supply opening is opened. In contrast, when the shutter moves to bring the passage hole apart from the position between the holes, the developer supply opening is closed. The developer receiving opening is also opened and closed in the same way as the developer supply opening. By allowing the shutter to close the developer supply opening and the developer receiving opening, the leakage of developer from the developer supply opening and the developer receiving opening is prevented when the developer cartridge is mounted to and removed from the frame.

When the shutter is provided, a portion of the developer passing through the opened developer supply opening and developer receiving opening may be adhered to the circumference of each of the passage holes of the shutter. In this case, when the shutter is moved to close the developer supply opening and the developer receiving opening and the developer cartridge is removed from the frame, the developer adhered to the circumference of the passage hole may be exposed and scattered to an outside.

Further, in the related developer cartridge, the developer supply opening and the developer receiving opening are formed in the first frame. In this case, the second frame is moved relative to the first frame to open or close the developer supply opening and the developer receiving opening.

When the second frame closes up the developer supply opening and the developer receiving opening of the first frame in order to remove the developer cartridge from the frame of the developing device, developer in the developer supply opening and the developer receiving opening may be adhered to an end portion of the second frame that initially crosses the developer supply opening and the developer receiving opening. When the developer cartridge is removed from the frame of the developing device with the developer being adhered to the end portion of the second frame, the developer may be scattered to the outside.

Further, when the second frame closes up the developer supply opening and the developer receiving opening of the first frame in order to remove the developer cartridge from the frame of the developing device, developer in the developer supply opening and the developer receiving opening may be adhered to the second frame. In this case, the developer attached to the second frame may be scattered in the developing device.

One aspect of the invention provides a developing unit capable of preventing developer attached to the circumference of an opening of a shutter from being scattered to the outside.

Another aspect of the invention provides a developer cartridge in which a first opening of a first frame accommodating developer is opened or closed by a second frame that is provided outside the first frame and which can prevent the developer attached to the second frame or an end portion of the second frame from being scattered to the outside, and a developing unit including the developer cartridge.

Exemplary embodiments of the invention will be described with reference to the drawings.

I. First Exemplary Embodiment (Image Forming Apparatus)

Referring to FIG. 1, an image forming apparatus 1 includes a feeder unit 4 feeding a sheet 3 to a body casing 2, an image forming unit 5 forming an image on the fed sheet 3, and a sheet discharge part 6 discharging the sheet 3 having an image formed thereon.

(1) Body Casing

The body casing 2 has a box shape, where an opening is formed in one side wall and a front cover 7 opening and closing the opening is provided. By opening the front cover 7, a process cartridge 17 (which will be described later) as an example of a developing unit is removably mounted to the body casing 2 in a direction indicated by a bold arrow shown in FIG. 1.

In the following description, it is assumed that one side where the front cover 7 is provided is referred to as a front side (front face side), and the opposite side thereof is referred to as a rear side (rear face side). The front side in a paper thickness direction of FIG. 1 is a left side, and a depth side in the paper thickness direction of FIG. 1 is a right side. A lateral (right-left) direction is equal to a width direction. A substantially horizontal direction includes the front-rear direction and the right-left direction, and a substantially vertical direction includes the vertical direction. In the description of the process cartridge 17 (which will be described later) and a developer cartridge 31 as an example of a developer cartridge, a frame-side passage hole 34 (which will be described later) as an example of a second opening and a cartridge-side passage hole 47 (which will be described later) as an example of a first opening are opposite to each other substantially in the horizontal direction (front-rear direction).

(2) Feeder Unit

The feeder unit 4 includes a sheet feed tray 9, a sheet feed roller 10, a sheet feed pad 11, paper dust removing rollers 12 and 13, a registration roller 14 and a sheet pressing plate 15. The sheet 3 located at the uppermost of the sheet pressing plate 15 is fed to the sheet feed roller 10 and the sheet feed pad 11 one at a time, passes through the rollers 12 to 14, and then conveyed to a transfer position (which will be described later) of the image forming unit 5.

(3) Image Forming Unit

The image forming unit 5 includes a scanner unit 16, the process cartridge 17 and a fixing part 18.

(3-1) Scanner Unit

The scanner unit 16 is provided at an upper part of the body casing 2 and includes a laser emitting part (not shown), a polygon mirror 19 rotationally driven, plural lenses 20 and plural reflecting mirrors 21. As indicated by a one-dot chained line, a laser beam emitted from the laser emitting part based on image data is reflected by the polygon mirror 19, is transmitted or reflected by the plural lenses 20 and the plural reflecting mirrors 21, and is applied to the surface of a photosensitive drum 25 (which will be described later) of the process cartridge 17.

(3-2) Process Cartridge

The process cartridge 17 is housed in a space below the scanner unit 16 in the body casing 2, and is removably mounted to the body casing 2.

Figure 2A:
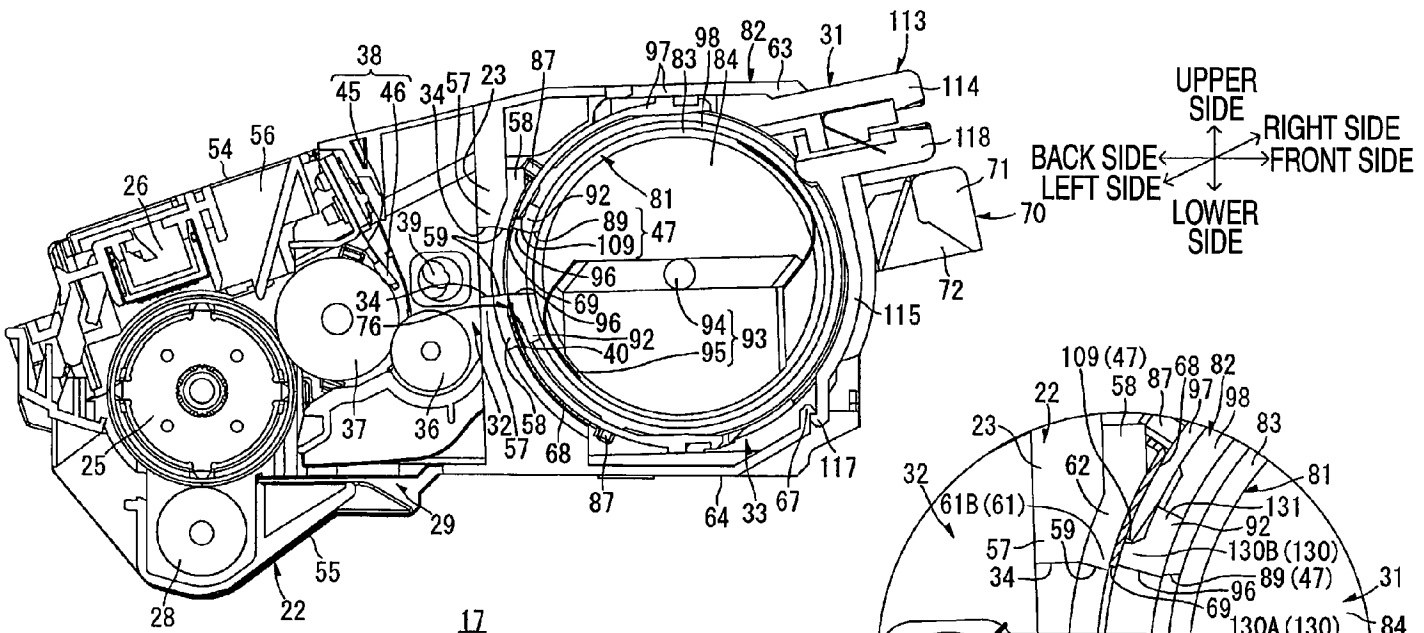
FIG. 2A is a left side sectional view of a process cartridge of the image forming apparatus, showing a state where a developer cartridge is mounted and a swing arm is located at a pressing position.
Figure 2B:
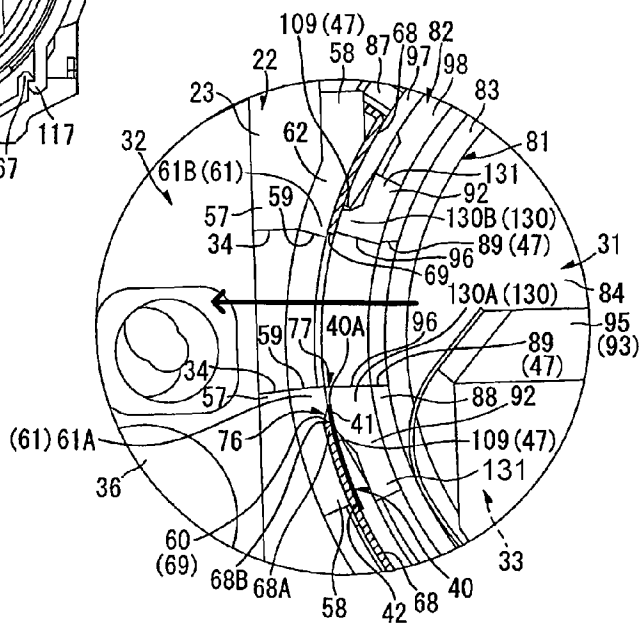
FIG. 2B is a partial enlarged view of FIG. 2A.

As shown in FIGS. 2A and 2B, the process cartridge 17 includes a hollow process frame 22 having a transfer path 29 for allowing the passage of the sheet 3 and a developer cartridge 31 removably mounted to a cartridge housing part 33 (which will be described later) of the process frame 22. The process frame 22 serves as an example of a housing.

A partition wall 23 extending in the vertical direction is provided substantially at the center portion in the front-rear direction of the process frame 22. In the inside space of the process frame 22, a rear portion of the partition wall 23 serves as a developing part 32 and a front portion of the partition wall 23 serves as the cartridge housing part 33. A frame-side passage hole 34 is formed in the partition wall 23. The developing part 32 and the cartridge housing part 33 communicate with each other through the frame-side passage hole 34.

The developing part 32 includes a photosensitive drum 25, a scorotron-type charger 26, a transfer roller 28, a supply roller 36, a developing roller 37, a thickness regulating plate 38 and an auger 39. The photosensitive drum 25, the transfer roller 28, the supply roller 36, the developing roller 37, and the auger 39 are rotatably supported by the process frame 22.

The scorotron-type charger 26 is supported above the photosensitive drum 25 by the process frame 22 with a predetermined gap from the photosensitive drum 25. The transfer roller 28 is oppositely disposed below the photosensitive drum 25. The developing roller 37 is oppositely disposed in front of the photosensitive drum 25. The supply roller 36 is oppositely disposed in front of the developing roller 37. The thickness regulating plate 38 includes a thin-plate leaf spring member 45 of which an upper end is fixed to the process frame 22 and a pressing rubber 46 disposed at a lower end portion of the leaf spring member 45 to press contact with the surface of the developing roller 37 by elastic force of the leaf spring member 45. The auger 39 includes a shaft extending in the width direction thereof and a spiral blade formed on the outer circumferential surface of the shaft. The auger 39 is provided above the supply roller 36 and in back of the frame-side passage hole 34 adjacently.

The developer cartridge 31 is removably mounted to the process frame 22 and is housed in the cartridge housing part 33 at the time of mounting. The developer cartridge 31 has a substantially cylindrical shape. A cartridge-side passage hole 47 is formed in the developer cartridge 31 such that the inside and the outside of the developer cartridge communicate with each other.

An agitator 93 is rotatably disposed in the developer cartridge 31. A positively chargeable, non-magnetic one component toner as an example of a developer is accommodated in the developer cartridge 31.

The developer in the developer cartridge 31 is agitated by rotation of the agitator 93 and is supplied into the developing part 32 from the cartridge-side passage hole 47 through the frame-side passage hole 34. Thereafter, the developer is conveyed in the width direction by the blade of the rotating auger 39, drops in the middle way thereof, and is supplied to the supply roller 36.

The developer supplied to the supply roller 36 is supplied to the developing roller 37 by rotation of the supply roller 36. At this time, the developer is positively charged between the supply roller 36 and the developing roller 37. Subsequently, the developer supplied to the developing roller 37 enters between the pressing rubber 46 and the developing roller 37 by the rotation of the developing roller 37, is regulated in thickness therebetween, and is carried as a thin layer on the surface of the developing roller 37.

The surface of the photosensitive drum 25 is positively and uniformly charged by the scorotron-type charger 26 with the rotation of the photosensitive drum 25 and then exposed by the laser beam emitted from the scanner unit 16. Accordingly, an electrostatic latent image based on image data is formed on the surface of the photosensitive drum 25. Then, when the developing roller 37 is rotated to bring the developer carried on the surface of the developing roller 37 into contact with the photosensitive drum 25, the developer is supplied to the electrostatic latent image formed on the surface of the photosensitive drum 25. Accordingly, the electrostatic latent image is developed (visualized), and a developer image is carried on the surface of the photosensitive drum 25. The developer image is transferred onto the sheet 3 passing between the photosensitive drum 25 and the transfer roller 28 (transfer position) in the transfer path 29.

(3-3) Fixing Part

The fixing part 18 is provided on the rear side of the process cartridge 17 as shown in FIG. 1. The fixing part 18 includes a heating roller 48, a pressure roller 49 that is provided below the heating roller 48 so as to press contact with the heating roller 48, and a pair of conveyance rollers 50 provided on the rear side of the heating roller and the pressure roller.

The fixing part 18 thermally fixes the developer transferred onto the sheet 3 at the transfer position while the sheet 3 passes between the heating roller 48 and the pressure roller 49. Then, the sheet 3 is conveyed to the sheet discharge part 6 by the pair of conveyance rollers 50.

(4) Sheet Discharge Part

The sheet discharge part 6 includes a sheet discharge path 51, a sheet discharge roller 52, and a sheet discharge tray 53. The sheet 3 fed from the fixing part 18 to the sheet discharge part 6 is fed to the sheet discharge roller 52 along the sheet discharge path 51 and is discharged onto the sheet discharge tray 53 by the sheet discharge roller 52.

(Process Cartridge)

Figures 3A, 3B:
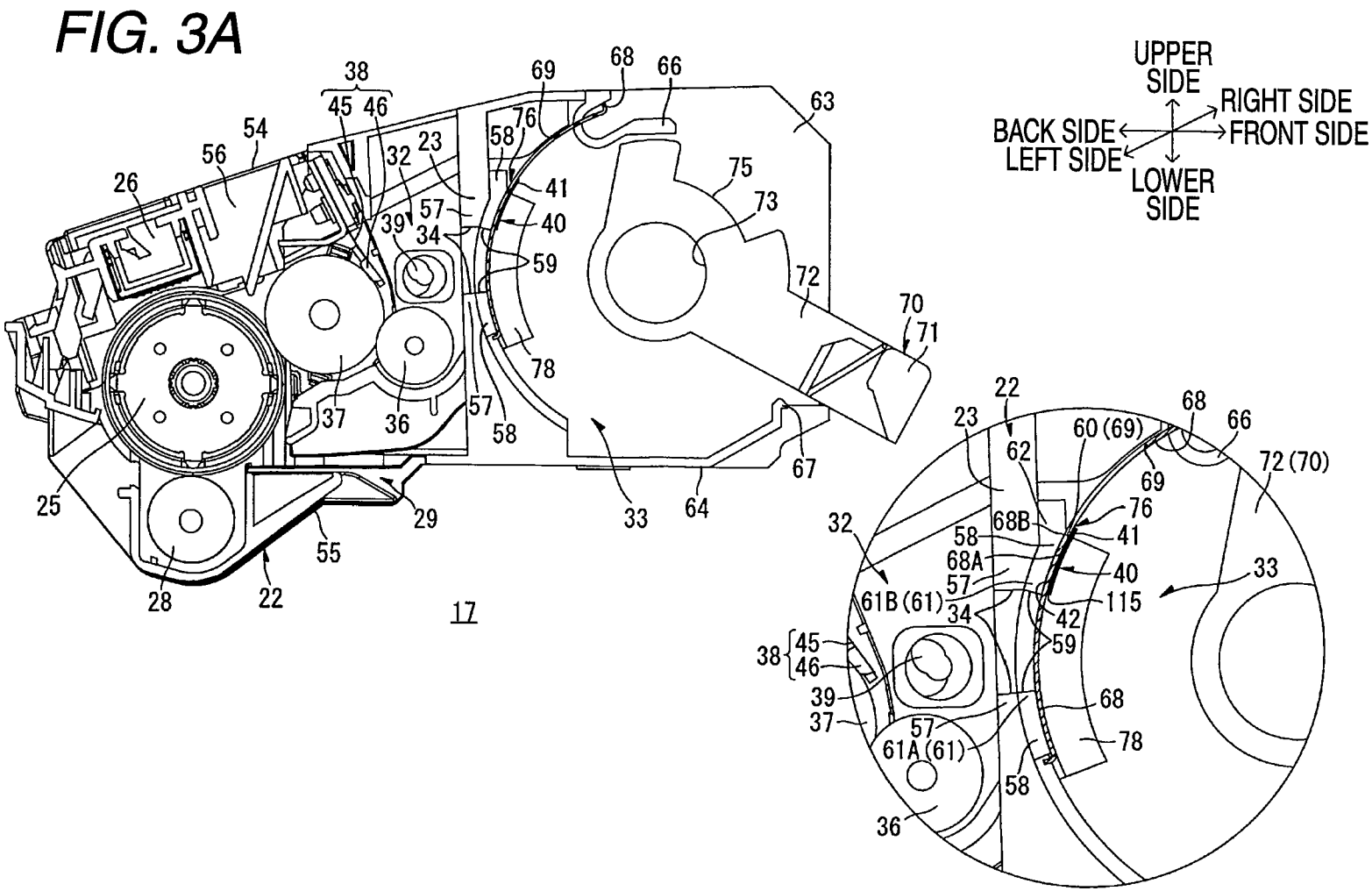
FIG. 3A is a left side sectional view of the process cartridge, showing a state where the developer cartridge is removed and the swing arm is located at a press releasing position.
FIG. 3B is a partial enlarged view of FIG. 3A.
Figure 4:
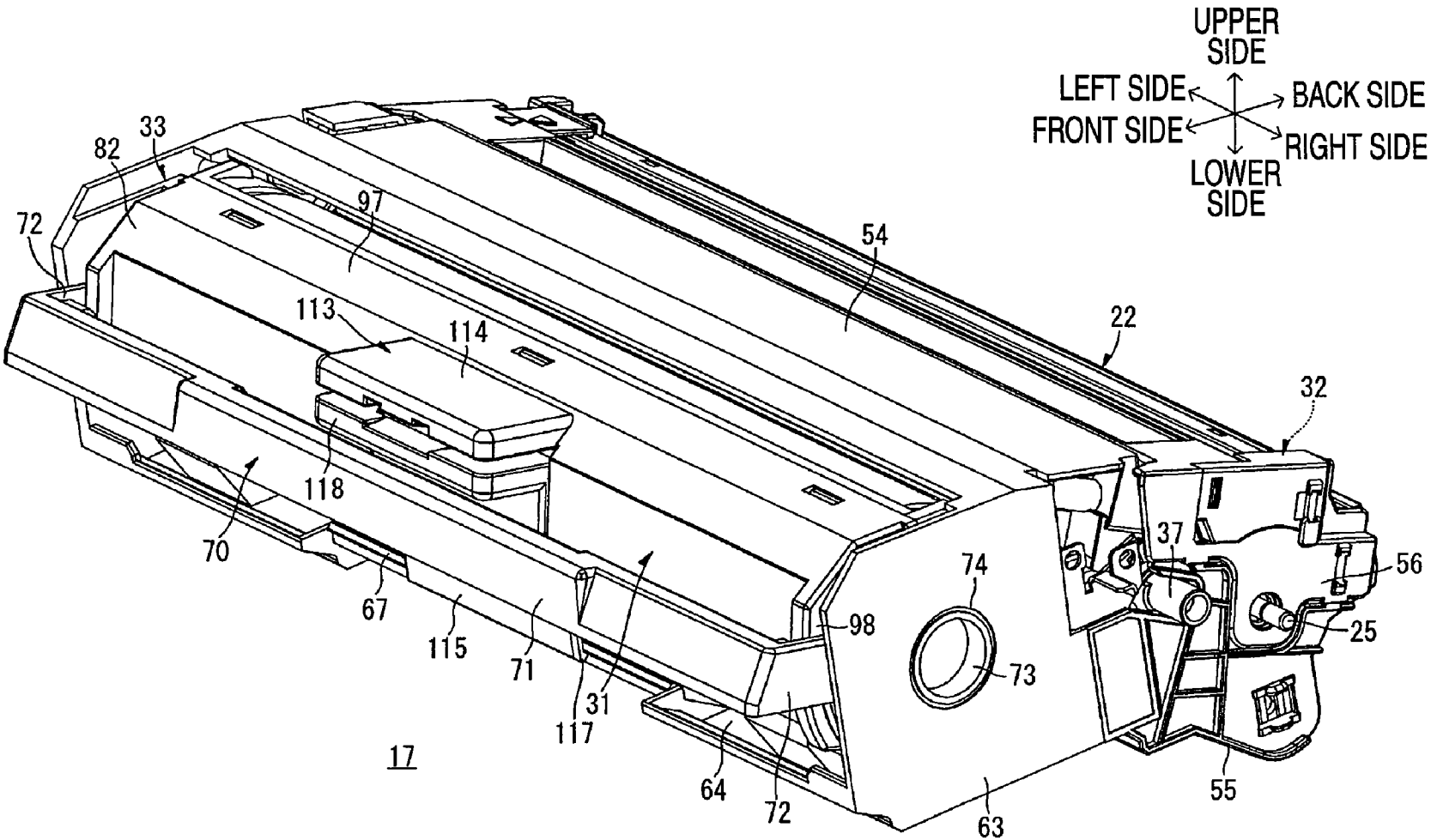
FIG. 4 is a perspective view of the process cartridge shown in FIGS. 2A and 2B as viewed obliquely from the front right side.
Figure 5:
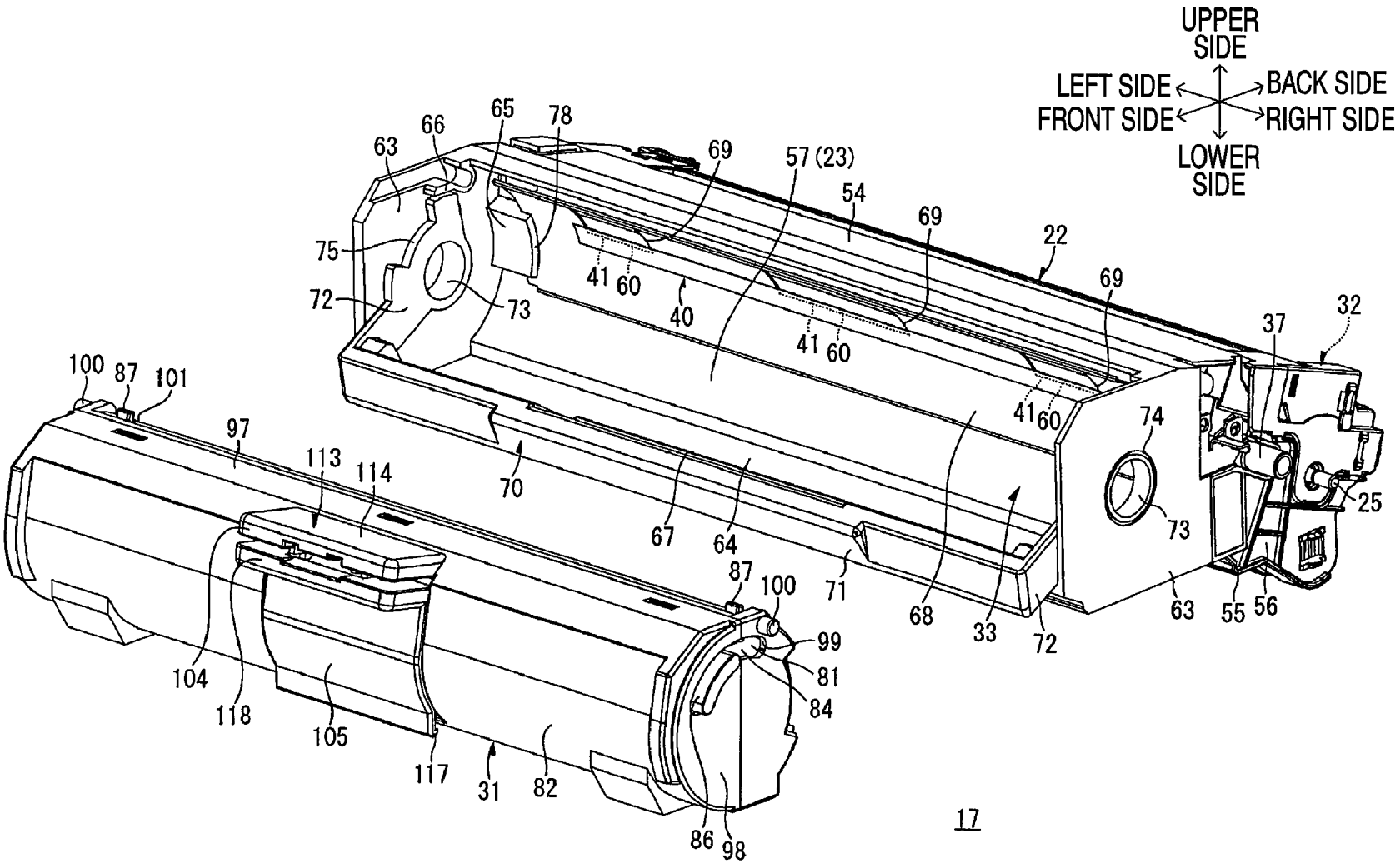
FIG. 5 is an exploded perspective view of the process cartridge as viewed obliquely from the front right side.
Figure 6:
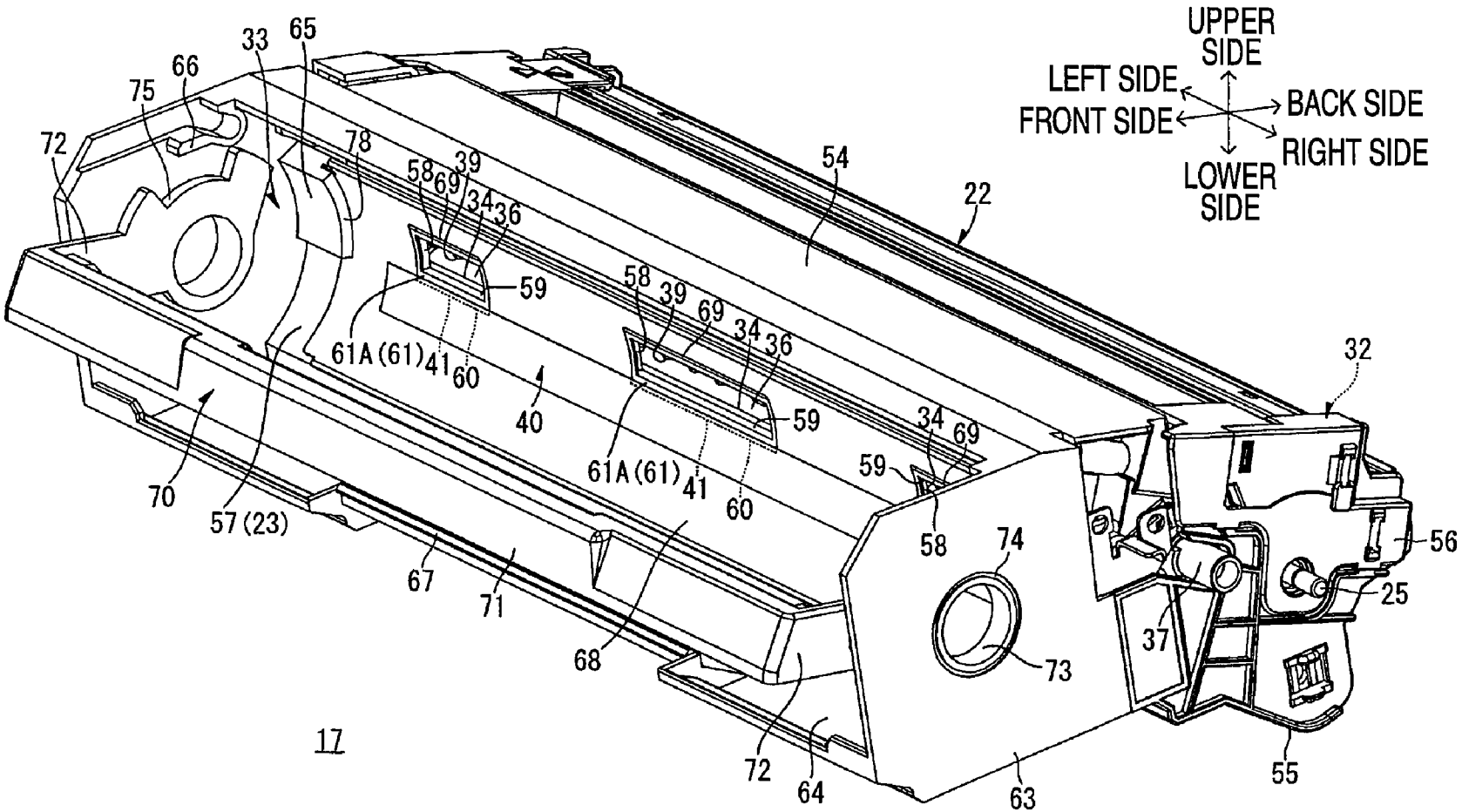
FIG. 6 is a diagram showing a state where the process cartridge is omitted from FIG. 4.

FIG. 3A is a left side sectional view of the process cartridge of the image forming apparatus shown in FIG. 1, showing a state where the developer cartridge is removed and the swing arm is located at a press releasing position, and FIG. 3B is a partial enlarged view of FIG. 3A. FIG. 4 is a perspective view of the process cartridge shown in FIGS. 2A and 2B as viewed obliquely from the front right side. FIG. 5 is an exploded perspective view of the process cartridge as viewed obliquely from the front right side. FIG. 6 is a diagram showing a state where the process cartridge is omitted from FIG. 4.

(1) Process Frame

As shown in FIGS. 3A and 3B, the developing part 32 and the cartridge housing part 33 are formed in the process frame 22.

(1-1) Developing Part

As shown in FIGS. 3A, 3B and 4, the developing part 32 is formed in a space that is partitioned by an upper wall 54, a bottom wall 55, both side walls 56 and the partition wall 23. Both side walls 56 extend in the front-rear direction and are disposed opposite to each other with a gap therebetween in the width direction.

As shown in FIGS. 2A and 2B, a curved portion 57 is formed in the middle of the partition wall 23 in the vertical direction. The front side surface of the curved portion 57 is smoothly recessed backward along the outer circumferential surface of the developer cartridge 31. The frame-side passage hole 34 is formed in the curved portion 57. As shown in FIG. 6, three frame-side passage holes 34 are formed in the width direction with predetermined intervals. Each of the frame-side passage holes 34 has a substantially rectangular shape elongated in the width direction thereof and faces the cartridge housing part 33.

As shown in FIGS. 3A and 3B, a frame seal 58 for preventing the leakage of the developer from the frame-side passage hole 34 to the cartridge housing part 33 is attached to the front surface of the curved portion 57.

The frame seal 58 serves as an example of a second elastic member. The frame seal 58 is made of an elastic material, such as urethane sponge, and has a band shape that extends in the width direction. Three cutout portions 59 are formed at predetermined intervals in the width directions so as to correspond to the frame-side passage holes 34. The cutout portion 59 serves as an example of a second passage hole. Each of the cutout portions 59 is a passage hole having a size that is substantially equal to that of the corresponding frame-side passage hole 34 and communicates with the corresponding frame-side passage holes 34 from the front side so as to be opposite thereto. In this state, the frame seal 58 protrudes toward the cartridge housing part 33 such that the cutout portions 59 surround the corresponding frame-side passage holes 34.

(1-2) Cartridge Housing Part

As shown in FIG. 5, the cartridge housing part 33 is a space that is partitioned by both side plates 63, a bottom plate 64 and the partition wall 23. Both side plates 63 extend continuous from both side wall 56 of the developing part 32, and the bottom plate 64 extends continuous from the bottom wall 55 of the developing part 32.

Shutter supporting portions 65 are provided on the inner side surfaces in the width direction of both side plates 63. Each of the shutter supporting portions 65 has a square that has a substantially arc shape in a cross-sectional view as viewed from the width direction and protrudes inward from the inner surface of the side plate 63 in the width direction.

A shutter guide portion 78 is provided on the inner side surface in the width direction of each of the shutter supporting portion 65. The shutter guide portion 78 forms a convex claw protruding inward from the inner surface of the shutter supporting portion 65 in the width direction, and is opposite to the curved portion 57 of the partition wall 23 with a small gap therebetween in the front-rear direction. The shutter guide portion 78 has a curved shape having a curvature that is substantially equal to that of the curved portion 57.

Upper fixing portions 66 are provided in the inner side surfaces in the width direction of both side plates 63. Each of the upper fixing portions 66 has substantially a U shape recessed obliquely to the rear lower direction as viewed in the width direction and protrudes inward from the inner side surface in the width direction of the side plate 63. A lower fixing portion 67 protruding slightly to the front side is formed at the center in the width direction of the front edge of the bottom plate 64 (see FIG. 3A).

A shutter 68 opening or closing the frame-side passage holes 34 is provided in the cartridge housing part 33.

The shutter 68 has a substantially rectangular plate shape extending in the width direction and has a curved shape having a curvature that is substantially equal to that of the curved portion 57 of the partition wall 23. The shutter 68 extends between the shutter guide portions 78 in the width direction and extends longer than the shutter guide portion 78 in the vertical direction. Three shutter openings 69 are formed in the shutter 68 at predetermined intervals in the width direction so as to be opposite to the corresponding frame-side passage holes 34. The shutter opening 69 serves as an example of a third opening.

As shown in FIGS. 3A and 3B, the shutter 68 is opposed to the curved portion 57 to which the frame seals 58 are adhered from the front side. Both end portions of the shutter 68 in the width direction are slidably interposed between the curved portion 57 and the shutter guide portions 78.

Accordingly, the shutter 68 is supported freely swing in the vertical direction along the shutter guide portions 78 between an open position (see FIGS. 2A and 2B) where the frame-side passage holes 34 are opened and a closed position (see FIGS. 3A, 3B and 5) where the frame-side passage holes 34 are closed. The position of the shutter 68 when the shutter 68 located at the open position is made to move upward by a predetermined distance is the closed position.

As shown in FIGS. 2A and 2B, when the shutter 68 is located at the open position, the frame-side passage holes 34 and the cutout portions 59 are opposed to the corresponding shutter openings 69 to communicate therewith and are exposed to the outside (front side). At this time, as shown in FIG. 2B, inside circumferential edge portions 61 of the frame seals 58 partitioning the cutout portions 59 are exposed from the corresponding shutter opening 69 to the front side. Particularly, in the inside circumferential edge portion 61, an inside circumferential edge portion below the cutout portion 59 (referred to as a lower circumferential edge portions 61A) protrudes to the front side such that the front side surface thereof is substantially flush with the front surface of the shutter 68. In contrast, in the inside circumferential edge portion 61, a portion above the cutout portion 59 (referred to as an upper circumferential portion 61B) is slightly exposed from the shutter opening 69, but most of the upper circumferential portion is pressed contact with the shutter 68 (a portion of the shutter 68 above the shutter opening 69). In addition, in the frame seal 58, a portion other than the inside circumferential edge portion 61 (a portion that is further away from the cutout portion 59 than the inside circumferential edge portion 61) is compressed between the curved portion 57 of the partition wall 23 and the shutter 68 so as to surround a space between the frame-side passage hole 34 and the shutter opening 69. In this way, it is possible to prevent the leakage of developer from the frame-side passage hole 34 and the shutter opening 69 communicating with each other to the gap between the curved portion 57 and the shutter 68.

When the shutter 68 is located at the closed position, as shown in FIGS. 3A and 3B, the frame-side passage holes 34 and the cutout portions 59 are closed from the front side by the portion of the shutter 68 below the shutter opening 69.

As shown in FIG. 5, a sheet 40 is provided on the front surface of the shutter 68. The sheet 40 is a rectangular sheet that is formed of a flexible material (for example, a PET film, rubber, or a very thin metal plate) and is elongated is the width direction. A length of the sheet 40 in the width direction is greater than a distance between the left end of the left shutter opening 69 and the right end of the right shutter opening 69.

The sheets 40 are provided to extend continuously from the lower end portions of all the shutter openings 69 in the shutter 68. A part of the upper end portion of the sheet 40 (referred to as a damming portion 41) protrudes upward into the shutter openings 69. Specifically, each of the damming portions 41 of the sheet 40 is located at the same position as the corresponding shutter opening 69 in the width direction. As shown in FIG. 2B, the damming portion 41 covers the lower end portions 60 of the corresponding shutter openings 69 from the front side (from the cartridge housing part 33 side). The lower end portions 60 are upstream end portions of the shutter openings 69 in a movement direction of the shutter 68 from the open position to the closed position. In addition, an upper side in the vertical direction means a downstream side in the direction in which the shutter 68 is moved from the open position to the closed position (that is, the movement direction of the shutter is upward), and a lower side in the vertical direction means an upstream side in the direction in which the shutter 68 is moved from the open position to the closed position. Therefore, the rear side surfaces (referred to as adhesive surfaces 42) of portions of the sheet 40 below the damming portion 41 are adhered from the front side surface of portions below the shutter openings 69 of the shutter 68.

The adhesive surface 42 of the sheet 40 is adhered to the front side surface of the shutter 68 such that the damming portion 41 protrudes from the downside in the corresponding shutter opening 69. The length (protruding length) of the damming portion 41 protruding toward the inside of the shutter opening 69 is set to, for example, 0.5 mm (a maximum of 1.0 mm). Therefore, the damming portion 41 protrudes more upward than a portion (referred to as a lower circumferential edge portion 68A) of the shutter 68 that defines the lower end portion 60 of the shutter opening 69 in the shutter 68. That is, when the damming portion 41 and the lower circumferential edge portion 68A of the shutter 68 are referred to as a protruding portion 76, the protruding portion 76 is provided at the lower end portion 60 of the shutter opening 69 of the shutter 68. In the protruding portion 76, the front end (the damming portion 41) protrudes more upward than the rear end (the lower circumferential edge portion 68A). In addition, as shown in FIGS. 3A and 3B, an angle formed between the protruding direction of the damming portion 41 and the horizontal surface when the shutter 68 is located at the close position is, for example, 40°.

As shown in FIG. 5, the cartridge housing part 33 includes a swing arm 70. The swing arm 70 has substantially a U shape in a plan view. The swing arm 70 includes a grip rod 71 extending in the width direction and arm side plates 72 extending from both end portions of the grip rod 71 in the width direction to the rear side.

A boss 73 protruding outward in the width direction is disposed in the rear end portion of each of the arm side plates 72. Each of the bosses 73 is rotatably supported by a round hole 74 formed in the corresponding side plate 63.

A receiving concave portion 75 cut recessed downward is formed at the upper end of the rear end portion of each of the arm side plates 72.

The swing arm 70 swings about the bosses 73 of the arm side plates 72 between a press releasing position (see FIGS. 3A, 3B and 5) where the lower ends of the arm side plates 72 contact the front end of the bottom plate 64 and a pressing position (see FIGS. 2A, 2B, 4 and 6) where the developer cartridge 31 is pressed from the front side when the developer cartridge 31 is accommodated in the cartridge housing part 33.

(2) Developer Cartridge

Figure 7A:
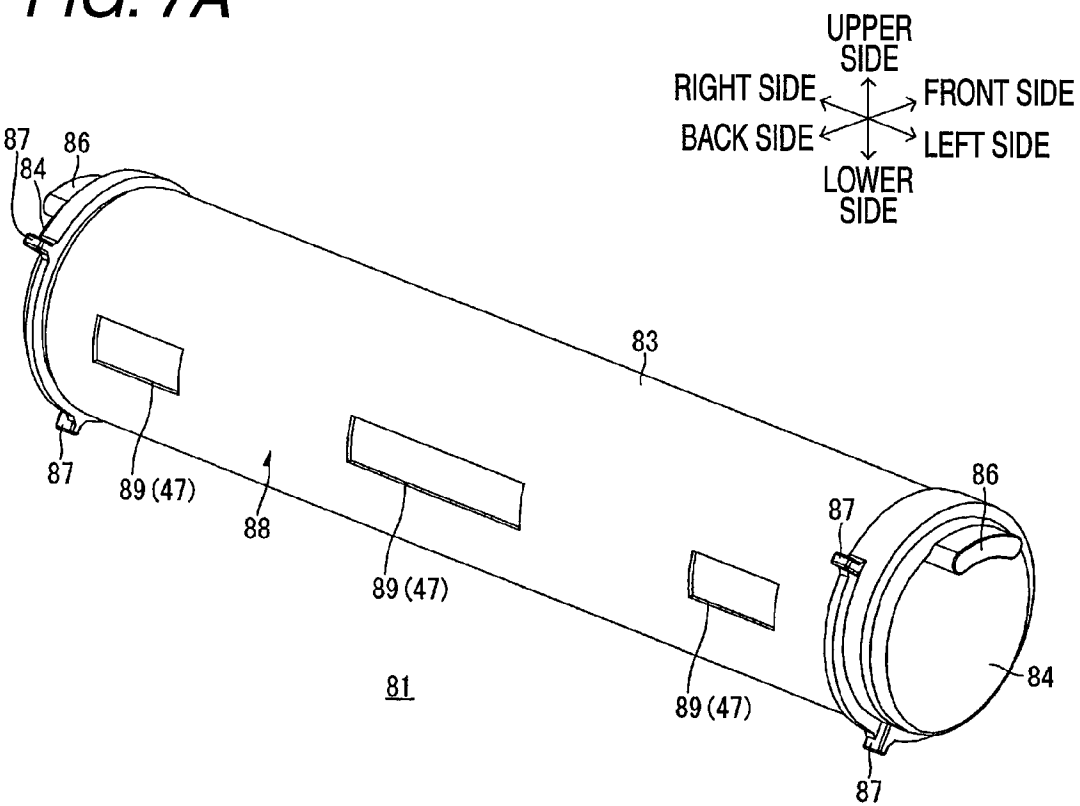
FIG. 7A is a perspective view of an inside housing of the developer cartridge as obliquely viewed from a rear left side, showing a state where a developer seal is not adhered.
Figure 7B:
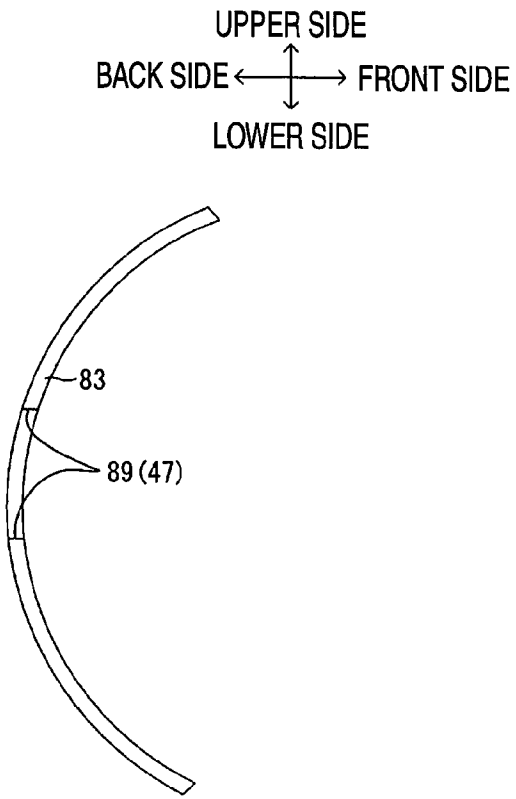
FIG. 7B is a partial sectional view of the inside housing shown in FIG. 7A around an inside passage hole.
Figure 8B:
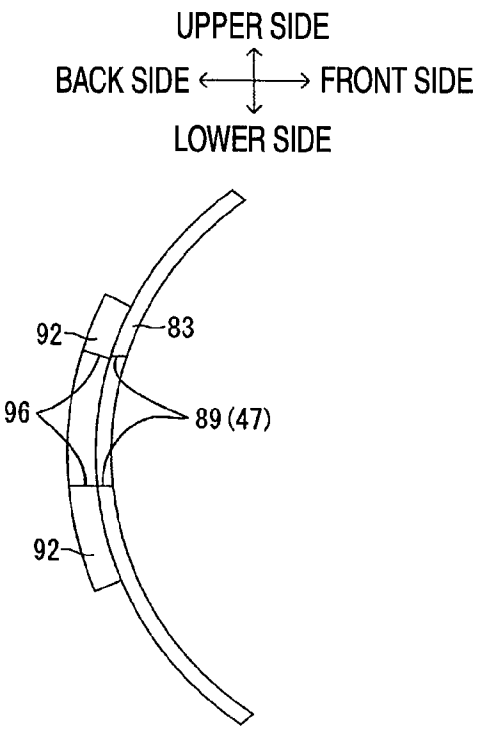
FIG. 8B is a diagram showing a state where the developer seal is adhered in FIG. 7B.
Figure 8A:
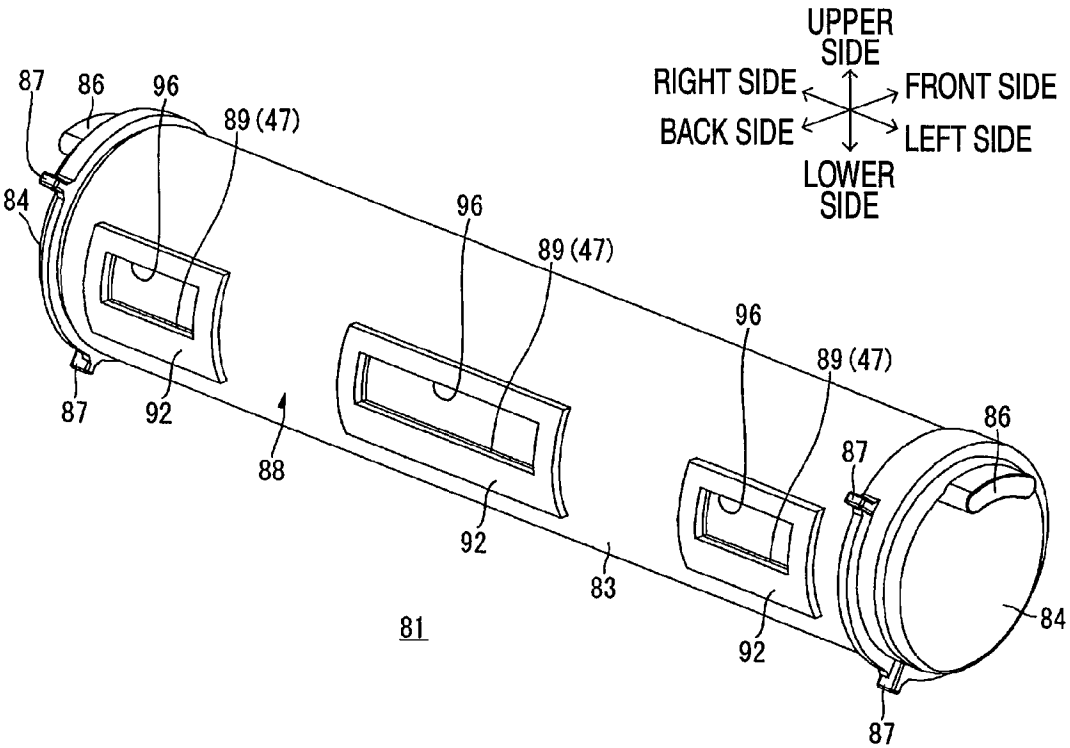
FIG. 8A is a diagram showing a state where the developer seal is adhered in FIG. 7A.
Figure 9A:
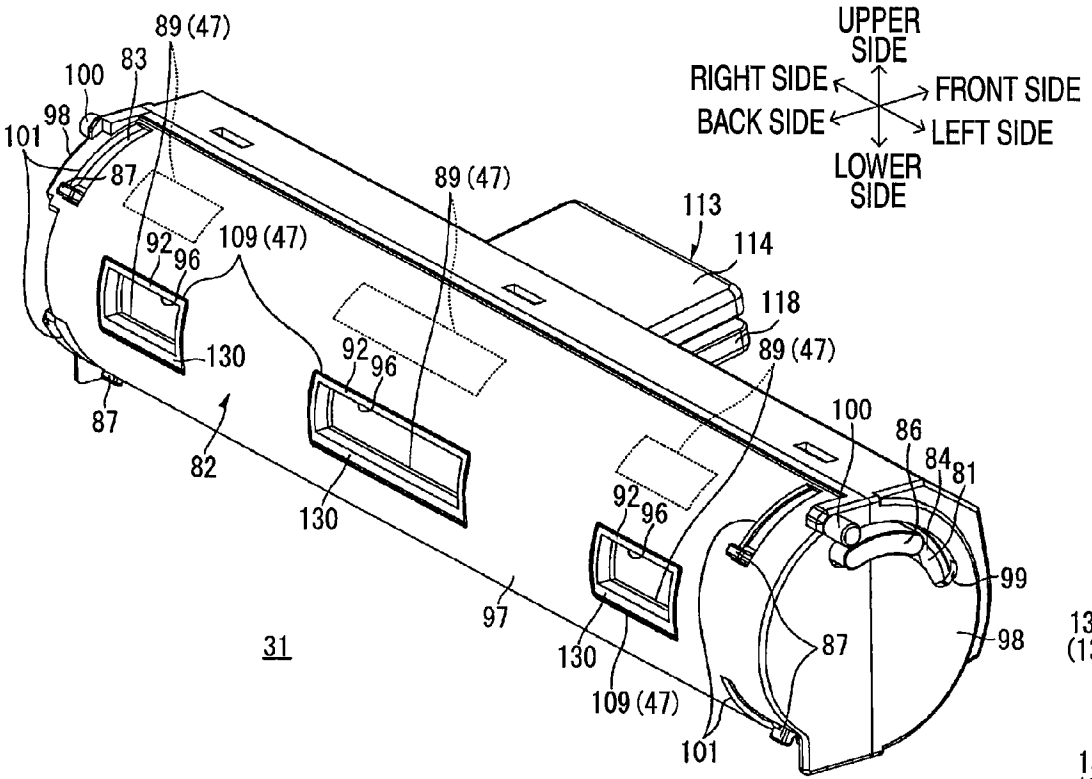
FIG. 9A is a perspective view of the developer cartridge as obliquely viewed from the rear left side, showing a state where the inside housing is located at an open position.
Figure 9B:
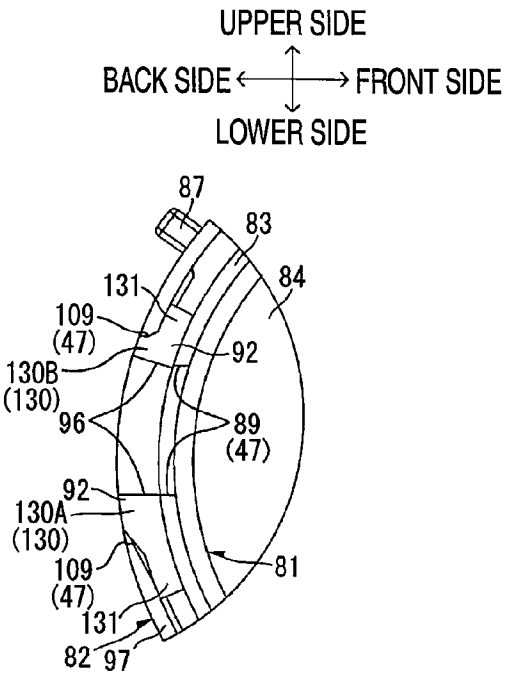
FIG. 9B is a partial sectional view of the developer cartridge shown in FIG. 9A around a cartridge-side through hole.

FIG. 7A is a perspective view of an inside housing of the developer cartridge as viewed obliquely from a rear left side, showing a state where a developer seal is not adhered, and FIG. 7B is a partial sectional view of the inside housing shown in FIG. 7A. FIG. 8A is a diagram showing a state where the developer seal is adhered in FIG. 7A, and FIG. 8B is a diagram showing a state where the developer seal is adhered in FIG. 7B. FIG. 9A is a perspective view of the developer cartridge as obliquely viewed from the rear left side, showing a state where the inside housing is located at an open position, and FIG. 9B is a partial sectional view of the developer cartridge shown in FIG. 9A around a cartridge-side passage hole.

As shown in FIGS. 7A to 9B, the developer cartridge 31 includes an inside housing 81 that accommodates developer and an outside housing 82 that accommodates the inside housing 81.

(2-1) Inside Housing

As shown in FIG. 7A, the inside housing 81 integrally includes an inside circumferential wall 83 having a cylindrical shape that extends in the width direction and a pair of inside side walls 84 that has a disc shapes and closes both end portions in the width direction of the inside circumferential wall 83. In the following description, as long as it is not particularly specified, it is assumed that inside passage holes 89 (which will be described later) face rear side.

A slide protrusion 86 is provided in one position (upper end portion in FIG. 7A) of the circumferential edge portion of the inside side wall 84. The slide protrusion 86 has an arc shape along the outer circumferential surface of the inside side wall 84 in a side view and protrudes outward in the width direction from the inside side wall 84.

A pair of interposing protrusions 87 are provided in a rear end portion of the inside side wall 84 so as to protrude from the outer circumferential surface in the diameter direction. The pair of interposing protrusions 87 is arranged on the outer circumferential surface of the inside side wall 84 with a gap therebetween (a gap corresponding to a circumferential length of the shutter 68) in the circumferential direction.

In the inside circumferential wall 83, inside passage holes 89 forming a part of the cartridge-side passage holes 47 are formed in a surrounding portion 88 that is surrounded by a pair of interposing protrusions 87 (four interposing protrusions 87) arranged at both end portions in the width direction.

Each of the inside passage holes 89 has a substantially rectangular shape that is elongated in the width direction in a rear view. Specifically, three inside passage holes 89 are formed at predetermined intervals in the width direction so as to correspond to three frame-side passage holes 34 (see FIG. 6). During an image forming process, the inside passage holes 89 are opposed to the corresponding frame-side passage holes 34 (see FIG. 6) and the corresponding cutout portion 59 of the shutter 68 (see FIG. 6) in the width direction.

As shown in FIGS. 8A and 8B, in the surrounding portion 88, three developer seals 92 for preventing the developer from leaking from the inside passage holes 89 are adhered to the inside passage holes 89. The developer seal 92 serves as an example of a first elastic member. The developer seal 92 is formed of an elastic material, such as urethane sponge, and has a rectangular band shape that is elongated in the width direction. The developer seal 92 has a substantially uniform length (thickness) in the front-rear direction in a rear view. In each of the developer seals 92, a cutout portion 96 that passes through the corresponding developer seal 92 in the front-rear direction is formed at a position that slightly deviates upward from the center position of the developer seal 92 in a rear view so as to correspond to the inside passage hole 89. The cutout portion 96 serves as an example of a first passage hole. Each of the cutout portions 96 has a substantially rectangular shape in a rear view and has a size that is substantially equal to that of the corresponding inside passage hole 89. The cutout portion 96 is opposed to the corresponding inside passage hole 89. In this way, each of the developer seals 92 protrudes to the outside so as to surround the inside passage hole 89 corresponding to the cutout portion 96.

As shown in FIG. 2A, the agitator 93 is provided in the inside housing 81. The agitator 93 includes an agitator shaft 94 that extends in the width direction thereof and an agitation blade 95 that extends from the agitator shaft 94 to the outside in the diameter direction. The agitator shaft 94 is rotatably supported by both inside side walls 84 and rotates with a driving force from a motor (not shown) during an image forming process.

(2-2) Outside Housing

The outside housing 82 is formed to be slightly larger than the inside housing 81 in the width direction and the diameter direction so as to rotatably house the inside housing 81. As shown in FIG. 9A, the outside housing 82 integrally includes an outside circumferential wall 97 having a substantially cylindrical shape that extends in the width direction and a pair of outside side walls 98 that has a substantially disc shape and closes both end portions of the outside circumferential wall 97 in the width direction. The outside circumferential wall 97 and the outside side walls 98 are integrally formed with each other. In the following description, as long as it is not particularly mentioned, it is assumed that an outside passage hole 109 (which will be described later) faces the rear side.

In the outer circumferential surface of the outside circumferential wall 97, an upper portion and a portion of an upper part of the front side have a flat shape. The inner circumferential surface of the outside circumferential wall 97 has a circular shape in a cross-sectional view (see FIGS. 2A and 2B).

Slide holes 99 through which the slide protrusion 86 passes are formed in upper portions of the outside side walls 98. The slide holes 99 are arranged so as to face the slide protrusions 86 in the width direction. Each of the slide holes 99 has an arc shape that is longer than the slide protrusion 86 in a side view. A boss 100 that protrudes to the outside in the width direction is provided on an upper end portion of the outside side wall 98. Four long holes 101 through which a pair of interposing protrusions 87 (four interposing protrusions 87) are inserted are formed at both end portions of the outside circumferential wall 97 in the width direction. Each of the long holes 101 is arranged to face the corresponding interposing protrusion 87 in the diameter direction. Each of the long hole 101 has a substantially rectangular shape that extends in the vertical direction in a rear view, and has a length corresponding to the swing range of the shutter 68 from the open position and the closed position.

In the outside circumferential wall 97, outside passage holes 109 forming a part of the cartridge-side passage holes 47 are formed between the four long holes 101 (between two upper long holes 101 and two lower long holes 101).

Specifically, three outside passage holes 109 are formed at predetermined intervals in the width direction so as to correspond to three inside passage holes 89 and three frame-side passage holes 34 (see FIG. 6), respectively. Each of the outside passage holes 109 has a substantially rectangular shape in a rear view that is larger than the corresponding inside passage hole 89. During an image forming process, the outside passage holes 109 are opposed to the inside passage holes 89, the cutout portions 96 of the developer seal 92, the frame-side passage holes 34 (see FIG. 6), the cutout portions 59 of the frame seal 58 (see FIG. 6), and the shutter openings 69 of the shutter 68 (see FIG. 6) in the width direction.

A grasp portion 113 is formed on the front side of the outside circumferential wall 97. As shown in FIG. 2A, the grasp portion 113 includes an upper grasp plate 114 that protrudes from the upper end portion of the outside circumferential wall 97 to the front side and a locking arm 115 that has a substantially J shape in a side view and extends downward below the upper grasp plate 114. An upper end portion of the locking arm 115 is swingably supported by a supporting shaft (not shown) that is provided below the upper grasp plate 114. A locking claw 117 that is locked to the lower fixing portion 67 is provided at a lower end portion of the locking arm 115. A lower grasp plate 118 that protrudes forward is integrally formed with the locking arm 115 in the vicinity of the lower end portion of the locking arm 115. The lower grasp plate 118 is arranged so as to extend substantially in parallel to the upper grasp plate 114 with a gap therebetween, and a compression spring (not shown) urging the plates in the direction in which they get apart from each other is interposed between the upper grasp plate 114 and the lower grasp plate 118.

(2-3) Relative Arrangement of Inside Housing and Outside Housing

The inside housing 81 is rotatably housed in the outside housing 82.

Specifically, the outer circumferential surface of the inside circumferential wall 83 is fitted to be slidable relative to the inner circumferential surface of the outside circumferential wall 97 in the circumferential direction. More specifically, the developer seals 92 provided on the outer circumferential surface of the inside circumferential wall 83 come into contact with the inner circumferential surface of the outside circumferential wall 97, and the developer seal 92 slides relative to the inner circumferential surface of the outside circumferential wall 97. As shown in FIG. 9A, the slide protrusions 86 are fitted into the corresponding slide holes 99. The interposing protrusions 87 are fitted into the corresponding long holes 101, and the interposing protrusions 87 protrude from the long holes 101 to the outside in the diameter direction.

The inside housing 81 is allowed to rotate relative to the outside housing 82 between a closed position (see FIG. 5) where the inside passage holes 89 and the cutout portions 96 of the developer seal 92 are not opposed to the outside passage holes 109 and an open position (see FIG. 5) where the inside passage holes 89 and the cutout portions 96 are opposed to the outside passage holes 109 (see FIGS. 2 and 9).

As shown in FIG. 5, when the inside housing 81 is located at the closed position, the slide protrusions 86 are arranged at the upper end portions of the slide holes 99, and the interposing protrusions 87 are disposed at the upper end portions of the long holes 101. As represented by a dotted line in FIG. 9A, the inside passage holes 89 are disposed above the outside passage holes 109, and the outside passage holes 109 are closed from the inside in the diameter direction by portions below the inside passage holes 89 (indicated by dotted lines) in the inside circumferential wall 83.

Although not shown in the drawings, the developer seals 92 are compressed between the inside circumferential wall 83 and the outside circumferential wall 97 shown in FIG. 9B.

When the inside housing 81 is made to rotate relative to the outside housing 82 in the direction (downward direction) in which the inside passage holes 89 face the outside passage holes 109 and thus the inside passage holes 89 and the cutout portions 96 are opposed to the outside passage holes 109, the inside housing 81 is located at the open position.

When the inside housing 81 is located at the open position, as shown in FIG. 9A, the slide protrusions 86 are located in the rear end portions of the slide holes 99, and the interposing protrusions 87 are located at the lower end portions of the long holea 101. The inside passage holes 89 and the cutout portions 96 are opposed to the corresponding outside passage holes 109, and they communicate with each other.

In the state where the inside housing 81 is located at the open position, an inside circumferential edge portion 130 defining the cutout portions 96 in the developer seals 92 are exposed from the corresponding outside passage holes 109.

Specifically, as shown in FIG. 9B, the inside circumferential edge portions 130 protrude outward in the diameter direction so that the outside surface in the diameter direction is substantially flush with the outer surface of the outside circumferential wall 97. Portions (being more apart from the cutout portions 96 than the inside circumferential edge portions 131 and being referred to as outside circumferential edge portions 130) of the developer seals 92 other than the inside circumferential edge portions 130 are compressed between the outside circumferential wall 97 and the inside circumferential wall 83 so as to surround the corresponding inside passage holes 89. Accordingly, to the developer is prevented from leaking from the inside passage holes 89 and the outside passage holes 109 communicating with each other to a gap between the outside circumferential wall 97 and the inside circumferential wall 83.

(3) Mount and Removal of Developer Cartridge to or from Process Frame (3-1) Mount of Developer Cartridge to Process Frame As shown in FIG. 5, in order to mount the developer cartridge 31 to the process frame 22, a user holds the upper grasp plate 114 and the lower grasp plate 118 such that they are close to each other against the urging force of a compression spring (not shown). Then, the user mounts the developer cartridge 31 (the developer cartridge 31 having the inside housing 81 arranged at the closed position) to the cartridge housing part 33 (the cartridge housing part 33 in which the shutter 68 is disposed at the closed position and the swing arm 70 is disposed at the press releasing position).

In this way, the developer cartridge 31 is mounted to the bottom plate 64. In this case, the bosses 100 are fitted into the upper fixing portions 66, and the slide protrusions 86 are fitted into the receiving concave portions 75. Therefore, as shown in FIG. 2A, two pairs of interposing protrusions 87 at both end portions of the developer cartridge 31 in the width direction hold the upper and lower ends of both end portions of the shutter 68 in the width direction.

Then, when the upper grasp plate 114 and the lower grasp plate 118 are unclamped, the locking arm 115 swings by the urging force of the compression spring, and the locking claw 117 is locked to the lower fixing portion 67. In this way, the developer cartridge 31 is accommodated in the cartridge housing part 33.

The boss 100 is fitted into the upper fixing portion 66 and the locking claw 117 is fixed to the lower fixing portion 67, thereby fixing the outside housing 82 to the cartridge housing part 33. In this case, although not shown in the drawings, the frame-side passage hole 34 and the corresponding cartridge-side passage hole 47 (specifically, the outside passage hole 109) are opposed to each other in the front-rear direction, with the shutter 68 disposed at the closed position interposed therebetween. That is, in the shutter 68, the front side means a side close to the cartridge-side passage hole 47 (the cartridge housing part 33), and the rear side means a side close to the frame-side passage hole 34 (a side that is further away from the cartridge housing part 33 than the front side). In addition, the shutter opening 69 (see FIG. 3) of the shutter 68 at the closed position is separated upward from a space between the frame-side passage hole 34 and the cartridge-side passage hole 47 (specifically, the outside passage hole 109).

The swing arm 70 swings from the press releasing position to the pressing position. In this way, the slide protrusions 86 fitted into the receiving concave portions 75 (see FIG. 5) slide backward through the slide holes 99 with the swing of the arm side plates 72 and are arranged at the rear end portions of the slide holes 99 (see FIG. 9A). Then, two pairs of interposing protrusions 87 at both end portions in the width direction slide downward through the long holes 101 while holding the shutter 68 therebetween and are arranged at the lower end portions of the long holes 101 (see FIG. 9A).

In this way, the inside housing 81 is disposed at the open position. As shown in FIGS. 2A and 9, the inside passage holes 89 and the cutout portions 96 of the developer seals 92 are opposed to the corresponding outside passage holes 109 substantially in the horizontal direction, such that they communicate with each other. In addition, when the shutter 68 is disposed at the open position, the frame-side passage holes 34 and the cutout portions 59 of the frame seals 58 are opposed to the corresponding shutter openings 69 and the corresponding cartridge-side passage holes 47 (which include the inside passage holes 89, the cutout portions 96, and the outside passage holes 109 that communicate with each other) substantially in the horizontal direction, such that they communicate with each other. Here, the shutter opening 69 of the shutter 68 at the open position is arranged between the frame-side passage hole 34 and the cartridge-side passage hole 47.

As shown in FIG. 2B, when both the inside housing 81 and the shutter 68 are at the open position, the inside circumferential edge portion 130 of each of the developer seals 92 that protrude up to the outside in the diameter direction of the outside circumferential wall 97 protrudes backward so as to surround the corresponding shutter opening 69. Specifically, in the inside circumferential edge portion 130, an inside circumferential edge portion below the cutout portion 96 (referred to as a lower circumferential edge portions 130A) comes into pressure contact with the lower circumferential edge portions 61A below the cutout portion 59 of the frame seal 58. In the inside circumferential edge portion 130 of the developer seal 92, an inside circumferential edge portion above the cutout portion 96 (referred to as an upper circumferential portion 130B) comes into pressure contact with the shutter 68 (a portion of the shutter 68 above the shutter opening 69). A portion of the shutter 68 above the shutter opening 69 is arranged between a portion of the frame seal 58 above the cutout portion 59 (an upper circumferential portion 61B) and a portion of the developer seal 92 above the cutout portion 96 (an upper circumferential portion 130B).

In this way, space between the inside passage holes 89 and the frame-side passage holes 34 are covered by the frame seals 58, the developer seals 92 and the shutter 68 without any gap therebetween. Therefore, the developer is prevented from leaking between the inside passage holes 89 and the frame-side passage holes 34.

Between the lower circumferential edge of the inside passage hole 89 and the lower circumferential edge of the frame-side passage hole 34, a flat surface 77 along substantially the horizontal direction is formed continuously by the lower circumferential edge portion 61A of the frame seal 58 and the lower circumferential edge portion 130A of the developer seal 92. The protruding portion 76 (the lower circumferential edge portion 68A of the shutter 68 and the damming portion 41 of the sheet 40) is disposed below the flat surface 77 (the lower end of the inside passage hole 89 and the lower end of the frame-side passage hole 34). That is, an upper end 40A (the upper end of the damming portion 41) of the sheet 40 and an upper end 68*b* (the lower end of the shutter opening 69 of the shutter 68) of the lower circumferential edge portion 68A of the shutter 68 are not exposed from the cutout portion 59 of the frame seal 58 is disposed below the lower ends of the cutout portion 59.

During an image forming process, the developer in the inside housing 81 is supplied to the developing part 32 with the agitation of the agitator 93 through the inside passage holes 89, the cutout portions 96 of the developer seals 92, the outside passage holes 109, the shutter openings 69, the cutout portions 59 of the frame seals 58, and the frame-side passage holes 34 substantially in the horizontal direction, as indicated by a solid arrow in the drawings. At this time, the developer moves over the flat surface 77. The developer may be made to circulate between the developing part 32 and the developer cartridge 31. In this case, the developer in the developer cartridge 31 is supplied to the developing part 32 through the cartridge-side passage hole 47 (see FIG. 9A) and the frame-side passage hole 34 (see FIG. 6) located at the center in the width direction, and is supplied to the supply roller 36 while being conveyed to both sides in the width direction by the auger 39. In contrast, some developer is returned to the developer cartridge 31 through the frame-side passage holes 34 and the cartridge-side passage holes 47 located at both sides of the developer cartridge in the width direction.

(3-2) Removal of Developer Cartridge from Process Frame

In order to remove the developer cartridge 31 from the process frame 22, first, the swing arm 70 is made to swing from the pressing position to the press releasing position (see FIG. 3A).

By allowing the swing arm 70 to swing from the pressing position to the press releasing position, the slide protrusions 86 inserted into the receiving concave portions 75 slide forward in the slide holes 99 with the swing of the arm side plates 72 and are located in the front end portions of the slide holes 99, as shown in FIG. 5. Then, the pair of interposing protrusions 87 on both sides in the width direction shown in FIGS. 2A and 2B slide upward in the long holes 101 with the shutter 68 interposed therebetween and are located in the upper end portions of the long holes 101 (see FIG. 5).

Accordingly, in the developer cartridge 31, when the inside housing 81 is located at the closed position, and the lower portion of the surrounding portion 88 (see FIG. 8A) is opposed to the outside passage holes 109, the outside passage holes 109 are closed. In addition, when the shutter 68 is located at the closed position, the frame-side passage holes 34 and the cutout portions 59 of the frame seals 58 are opposed to the shutter 68 and are then closed (see FIGS. 3A and 3B).

Then, by grasping the upper grasp plate 114 and the lower grasp plate 118 shown in FIG. 2A in the direction in which they get close to each other, the locking claws 117 are unlocked from the lower fixing portion 67. Accordingly, as shown in FIG. 5, when the developer cartridge 31 is drawn forward from the cartridge housing part 33 to the outside, the developer cartridge 31 is removed from the process frame 22.

In the process cartridge 17, as shown in FIGS. 2A and 2B, when the developer cartridge 31 is housed in the cartridge housing part 33 and the shutter 68 is located at the open position, the cartridge-side passage holes 47 of the developer cartridge 31 and the frame-side passage holes 34 of the process frame 22 are opposed to each other with the shutter openings 69 interposed therebetween to communicate with each other. Specifically, the cartridge-side passage holes 47, the frame-side passage holes 34, and the shutter openings 69 are aligned substantially in the horizontal direction. Accordingly, the developer accommodated in the developer cartridge 31 can move between the developer cartridge 31 and the process frame 22 (specifically, the developing part 32) through the cartridge-side passage holes 47, the frame-side passage holes 34 and the shutter openings 69. The frame seals 58 of the process frame 22 come into contact with the developer seals 92 of the developer cartridge 31, and the spaces between the cartridge-side passage holes 47 and the frame-side passage holes 34 are surrounded with the cutout portion 96 of the developer seals 92 and the cutout portions 59 of the frame seals 58 without any gap therebetween. Accordingly, it is possible to prevent the developer from leaking between the cartridge-side passage holes 47 and the frame-side passage holes 34.

In contrast, when the shutter 68 is located at the closed position, the shutter openings 69 get apart from the positions between the cartridge-side passage holes 47 and the frame-side passage holes 34. Accordingly, the cartridge-side passage holes 47 do not communicate with the frame-side passage holes 34, thereby regulating the movement of developer between the developer cartridge 31 and the process frame 22 (see FIGS. 2A to 3B).

When the shutter 68 is made to move upward from the open position to the closed position, the developer being moved between the developer cartridge 31 and the process frame 22 may be attached to the lower end portion 60 (specifically, the upper end 68B of the shutter 68) of the shutter opening 69. In this case, when the developer cartridge 31 is removed from the process frame 22 with the shutter 68 located at the closed position (see FIGS. 3A and 3B), the developer attached to the upper end 68B may overflow the cartridge housing part 33 and scatter to the outside.

However, the protruding portions 76 are provided at the lower end portions 60. In the protruding portions 76, the front ends (damming portions 41) close to the cartridge-side passage holes 47 (close to the cartridge housing part 33) protrude upward more than the rear ends (the lower circumferential circumference edge portions 68A) close to the frame-side passage holes 34 (more apart from the cartridge housing part 33 than the cartridge-side passage holes 47). Accordingly, even when the developer is attached to the lower end portions 60 of the shutter openings 69, the developer is blocked from the cartridge-side passage holes 47 side by the protruding portions 76. Therefore, it is possible to prevent developer from overflowing the cartridge housing part 33 and being scattered to the outside.

When the shutter 68 is located at the open position, the protruding portions 76 are located below the lower ends of the cartridge-side passage hole 47 and the frame-side passage hole 34. Accordingly, the protruding portion 76 can be made to depart from the flow passage of developer (indicated by the solid arrow in FIG. 2B) moving between the cartridge-side passage hole 47 and the frame-side passage hole 34. Accordingly, the protruding portions 76 do not prevent the flow of developer, and thus the developer can be allowed to smoothly move between the developer cartridge 31 and the process frame 22 (the developing part 32). Since the lower end portions 60 of the shutter openings 69 are also made to depart from the flow of developer moving between the cartridge-side passage holes 47 and the frame-side passage holes 34 along with the protruding portion 76, it is possible to prevent the developer from being attached to the lower end portions 60.

When the shutter 68 is located at the open position, the upper ends 68B of the lower circumferential edge portions 68A of the shutter opening 69 in the shutter 68 are disposed below the lower ends of the cutout portions 96 of the developer seals 92 and the cutout portions 59 of the frame seals 58. Accordingly, the upper end 68B of the shutter 68 can be made to depart from the flow of developer moving between the cartridge-side passage holes 47 and the frame-side passage holes 34. As a result, the upper end 68B does not hinder the flow of developer, thereby allowing the developer to smoothly move between the developer cartridge 31 and the process frame 22 (the developing part 32).

The lower end portions 60 of (specifically, the lower circumferential edge portions 68A of the shutter 68) the shutter openings 69 are located below the contact portions between the lower circumferential edge portions 61A of the frame seals 58 and the lower circumferential edge portions 130A of the developer seals 92. Therefore, the lower end portions 60 do not hinder the flow of developer moving between the cartridge-side passage holes 47 and the frame-side passage holes 34. Accordingly, it is possible to prevent the developer from being attached to the lower end portions 60 when the shutter 68 is located at the open position.

As shown in FIGS. 3A and 3B, the sheet 40 included in the protruding portions 76 protrude into the shutter openings 69 in the front side of the shutter 68 to block the developer attached to the lower end portions 60 of the shutter openings 69 from the front side. Therefore, it is possible to block the developer from leaking to the cartridge housing part 33 and from being scattered outside.

Further, the sheets 40 are flexible. Therefore, even when the shutter 68 has a curved shape, the sheets 40 can be closely attached to the shutter 68. As a result, the sheets 40 can prevent the leakage of the developer attached to the lower end portion 60 of the shutter openings 69 from the front side without any gap.

Further, it is possible to easily bond the sheets 40 to the shutter 68 by bonding the adhesive surfaces 42 of the sheets 40 to a portion of the shutter 68 below the shutter openings 69.

When the sheets 40 have the same color as the developer, the developer attached to the lower end portions 60 of the shutter openings 69 can be made to be invisible. In contrast, when the sheets 40 have a color different from that of the developer, the developer attached to the lower end portions 60 of the shutter openings 69 can be made to be visible and can urge a user to clean the developer in the vicinity of the lower end portion 60 or prevent the user from touching the developer attached to the lower end portion 60 to contaminate his or her hand.

II. Second Exemplary Embodiment

Next, a second exemplary embodiment of the invention will be described. In the second exemplary embodiment, the same components as those in the first exemplary embodiment are denoted by the same reference numerals, and a description thereof will be omitted.

(Image Forming Apparatus)

Figure 17:
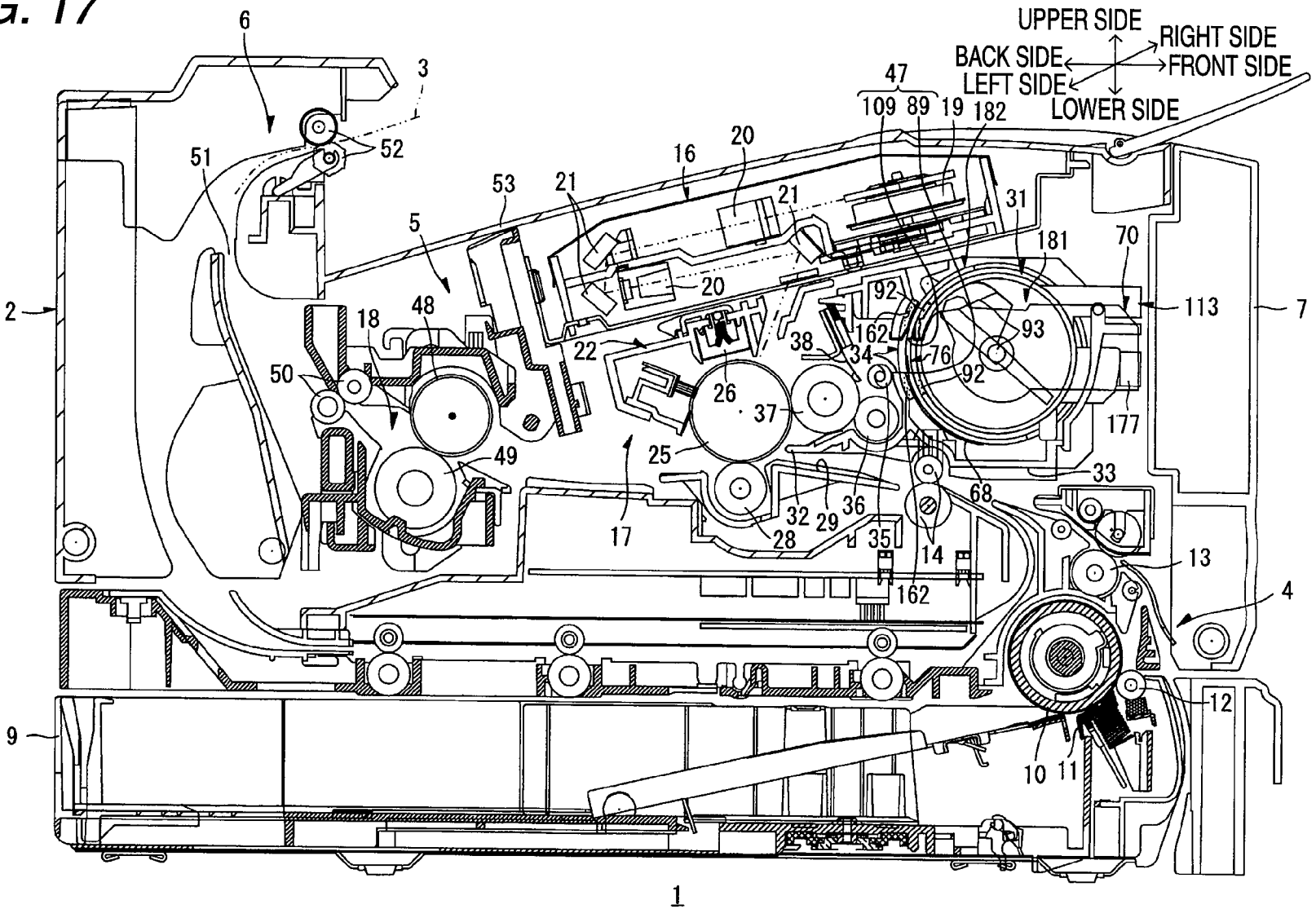
FIG. 17 is a left side sectional view showing an image forming apparatus according to a second exemplary embodiment of the invention.
Figures 18A, 18B:
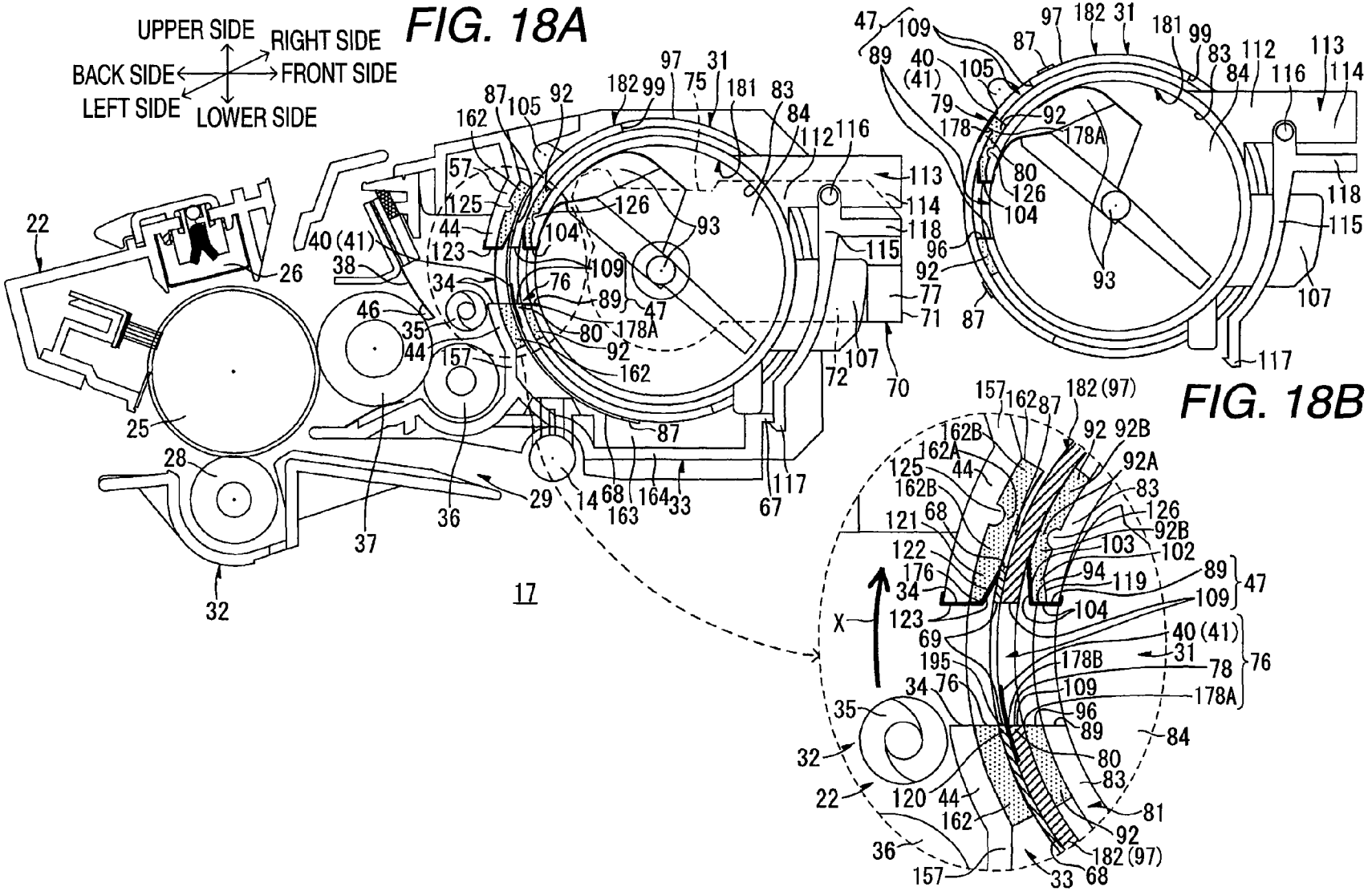
FIG. 18A is a left side sectional view showing a process cartridge of the image forming apparatus shown in FIG. 17, showing a state where a developer cartridge is mounted.
FIG. 18B is a partial enlarged view of FIG. 18A.

FIG. 17 is a left side sectional view showing an image forming apparatus according to the second exemplary embodiment of the invention. FIG. 18A is a left side sectional view showing a process cartridge (having a developer cartridge mounted thereinto) of the image forming apparatus shown in FIG. 17, and FIG. 18B is a left side sectional view showing only the developer cartridge.

As shown in FIG. 17, an image forming apparatus 1 includes a feeder unit 4 that feeds sheets 3, an image forming unit 5 that forms an image on the fed sheet 3, and a sheet discharge part 6 that discharges the sheet 3 having an image formed thereon in a body casing 2.

(1) Body Casing

The body casing 2 has a box shape, and has an opening formed in one side wall thereof. A front cover 7 for opening and closing the opening is provided in the body casing 2. By opening the front cover 7, a process cartridge 17 (which will be described later) as an example of a developing unit is removably mounted to and from the body casing 2.

In the following description, one side where the front cover 7 is provided is referred to as a front side (front face side), and the opposite side thereof is referred to as a rear side (rear face side). In addition, in FIG. 17, a near side of the drawing sheet in the direction perpendicular to the direction that the drawing sheet extends is referred to as the left side and a far side of the drawing sheet in the direction perpendicular to the direction that the drawing sheet extends is referred to as the right side. A horizontal direction (right-left direction) is identical to the width direction. The horizontal direction includes the front-rear direction and the right-left direction. In the description of the process cartridge 17 (which will be described later) and a developer cartridge 31, a frame-side passage hole 34 (which will be described later) as an example of a second opening and a cartridge-side passage hole 47 (which will be described later) are aligned in the horizontal direction.

(2) Feeder Unit

The feeder unit 4 includes a sheet feed tray 9, a sheet feed roller 10, a sheet feed pad 11, paper dust removing rollers 12 and 13, and a registration roller 14. The sheets 3 disposed at the top of the sheet feed tray 9 are fed one by one by the sheet feed roller 10 and the sheet feed pad 11 and then transported to a transfer position (which will be described later) of the image forming unit 5 through the rollers 12 to 14.

(3) Image Forming Unit

The image forming unit 5 includes a scanner unit 16, the process cartridge 17, and a fixing part 18.

(3-1) Scanner Unit

The scanner unit 16 is provided at an upper part in the body casing 2, and includes a laser beam emitting unit (not shown), a polygon mirror 19 that is rotated, a plurality of lenses 20, and a plurality of reflecting mirrors 21. A laser beam that is emitted by the laser beam emitting unit on the basis of image data is reflected from the polygon mirror 19 and then passes through or is reflected from the plurality of lenses 20 and the plurality of reflecting mirrors 21 to be incident on the surface of a photosensitive drum 25 (which will be described later) of the process cartridge 17, as represented by a two-dot chain line.

The process cartridge 17 is accommodated in the body casing 2 below the scanner unit 16 and above the feeder unit 4.

As shown in FIG. 18, the process cartridge 17 includes a process frame 22, in which a transfer path 29 for allowing the passage of the sheet 3 is formed, and a developer cartridge 31 that is removably mounted to a cartridge housing part 33 (which will be described later) of the process frame 22. The process frame 22 serves as an example of a housing.

A partition wall 157 that extends in the vertical direction is provided substantially at the center of the process frame 22 in the front-rear direction thereof. In the process frame 22, a rear portion of the partition wall 157 corresponds to a developing part 32, and a front portion of the partition wall 157 corresponds to the cartridge housing part 33. The frame-side passage holes 34 are formed in the partition wall 157.

The developing part 32 includes a photosensitive drum 25, a scorotron-type charger 26, a transfer roller 28, an auger 35, a supply roller 36, a developing roller 37, and a thickness regulating plate 38.

The scorotron-type charger 26 is arranged above the photosensitive drum 25 with a predetermined gap from the photosensitive drum 25. The transfer roller 28 is arranged below the photosensitive drum 25 so as to come into pressure contact with the photosensitive drum 25. The developing roller 37 is provided in front of the photosensitive drum 25 so as to come into pressure contact with the photosensitive drum 25. The supply roller 36 is provided in front of the developing roller 37 so as to come into pressure contact with the developing roller 37. The thickness regulating plate 38 is a thin leaf spring that extends downward toward the developing roller 37, and a pressing rubber 46 that is provided at the lower end portion of the leaf spring comes into pressure contact with the surface of the developing roller 37 by the elastic force of the thickness regulating plate 38. The auger 35 is opposed to the rear side of the frame-side passage hole 34. The auger 35 includes a shaft that extends in the width direction thereof and a screw that is provided on the circumferential surface of the shaft, which are integrally formed with each other.

The developer cartridge 31 has a substantially cylindrical shape whose central axis extends in the width direction. Cartridge-side passage holes 47 are formed in the developer cartridge 31 such that the inside and the outside of the developer cartridge communicate with each other.

An agitator 93 is provided in the developer cartridge 31. In addition, a positively chargeable, non-magnetic one component toner as an example of developer is accommodated in the developer cartridge 31.

The developer in the developer cartridge 31 is agitated by rotation of the agitator 93, and then discharged into the developing part 32 through the cartridge-side passage hole 47 and the frame-side passage hole 34. The discharged developer is supplied to the supply roller 36 by the rotation of the auger 35 while being transported from the center of the developer cartridge in the width direction thereof to both sides thereof in the width direction. A portion of the developer returns to the developer cartridge 31 through the frame-side passage holes 34 and the cartridge-side passage holes 47. In this way, developer is circulated between the developer cartridge 31 and the developing part 32 of the process frame 22.

The developer supplied to the supply roller 36 passes between the pressing rubber 46 and the developing roller 37 and is then carried to the surface of the developing roller 37 as a thin layer.

The surface of the photosensitive drum 25 is uniformly charged to a positive polarity by the scorotron-type charger 26, and then exposed by the laser beam (which is indicated by a two-dot chain line in FIG. 17) emitted from the scanner unit 16. In this way, an electrostatic latent image corresponding to image data is formed on the surface of the photosensitive drum 25. Then, the developer carried on the surface of the developing roller 37 is supplied to the electrostatic latent image formed on the surface of the photosensitive drum 25. In this way, the electrostatic latent image is developed (visualized), and a developer image is carried on the surface of the photosensitive drum 25. The developer image is transferred onto the sheet 3 that is transported between the photosensitive drum 25 and the transfer roller 28 (transfer position) along the transfer path 29.

As shown in FIG. 17, the fixing part 18 is provided on the rear side of the process cartridge 17. The fixing part 18 includes a heating roller 48, a pressure roller 49 that is provided below the heating roller 48 so as to come into pressure contact with the heating roller 48, and a pair of conveyance rollers 50 that are provided on the rear side of the heating roller and the pressure roller.

The fixing part 18 thermally fixes the developer transferred onto the sheet 3 at the transfer position while the sheet 3 passes between the heating roller 48 and the pressure roller 49. Then, the sheet 3 is transported to the sheet discharge part 6 by the pair of conveyance rollers 50.

(4) Sheet Discharging Unit

The sheet discharge part 6 includes a sheet discharge path 51, a sheet discharge roller 52, and a sheet discharge tray 53. The sheet 3 transported to the sheet discharge part 6 is transported to the sheet discharge roller 52 along the sheet discharge path 51, and then discharged onto the sheet discharge tray 53 by the sheet discharge roller 52.

(Process Cartridge)

Next, the process frame 22 of the process cartridge 17 and the developer cartridge 31 will be described in detail.

(1) Process Frame

Figure 19:
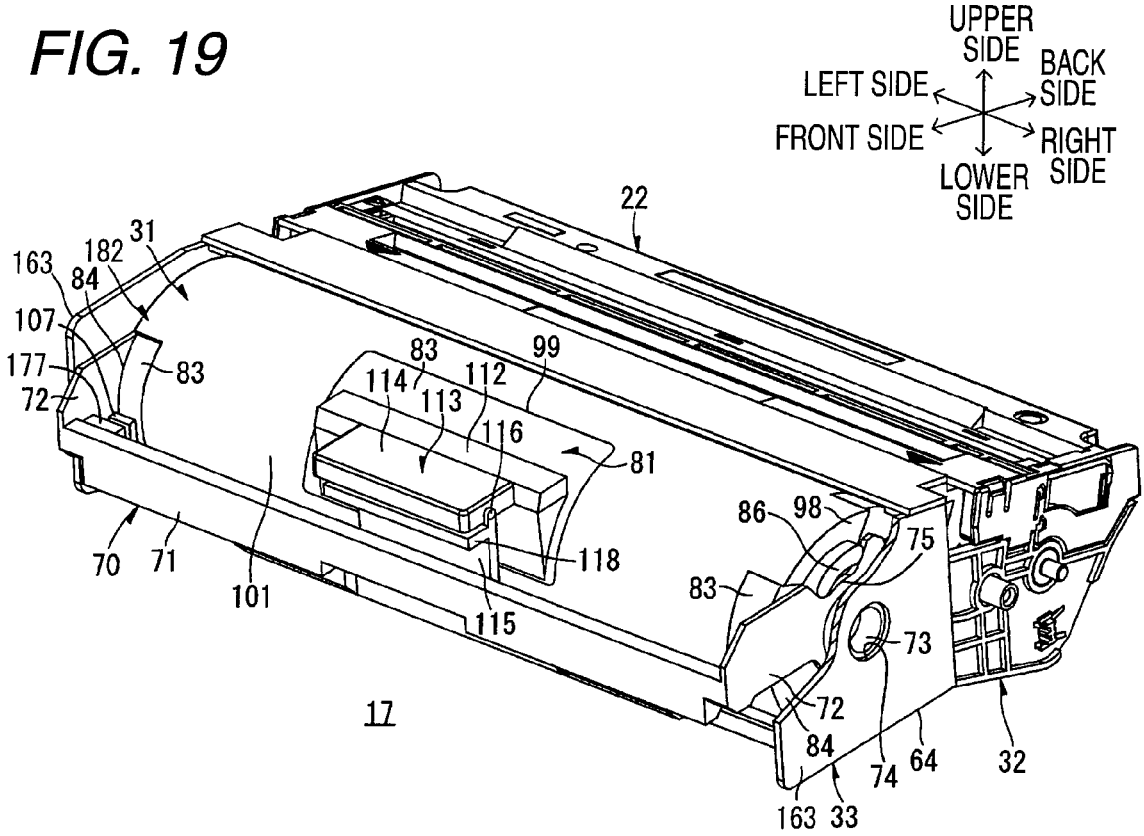
FIG. 19 is a schematic perspective view of the process cartridge shown in FIG. 18A as viewed obliquely from the front right side.
Figure 20:
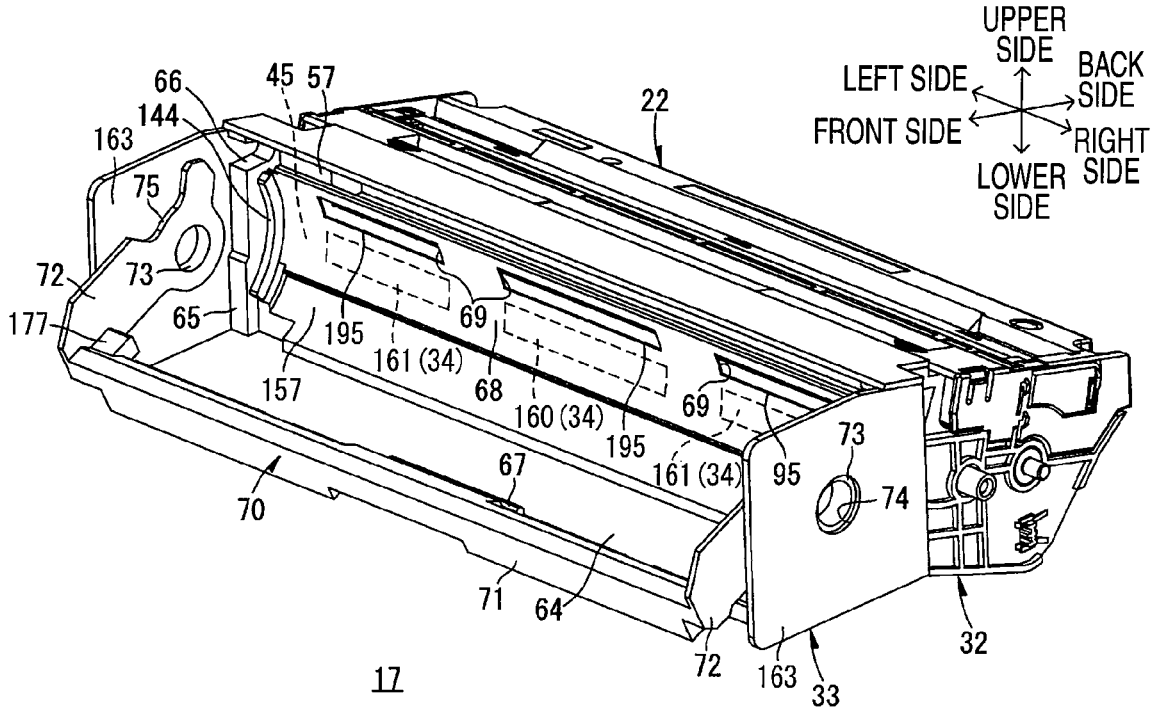
FIG. 20 is a perspective view of the process cartridge as viewed obliquely from the front right side, showing a state where the developer cartridge is removed from FIG. 18A.
Figure 21:
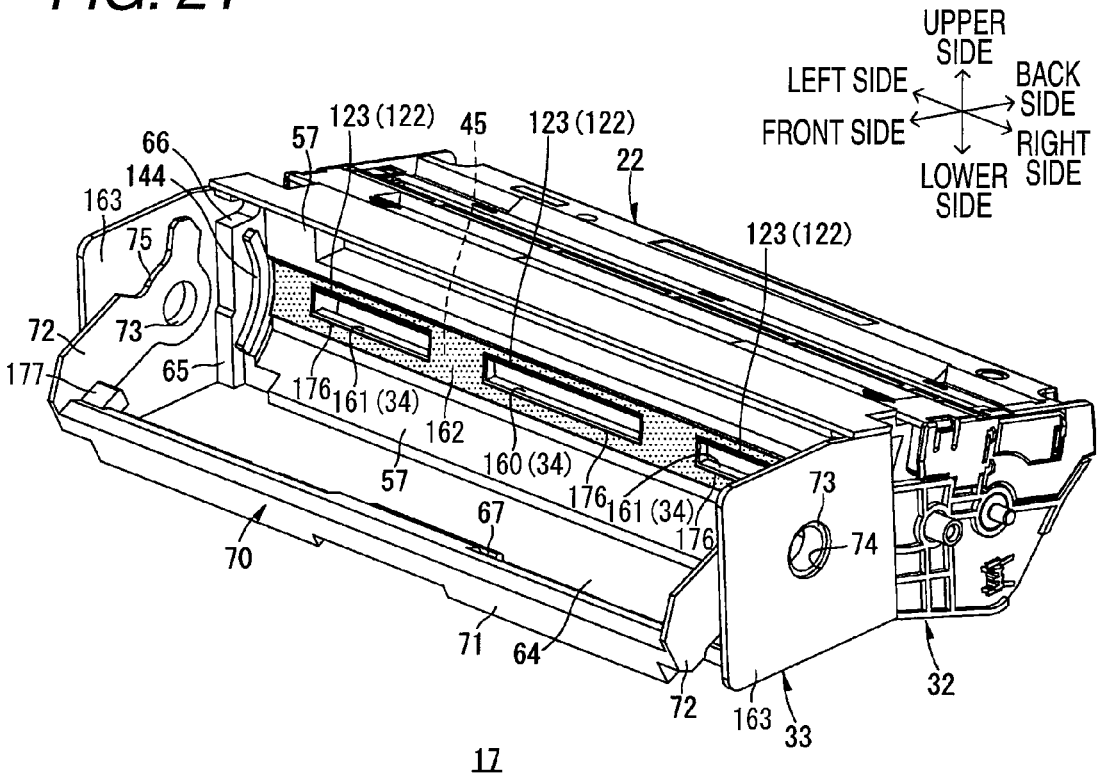
FIG. 21 is a diagram showing a state where a shutter is omitted from FIG. 20.

FIG. 19 is a partial perspective view showing the process cartridge having some parts omitted therefrom shown in FIG. 18A, as obliquely viewed from the front right side. FIG. 20 is a perspective view showing the process cartridge (from which the developer cartridge is removed) shown in FIG. 18A, as obliquely viewed from the front right side. FIG. 21 is a diagram showing the process cartridge shown in FIG. 20 from which a shutter is omitted.

As shown in FIG. 21, the process frame 22 has a box shape that is elongated in the width direction. The developing part 32 has a box shape that forms a substantially rear half of the process frame 22. The cartridge housing part 33 has a box shape which forms a substantially front half of the process frame 22 and whose front and upper surfaces are opened. The partition wall 157 serves as both the front wall of the developing part 32 and the rear wall of the cartridge housing part 33. The inside of the developing part 32 communicates with the inside of the cartridge housing part 33 by the frame-side passage holes 34 formed in the partition wall 157. That is, the frame-side passage holes 34 face both the inside of the developing part 32 and the inside of the cartridge housing part 33.

A curved portion 44 is formed in the middle of the partition wall 157 in the vertical direction such that it is curved to the rear side along the outer circumferential surface of the developer cartridge 31. The frame-side passage holes 34 are formed in the curved portion 44 (see FIG. 18A). Three frame-side passage holes 34, each having a substantially rectangular shape that is elongated in the width direction, are formed at predetermined intervals in the width direction. Among the three frame-side passage holes 34, the frame-side passage hole 34 at the center in the width direction serves as a frame supply opening 160, and the frame-side passage holes 34 arranged at both sides of the frame supply opening 160 in the width direction serve as frame return holes 161.

A frame seal 162 as an example of a second seal member is provided on the front surface of the curved portion 44 of the partition wall 157 in order to prevent the leakage of developer from the frame-side passage holes 34 (see a dotted portion). The frame seal 162 is formed of a foam material having elasticity, and has a band shape that extends in the width direction. Three cutout portions 176 having a size that is substantially equal to that of the frame-side passage hole 34 are formed in the frame seal 162.

The frame seal 162 is adhered to the front surface of the curved portion 44 such that the cutout portions 176 are aligned with the corresponding frame-side passage holes 34. In this way, the frame seal 162 is provided around each of the frame-side passage holes 34 and is continuous between the frame-side passage holes 34. In this state, the frame seal 162 protrudes forward to face the inside of the cartridge housing part 33.

The cartridge housing part 33 includes the partition wall 157, a pair of side walls 163 that are opposite to each other with a gap therebetween in the width direction, and a bottom wall 164 between the lower ends of the pair of side walls 163, which are integrally formed with each other. The partition wall 157 is provided between the rear ends of the pair of side walls 163 and is connected to the rear end of the bottom wall 164. In the cartridge housing part 33, no wall is provided between the front ends of the pair of side walls 163 and between the upper ends thereof. Therefore, as described above, the front and upper surfaces of the cartridge housing part 33 are opened.

Shutter supporting portions 65 are provided on the inner surfaces of the side walls 163 in the width direction. The shutter supporting portion 65 has a substantially square shape that protrudes inward from the inner surface of the side wall 163 in the width direction, and extends in the vertical direction from the rear end portion of the side wall 163.

Shutter guide portions 144 are provided on the inner surfaces of the shutter supporting portions 65 in the width direction. The shutter guide portion 144 is a protrusion that protrudes inward from the inner surface of the corresponding shutter supporting portion 65 in the width direction. The shutter guide portions 144 are opposed to the front side of the curved portion 44 (see FIG. 18A) of the partition wall 157 with a little gap therebetween. The shutter guide portion 144 has a curved shape having a curvature that is substantially equal to that of the curved portion 44.

The upper surface of each of the shutter supporting portions 65 is disposed slightly below the upper end of the side wall 163. The upper surface of each of the supporting portions 65 serve as an upper fixing portion 66. In contrast, a lower fixing portion 67 that slightly protrudes forward is formed at the center of the front end of the bottom wall 164 in the width direction (see FIG. 18A).

As shown in FIG. 20, the shutter 68 and a swing arm 70 are provided in the cartridge housing part 33.

The shutter 68 has a substantially rectangular shape that extends in the width direction, and is curved with a curvature that is substantially equal to that of the curved portion 44 of the partition wall 157 (see FIG. 18A). The shutter 68 extends between the left and right shutter guide portions 144 in the width direction, and the length thereof is slightly smaller than that of the shutter guide portion 144 in the vertical direction. Three shutter openings 69 are formed in the shutter 68 to correspond to the frame-side passage holes 34 such that they can be opposed to the frame-side passage holes 34.

The shutter 68 is arranged opposite to the front surface of the curved portion 44 of the partition wall 157 (strictly, the frame seal 162 adhered to the curved portion 44) (see FIG. 18A). Both end portions of the shutter 68 in the width direction are slidably provided between the curved portion 44 (see FIG. 18A) and the shutter guide portions 144. The shutter 68 swings in the vertical direction between an open position (see FIG. 18A) that opens the frame-side passage holes 34 and a closed position that closes the frame-side passage holes 34 (see FIG. 20).

Specifically, when the shutter 68 is located at the open position, as shown in the enlarged view of FIG. 18A, the frame-side passage hole 34 is opposed to the corresponding shutter opening 69 through the cutout portion 176 (see FIG. 21) of the frame seal 162, and the frame-side passage hole 34 is opened. When the shutter 68 at the open position swings upward, the shutter 68 is disposed at the closed position. When the shutter 68 is located at the closed position, as shown in FIG. 20, the front sides of the frame-side passage holes 34 are closed by a portion of the shutter 68 below the shutter openings 69.

As such, in the structure in which the shutter 68 is swingably provided between the open position and the closed position, the frame seal 162 is arranged between the curved portion 44 of the partition wall 157 (that is, the process frame 22) and the shutter 68, and is compressed by the curved portion 44 and the shutter 68 (see FIG. 18A). In this way, it is possible to prevent the leakage of developer from the frame-side passage holes 34 surrounded by the frame seal 162 of the curved portion 44 between the curved portion 44 and the shutter 68.

As shown in the enlarged view of FIG. 18A, a rib (referred to as a frame rib 125 as an example of a second protrusion) that extends in the width direction and protrudes toward the shutter 68 is integrally formed with the curved portion 44 in a portion of the front surface thereof that is above the frame-side passage holes 34 and contacts the frame seal 162. The frame rib 125 protrudes toward the shutter 68 from the other portion of the front surface of the curved portion 44 in which the frame rib 125 is not provided.

In this way, a portion that is pressed against the shutter 68 by the frame rib 125 (which is referred to as a first frame seal portion 162A as an example of a fourth contact portion) and the other portion (a second frame seal portion 162B as an example of a third contact portion) are formed in a portion of the frame seal 162 that is compressed by a portion of the curved portion 44 above the frame-side passage holes 34 and the shutter 68.

When the shutter 68 is moved between the open position and the closed position, both the first frame seal portion 162A and the second frame seal portion 162B come into slide contact with the rear surface of the shutter 68. In this case, as described above, since the first frame seal portion 162A is pressed against the shutter 68 by the frame rib 125 unlike the second frame seal portion 162B, the first frame seal portion 162A comes into slide contact with the shutter 68 with a contact pressure that is higher than that of the second frame seal portion 162B.

As shown in FIG. 20, the swing arm 70 has a substantially U shape in plan view. The swing arm 70 includes a grip rod 71 that extends in the width direction and arm side plates 72 that extend backward from both end portions of the grip rod 71 in the width direction. The grip rod 71 and the arm side plates 72 are integrally formed with each other. A boss 73 that protrudes to the outside in the width direction is formed at the rear end portion of each of the arm side plates 72. Each of the bosses 73 of the arm side plates 72 is fitted into a hole 74 that is formed in the corresponding side wall 163. A receiving concave portion 75 that is cut out so as to be recessed downward is formed at the upper end of a rear end portion of each of the arm side plates 72. Pressing protrusions 177 that protrude backward are provided at both end portions of the grip rod 71 in the width direction.

The swing arm 70 swings about the bosses 73 of the arm side plates 72 in the vertical direction between a press releasing position (see FIGS. 20 and 21) where the lower ends of the arm side plates 72 contact the front end of the bottom wall 164 and a pressing position (see FIGS. 18A and 19) where the pressing protrusions 177 press the front side of the developer cartridge 31 accommodated in the cartridge housing part 33.

(2) Developer Cartridge

Figure 22:
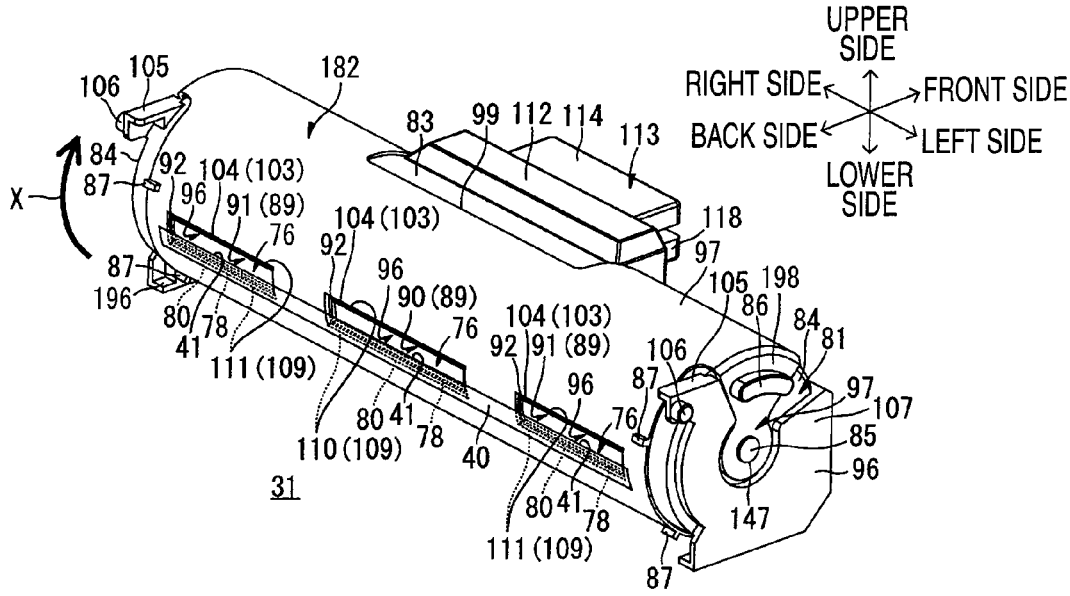
FIG. 22 is a perspective view of the developer cartridge as viewed obliquely from the rear left side, showing a state where an outside frame is located at an open position in FIG. 18B.
Figure 23:
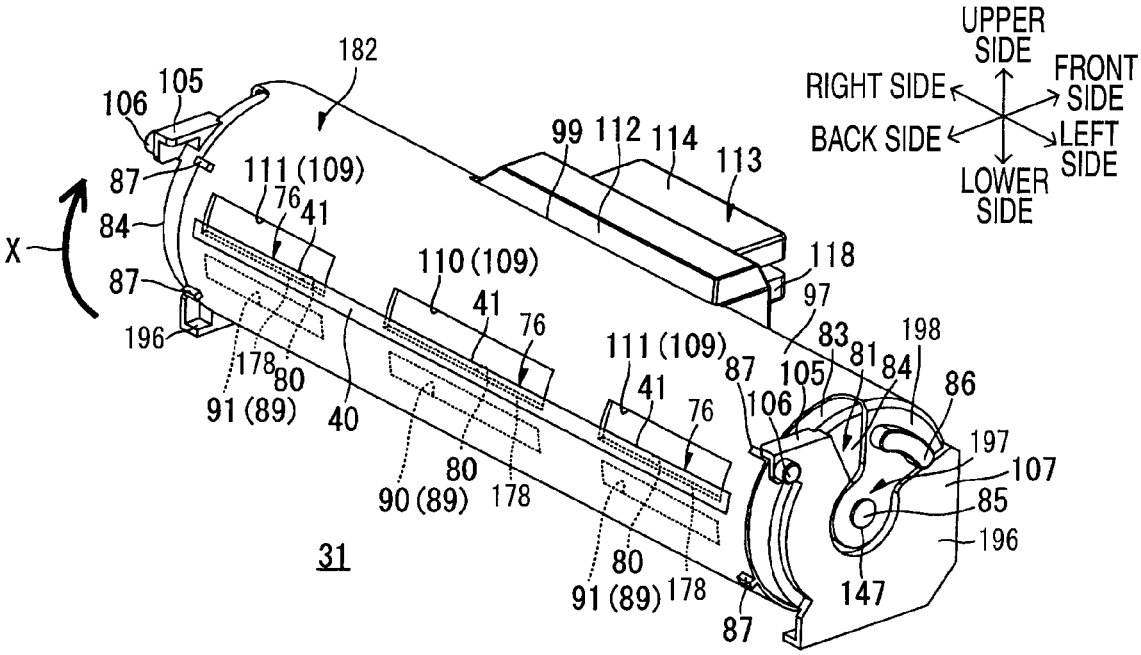
FIG. 23 is a diagram showing a state where the outside frame is located at a closed position in FIG. 22.
Figure 24:
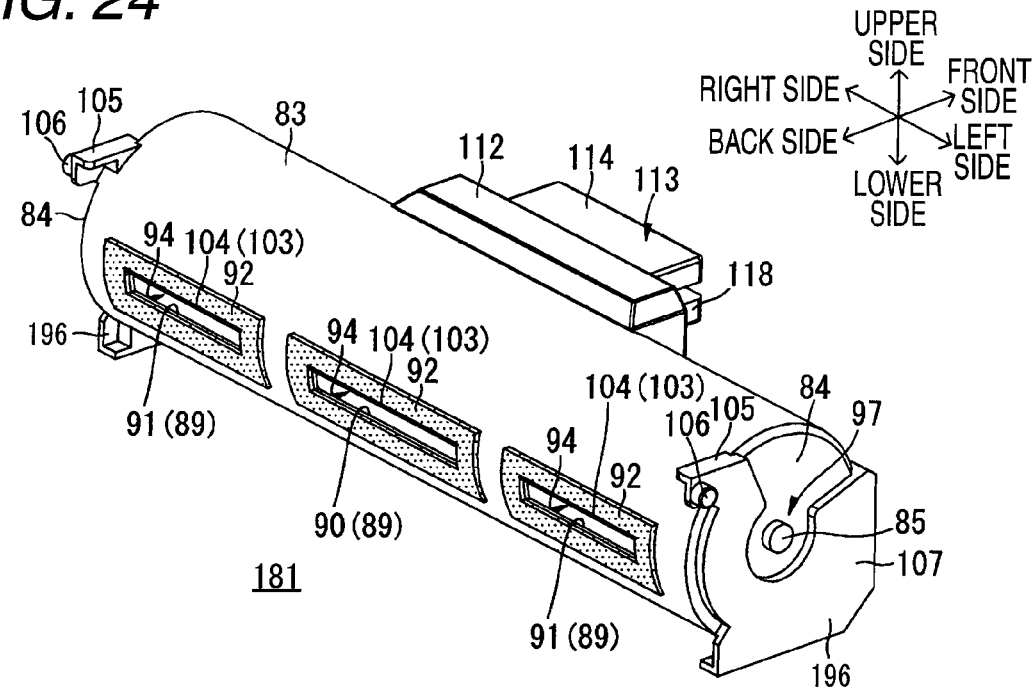
FIG. 24 is a perspective view showing an inside frame of the developer cartridge in FIG. 22 as viewed obliquely from the rear left side.
Figure 25:
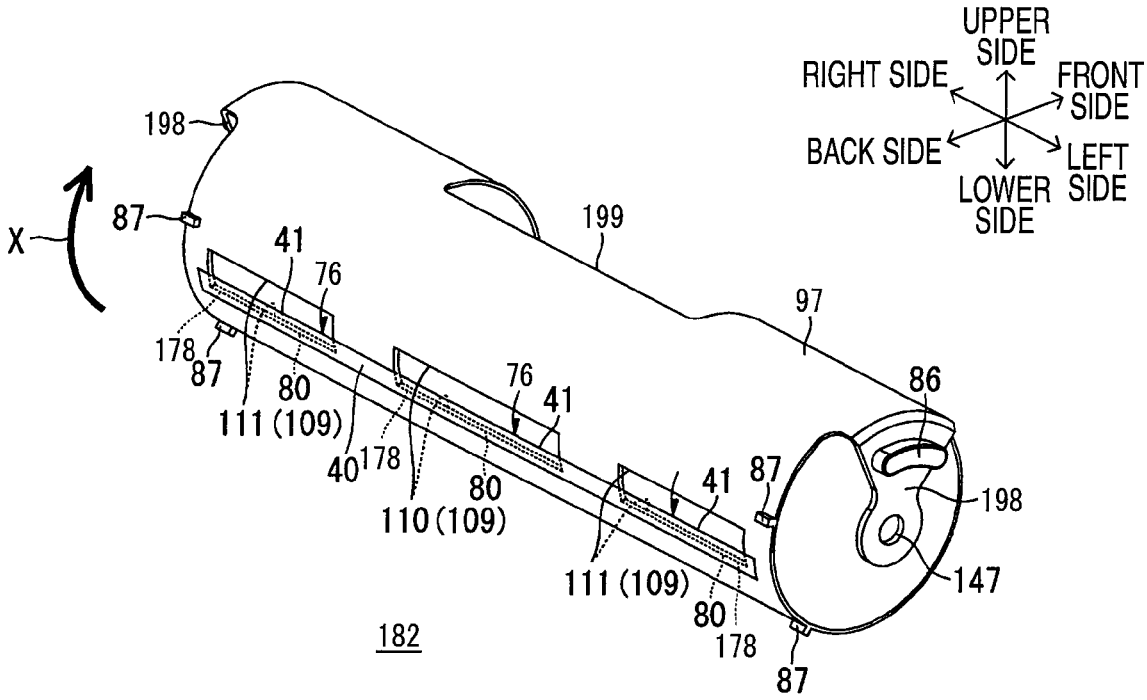
FIG. 25 is a perspective view showing the outside frame of the developer cartridge in FIG. 22 as viewed obliquely from the rear left side.

FIG. 22 is a perspective view showing the developer cartridge (in which an outside frame is located at an open position) shown in FIG. 18B, as obliquely viewed from the rear left side. FIG. 23 is a diagram showing the outside frame at a closed position in FIG. 22. FIG. 24 is a perspective view showing an inside frame of the developer cartridge shown in FIG. 22, as obliquely viewed from the rear left side. FIG. 25 is a perspective view showing the outside frame of the developer cartridge shown in FIG. 22, as obliquely viewed from the rear left side.

As shown in FIG. 22, the developer cartridge 31 has a substantially cylindrical shape that is elongated in the width direction and has a size capable of being exactly accommodated in the cartridge housing part 33 of the process frame 22 (see FIGS. 18A and 20) (a substantially cylindrical shape having a central axis that extends in the width direction) (see FIG. 19).

The developer cartridge 31 includes an inside frame 181 (see FIG. 24) as an example of a first frame and an outside frame 182 (see FIG. 25) as an example of a second frame. In the developer cartridge 31, developer is accommodated in the inside frame 181.

(2-1) Inside Frame

As shown in FIG. 24, the inside frame 181 has a substantially cylindrical shape that extends in the width direction, similar to the developer cartridge 31. The inside frame 181 includes an inside circumferential wall 83, which is a circumferential surface wall, and a pair of inside side walls 84 that close up both end portions of the inside circumferential wall 83 in the width direction and have disc shapes. The inside circumferential wall 83 and the inside side walls 84 are integrally formed with each other.

Inside passage holes 89, which are an example of a first opening, that form the cartridge-side passage holes 47 are formed in the rear surface of the inside circumferential wall 83. Three inside passage holes 89 are formed so as to be arranged at predetermined intervals in the width direction. Each of the inside passage holes 89 has a substantially rectangular shape that is elongated in the width direction, and passes through the rear surface of the inside circumferential wall 83 to communicate with the inside circumferential wall 83. That is, the inside and the outside of the inside frame 181 communicate with each other by the inside passage holes 89. Among the three inside passage holes 89, the inside passage hole 89 at the center in the width direction serves as an inside supply opening 90, and the inside passage holes 89 arranged at both sides of the inside supply opening 90 in the width direction serve as inside return holes 91.

A developer seal 92 as an example of a first seal member is adhered around each of the inside passage holes 89 on the outer surface (outer circumferential surface) of the inside circumferential wall 83 in order to prevent the leakage of developer from the inside passage holes 89. That is, three developer seals 92 are provided so as to correspond to three inside passage holes 89.

The developer seal 92 is formed of a foam material having elasticity, and has a band shape with a substantially uniform length (thickness) in the front-rear direction. Cutout portions 96 that pass through the developer seals 92 in the front-rear direction are formed substantially at the centers of the developer seals 92 in a rear view so as to correspond to the inside passage holes 89. The cutout portion 96 has a size that is substantially equal to that of the corresponding inside passage hole 89, and is opposed to the corresponding inside passage hole 89. As described above, the developer seals 92 adhered to the outer surface of the inside circumferential wall 83 are arranged such that the cutout portions 96 surround the corresponding inside passage holes 89, and protrude toward the outside (the rear side) in the diameter direction of the inside circumferential wall 83.

A grasp portion 113 is provided on the front surface of the inside circumferential wall 83. As shown in FIGS. 18 and 19, the grasp portion 113 includes a base 112 that is connected to the inside circumferential wall 83 and has a block shape elongated in the width direction, an upper grasp plate 114 that has a substantially rectangular shape protruding forward from the base 112, and a locking arm 115 that extends downward from the upper grasp plate 114 and has a substantially J shape in a left side view.

An upper end portion of the locking arm 115 is swingably supported by a supporting shaft 116 that is provided in the upper grasp plate 114. As shown in FIG. 18A, a locking claw 117 that is locked to the lower fixing portion 67 is provided at a lower end portion of the locking arm 115. A lower grasp plate 118 that protrudes forward and has a substantially rectangular shape in plan view is provided in the vicinity of the upper end portion of the locking arm 115 (see FIG. 19). The lower grasp plate 118 is arranged above the upper grasp plate 114 so as to extend substantially in parallel to the upper grasp plate 114 with a gap therebetween. A compression spring (not shown) is interposed between the upper grasp plate 114 and the lower grasp plate 118, and presses the upper grasp plate 114 and the lower grasp plate 118 in the direction in which they are separated from each other.

As shown in FIG. 19, pressed portions 107 that protrude forward along the outer circumferential surface of the inside circumferential wall 83 are formed integrally with the inside circumferential wall 83 at both end portions of the front surface of the inside circumferential wall 83 in the width direction.

As shown in FIG. 24, cylindrical bosses 85 are integrally formed with the inside side walls 84 at the centers of the outer surfaces of the inside side walls 84 in the width direction so at to protrude toward the outside in the width direction. In addition, developer inside plates 196 are integrally formed with the inside side walls 84 on the outer surfaces of the inside side walls 84 in the width direction. The developer inside plate 196 has a substantially U shape with an upper side opened, as viewed in the width direction, and the U-shaped inside portion (which is referred to as an inside portion 197) is formed such that it is recessed downward in the oblique direction. The lowest portion of the inside portion 197 has a circular shape, and the boss 85 is formed at the center of the lowest portion. The inside portion 197 is formed such that it is spread obliquely from the lowest portion to the front side in a fan shape.

A rear upper end portion 105 of each of the developer inside plate 196 protrudes backward, and a positioning boss 106 that protrudes to the outside in is the width direction is provided in the rear end portion 105.

(2-2) Outside Frame

As shown in FIG. 25, the outside frame 182 has a substantially cylindrical shape that is elongated in the width direction and has a diameter that is slightly larger than the inside frame 181 (specifically, the inside circumferential wall 83). The outside frame 182 includes an outside circumferential wall 97 composed of a circumferential wall. Both end portions of the outside circumferential wall 97 in the width direction are opened to the outside in the width direction. The curvature of the outside circumferential wall 97 is substantially equal to those of the shutter 68 and the curved portion 44 of the partition wall 157 of the process frame 22 (see FIG. 18A).

A pair of interposing protrusions 87 are formed at both end portions of the rear surface of the outside circumferential wall 97 in the width direction so as to be arranged with a predetermined gap therebetween (which corresponds to the length of the creeping surface of the shutter 68 in the vertical direction) in the circumferential direction, on the basis of the posture of the outside frame 182 in FIG. 25. That is, a total of four interposing protrusions 87 are formed on the outside circumferential wall 97. The interposing protrusions 87 protrude to the outside in the diameter direction of the outside circumferential wall 97.

Outside passage holes 109 forming the cartridge-side passage holes 47 are formed in a region surrounded by the four interposing protrusions 87 in the outside circumferential wall 97 (the rear surface of the outside circumferential wall 97 in FIG. 25). Three outside passage holes 109 are formed at predetermined intervals in the width direction. The outside passage hole 109 has a substantially rectangular shape that is elongated in the width direction, and passes through the outside circumferential wall 97. Among the three outside passage holes 109, the outside passage hole 109 at the center in the width direction serves as an outside supply opening 110, and the outside passage holes 109 arranged at both sides of the outside supply opening 110 in the width direction serve as outside return holes 111.

A sheet 40 is attached to the outer surface of the outside circumferential wall 97 (the rear outer circumferential surface in FIG. 25). Next, the sheet 40 will be described. In the following description, the upper side means a downstream side in a movement direction X (indicated by a bold solid arrow in FIG. 25) of the outside frame 182 (which will be described later) from the open position to the closed position, and the lower side means an upstream side in the movement direction X.

The sheet 40 is a rectangular sheet that is formed of a flexible material (for example, a PET film, rubber, or a very thin metal plate) and is elongated is the width direction. The length of the sheet 40 in the width direction is larger than the distance between the left end of the left outside passage hole 109 and the right end of the right outside passage hole 109.

The sheet 40 is continuous provided so as to be laid across the lower end portions of all the outside passage holes 109. Specifically, a portion of the upper end portion of the sheet 40 (which is referred to as a damming portion 41) protrudes upward into the corresponding outside passage hole 109. The length of the damming portion 41 is set to, for example, about 0.5 mm to 1.0 mm. That is, three damming portions 41 are provided to correspond to the number of outside passage holes 109. The damming portion 41 is disposed at the same position as the corresponding outside passage hole 109 in the width direction. The damming portion 41 covers the outside (the rear side in FIG. 25) of a frame end portion 80 as an example of an end portion that hems the lower end of the corresponding outside passage hole 109 in the outside circumferential wall 97. The damming portion 41 protrudes above the frame end portion 80 (see FIG. 18).

As shown in the enlarged view of FIG. 18A, when both an end surface of the frame end portion 80 that actually edges the lower end of the outside passage hole 109 (a surface of the frame end portion 80 that connects the outer surface and the inner surface of the outside circumferential wall 97, which is referred to as a frame end surface 178) and the sheet 40 (strictly, the damming portion 41) are referred to as a protruding portion 76, the protruding portion 76 is provided in the frame end portion 80. The protruding portion 76 includes a front end (a front end 178A of the frame end surface 178) as an example of a first end and a rear end (the damming portion 41) as an example of a second end. The damming portion 41 protrudes above the front end 178A.

As shown in FIG. 25, an exposure hole 199 that communicates with the inside of the outside circumferential wall 97 is formed in the outside circumferential wall 97 at a position that is opposite to the outside passage hole 109 (the front surface in FIG. 25) with the central axis of the outside circumferential wall 97 interposed therebetween.

At both end portions of the outside circumferential wall 97 in the width direction, developer outside plates 198 are integrally formed with the outside circumferential wall 97 at positions (an upper end portion in FIG. 25) that are rotated about 90° from the outside passage hole 109 in the clockwise direction in a left side view.

The developer outside plates 198 extend inward in the diameter direction of the outside circumferential wall 97 from both end portions of the outside circumferential wall 97 in the width direction. Each of the developer outside plates 198 has a substantially triangular shape that is tapered inward in the diameter direction in a cross-sectional view. A hole (a fitting hole 147) is formed in a portion of each of the developer outside plates 198 that corresponds to the central axis of the outside circumferential wall 97, and a slide protrusion 86 is provided in another portion of each of the developer outside plates 198 that is close to the outer circumferential surface of the outside circumferential wall 97. The slide protrusion 86 has an arc shape along the outer circumferential surface of the outside circumferential wall 97 in a side view, and protrudes from the corresponding developer outside plate 198 to the outside in the width direction.

(2-3) Relative Arrangement Between Inside Frame and Outside Frame

The inside frame 181 is accommodated in the outside frame 182. That is, the outside frame 182 is arranged outside the inside frame 181.

Specifically, as shown in FIGS. 22 and 23, the grasp portion 113 is exposed from the exposure hole 199 of the outside circumferential wall 97, and the bosses 85 of the inside side walls 84 are fitted into the fitting holes 147 of the corresponding developer outside plates 198. The developer outside plates 198 are arranged in the inside portions 197 of the corresponding developer inside plates 196. Therefore, the developer seal 92 is compressed by the outer circumferential surface of the inside circumferential wall 83 of the inside frame 181 and the inner circumferential surface of the outside circumferential wall 97 of the outside frame 182 (see FIG. 18). In this way, it is possible to prevent the leakage of developer from the inside passage holes 89 surrounded by the developer seal 92 in the inside circumferential wall 83 between the inside circumferential wall 83 and the outside circumferential wall 97.

When the bosses 85 are fitted into the fitting holes 147, the outside frame 182 is allowed to rotate about the bosses 85 relative to the inside frame 181 between the closed position (see FIG. 23) and the open position (see FIG. 22).

When the outside frame 182 is located at the closed position, as shown in FIG. 23, the outside passage hole 109 and the frame end portion 80 are arranged above the inside passage hole 89, and the outside of the inside passage hole 89 in the diameter direction is closed by a portion of the outside circumferential wall 97 that is arranged below the outside passage hole 109 and the frame end portion 80.

In this state, the outside frame 182 is rotated about the bosses 85 relative to the inside frame 181 such that the outside passage holes 109 and the frame end portions 80 are moved downward to the inside passage holes 89. When the developer outside plates 198 come into contact with the rear ends of the corresponding inside portions 197 with the rotation of the outside frame, as shown in FIG. 22, the outside frame 182 is disposed at the open position.

When the outside frame 182 is disposed at the open position, the inside passage hole 89 is opposed to the corresponding outside passage hole 109 with the cutout portion 96 of the developer seal 92 interposed therebetween such that they (the inside passage hole 89, the cutout portion 96, and the inside passage hole 109) communicate with each other and are exposed to the rear side. In this case, the frame end portion 80 of the outside frame 182 is substantially aligned with the lower end of the inside passage hole 89 and the lower end of the cutout portion 96 in a rear view (see the enlarged view of FIG. 18A).

The outside frame 182 at the open position is rotated about the bosses 85 relative to the inside frame 181 in the direction in which the outside passage holes 109 and the frame end portions 80 move upward from the inside passage holes 89. Then, when each of the developer outside plates 198 comes into contact with the front end of the corresponding inside portion 197, as shown in FIG. 23, the outside frame 182 is disposed at the closed position.

As such, the outside frame 182 is movable between the open position where the inside passage holes 89 are opened and the closed position where the inside passage holes 89 are closed.

When the outside frame 182 is moved in the movement direction (the movement direction X) from the open position to the closed position, as shown in the enlarged view of FIG. 18A, in the outside circumferential wall 97, the frame end portion 80 that borders the lower end of the outside passage hole 109 is moved upward while initially crossing the corresponding inside passage hole 89 (see FIGS. 22 and 23).

In addition, when the outside frame 182 is disposed at any position between the open position and the closed position, a front end 178A of the protruding portion 76 provided in the frame end portion 80 is disposed close to the inside passage hole 89 (the inside in the diameter direction, and the front side in FIG. 18A), and the sheet 40 (including the damming portion 41) is disposed at a position that is further away from the inside passage hole 89 than the front end 178A (the outside in the diameter direction, and the rear side in FIG. 18A).

Referring to the enlarged view of FIG. 18A, when the outside frame 182 is moved in the movement direction X from the open position to the closed position, the frame end portion 80 (including the protruding portion 76) is opposed to a portion of the developer seal 92 above the inside passage hole 89, specifically, a portion (which is referred to as a developer seal opposite portion 102 as an example of a first seal side opposite portion) that borders the upper end of the cutout portion 96 in the movement direction X.

A first guide surface 103 that is inclined toward the front side, that is, the inside passage hole 89 in the direction from the upper side to the lower side is formed in the outer surface (the rear surface) of the developer seal opposite portion 102. When the outside frame 182 is moved from the open position to the closed position, the frame end portion 80 opposed to the developer seal opposite portion 102 comes into contact with the first guide surface 103 of the developer seal opposite portion 102.

When a portion of the outer surface of the inside circumferential wall 83 corresponding to the upper end of the inside passage hole 89 is chamfered (see a chamfered portion 119 shown in FIG. 18A), the developer seal 92 is adhered to the outer surface of the inside circumferential wall 83 to form the first guide surface 103 in the developer seal opposite portion 102 of the developer seal 92.

The surface of the developer seal opposite portion 102 (including the first guide surface 103) is covered with a developer seal protective film 104 as an example of a first protective member. The developer seal protective film 104 is formed of a material having an elastic modulus that is higher than that of the developer seal 92 (that is, a material that has high rigidity and is not easy to deform). For example, the developer seal protective film 104 may be formed of a tape, a PET sheet, a resin layer formed by drying, for example, an adhesive or a coating material, or a resin layer formed by melting the surface of the developer seal 92 using a heat treatment. In addition, a portion of the developer seal protective film 104 that protrudes from the developer seal opposite portion 102 is adhered to the inner circumferential surface of the inside frame 181 (the inside circumferential wall 83), such that the developer seal protective film 104 is fixed to the inside frame 181.

When the outside frame 182 is moved from the open position to the closed position, the developer seal protective film 104 is disposed between the developer seal opposite portion 102 and the frame end portion 80. In this way, the developer seal protective film 104 protects the developer seal opposite portion 102 (that is, the developer seal 92) from the frame end portion 80.

Further, a rib (referred to as a developer rib 126 as an example of a first protrusion) that extends in the width direction and protrudes to the inner circumferential surface of the outside circumferential wall 97 outward (to the front side) in the diameter direction is integrally formed with the inside circumferential wall 83 in a portion of the outer circumferential surface (the rear surface) thereof that is above the inside passage holes 89 and contacts the developer seals 92. The developer rib 126 protrudes toward the inner circumferential surface of the outside circumferential wall 97 from the other portion of the outer circumferential surface of the inside circumferential wall 83 in which the developer rib 126 is not provided.

Therefore, a portion that is pressed against the outside circumferential wall 97 by the developer rib 126 (which is referred to as a first developer seal portion 92A as an example of a second contact portion) and the other portion (a second developer seal portion 92B as an example of a first contact portion) are formed in a portion of the developer seal 92 that is compressed by a portion of the inside circumferential wall 83 above the inside passage holes 89 and the outside circumferential wall 97.

When the outside frame 182 is moved between the open position and the closed position, both the first developer seal portion 92A and the second developer seal portion 92B come into slide contact with the inner circumferential surface of the outside circumferential wall 97. In this case, as described above, since the first developer seal portion 92A is pressed against the outside circumferential wall 97 by the developer rib 126 unlike the second developer seal portion 92B, the first developer seal portion 92A comes into slide contact with the inner circumferential surface of the outside circumferential wall 97 with a contact pressure that is higher than that of the second developer seal portion 92B.

The first developer seal portion 92A is disposed at the upper side (the downstream side in the movement direction X) of the first guide surface 103. Therefore, when the outside frame 182 is moved from the open position to the closed position, a portion of the inner circumferential surface of the outside circumferential wall 97 that is below the first guide surface 103 (on the downstream side in the movement direction X) passes through the first guide surface 103 and then comes into slide contact with the first developer seal portion 92A.

(2-4) Mount and Removal of Developer Cartridge to and from Process Frame (2-4-1) Mount of Developer Cartridge to Process Frame The mount of the developer cartridge 31 to the process frame 22 will be described with reference to FIGS. 20 and 23.

First, a user holds the upper grasp plate 114 and the lower grasp plate 118 of the grasp portion 113 in the developer cartridge 31 such that they are close to each other. Then, the user mounts the developer cartridge 31 in the state shown in FIG. 23 (the outside frame 182 is disposed at the closed position) to the cartridge housing part 33 of the process frame 22 in the state shown in FIG. 20 (the shutter 68 is disposed at the closed position and the swing arm 70 is disposed at the press releasing position) from the front upper side.

In this case, the positioning bosses 106 are mounted on the corresponding upper fixing portions 66, and two pairs of interposing protrusions 87 provided at both end portions of the developer cartridge 31 in the width direction hold the upper and lower ends of both end portions of the shutter 68 in the width direction. In addition, the slide protrusions 86 are fitted into the corresponding receiving concave portions 75.

Then, when the upper grasp plate and the lower grasp plate of the grasp portion 113 are unclamped, as shown in FIG. 18A, the locking claw 117 is locked to the lower fixing portion 67, and the developer cartridge 31 is accommodated in the cartridge housing part 33. In the developer cartridge 31, the positioning bosses 106 of the inside frame 181 are fitted into the upper fixing portions 66 (see FIGS. 20 and 23) and the locking claws 117 of the inside frame 181 are locked to the lower fixing portions 67 of the process frame 22. Therefore, the inside frame 181 is fixed to the cartridge housing part 33. In this way, the mount of the developer cartridge 31 to the process frame 22 is completed. In this case, the outside passage holes 109 of the outside frame 182 at the closed position are opposed to the corresponding shutter passage holes 69 of the shutter 68 disposed at the closed position such that they communicate with each other (not shown).

When the swing arm 70 swings from the press releasing position (see FIG. 20) to the pressing position (see FIGS. 18A and 19), the slide protrusions 86 fitted into the receiving concave portions 75 (see FIG. 19) slide backward with the swing of the arm side plates 72, and two pairs of interposing protrusions 87 at both end portions in the width direction slide downward while holding the shutter 68 therebetween. In this way, the outside frame 182 having the interposing protrusions 87 and the shutter 68 are moved together.

With the movement, the outside frame 182 is disposed at the open position (see FIG. 22), and the outside passage holes 109 are opposed to the inside passage holes 89 such that they communicate with each other, as shown in FIG. 18A. In this case, the shutter 68 is disposed at the open position, and the frame-side passage holes 34 and the cartridge-side passage holes 47 (the inside passage holes 89 and the outside passage holes 109) are opposed to each other in the horizontal direction, such that they communicate with each other. As such, the movement direction of the shutter 68 from the closed position to the open position is the same as that of the outside frame 182 from the closed position to the open position.

In the swing arm 70 at the pressing position, the pressing protrusion 177 presses the corresponding pressed portion 107 backward. The developer cartridge 31 is pressed backward and is prevented from moving forward from the process frame 22 (see FIG. 19).

Therefore, during an image forming process, the developer in the inside frame 181 is agitated by the agitator 93, and then supplied to the developing part 32 through the inside passage hole 89 (an inside supply opening 90) and the outside passage hole 109 (an outside supply opening 110). Then, the developer is supplied into the developing part 32 through the frame-side passage hole 34 (a frame supply opening 160) (see FIGS. 21 and 22).

The developer supplied into the developing part 32 through the frame supply opening 160 (see FIG. 21) is supplied to the supply roller 36 while being transported from the center in the width direction to both sides in the width direction by the auger 35. The developer supplied to the supply roller 36 is supplied to the developing roller 37, as described above. Developer supplied to the supply roller 36 is transported the frame return holes 161 (see FIG. 21), and returns from the developing part 32 to the inside frame 181 through outside return holes 111 and inside return holes 91 (see FIG. 22). In this way, developer is circulated between the inside frame 181 and the developing part 32.

In the state in which the developer cartridge 31 is mounted to the process frame 22, the front side of the outside circumferential wall 97 of the outside frame 182 is closely attached to the shutter 68 along the curved surface of the shutter at all times.

(2-4-2) Removal of Developer Cartridge from Process Frame

In order to remove the developer cartridge 31 (the outside frame 182 is disposed at the open position) from the process frame 22 (the shutter 68 is disposed at the open position and the swing arm 70 is disposed at the pressing position), first, the swing arm 70 swings from the pressing position (see FIGS. 18A and 19) to the press releasing position (see FIG. 20). Then, the pressing protrusions 177 deviate from the corresponding pressed portions 107 downward, and the pressing of the developer cartridge 31 backward is released.

When the swing arm 70 swings from the pressing position to the press releasing position, the slide protrusions 86 fitted into the receiving concave portions 75 (see FIG. 19) slide forward with the swing of the arm side plates 72. In addition, the two pairs of interposing protrusions 87 arranged at both sides of the outside frame in the width direction slide upward while holding the shutter 68 therebetween. In this way, the shutter 68 and the outside frame 182 having the interposing protrusions 87 are moved together.

With the movement, the outside frame 182 is disposed at the closed position (see FIG. 23). When the outside frame 182 is disposed at the closed position, the shutter 68 is disposed at the closed position (see FIG. 20). That is, the movement direction of the shutter 68 from the open position to the closed position is the same as the movement direction X of the outside frame 182 from the open position to the closed position.

Then, when the upper grasp plate 114 and the lower grasp plate 118 of the grasp portion 113 are clamped in the direction in which they are close to each other, the locking of the locking claw 117 to the lower fixing portion 67 is released. Therefore, as shown in FIG. 18B, when the developer cartridge 31 is drawn out from the cartridge housing part 33 to the outside, the developer cartridge 31 is removed from the process frame 22.

As shown in the enlarged view of FIG. 18A, when the shutter 68 is moved upward from the open position to the closed position, in the shutter 68, a shutter end portion 120 that hems the lower end of the shutter opening 69 is moved upward while initially crossing the corresponding frame-side passage hole 34.

When the shutter 68 is moved from the open position to the closed position, the shutter end portion 120 is opposed to a portion of the frame seal 162 above the frame-side passage hole 34, specifically, a portion (which is referred to as a frame seal opposite portion 121 as an example of a second seal side opposite portion) that borders the upper end of the cutout portion 176 in the movement direction of the shutter 68 (that is, in the movement direction X). In this case, since both the shutter 68 and the outside frame 182 are moved from the open position to the closed position, the frame end portion 80 (including the protruding portion 76) of the outside frame 182 and the shutter end portion 120 are also arranged below the frame seal opposite portion 121 so as to be opposed to the frame seal opposite portion 121.

A second guide surface 122 that is inclined toward the rear side, that is, the frame-side passage hole 34 in the direction from the upper side to the lower side is formed in the outer surface (the front surface) of the frame seal opposite portion 121. When the shutter 68 and the outside frame 182 are moved from the open position to the closed position, the frame end portion 80 and the shutter end portion 120 opposed to the frame seal opposite portion 121 come into contact with the second guide surface 122 of the frame seal opposite portion 121.

A first frame seal portion 162A of the frame seal 162 is arranged above the second guide surface 122 (on the upstream side in the movement direction X). Therefore, when the shutter 68 is moved from the open position to the closed position, a portion of the rear surface of the shutter 68 that is disposed below the second guide surface 122 (on the upstream side in the movement direction X) passes through the second guide surface 122 and then comes into slide contact with the first frame seal portion 162A.

The surface of the frame seal opposite portion 121 (including the second guide surface 122) is covered by a frame seal protective film 123 as an example of a second protective member. The frame seal protective film 123 is formed of a material having an elastic modulus that is higher than that of the frame seal 162 (that is, a material that has high rigidity and is not easy to deform). For example, the frame seal protective film 123 may be formed of a tape, a PET sheet, a resin layer formed by drying, for example, an adhesive or a coating material, or a resin layer formed by melting the surface of the frame seal 162 using a heat treatment. In addition, a portion of the frame seal protective film 123 that protrudes from the frame seal opposite portion 121 is attached to the partition wall 157, such that the frame seal protective film 123 is fixed to the process frame 22.

When the shutter 68 and the second outside frame 182 are moved from the open position to the closed position, the frame seal protective film 123 is disposed between the frame seal opposite portion 121, and the shutter end portion 120 and the frame end portion 80. In this way, the frame seal protective film 123 protects the frame seal opposite portion 121 (that is, the frame seal 162) from the shutter end portion 120 and the frame end portion 80.

In the developer cartridge 31, the outside frame 182 that is arranged outside the inside frame 181 accommodating developer is movable between the open position where the inside passage holes 89 of the inside frame 181 are opened (see FIGS. 18A and 22) and the closed position where the inside passage holes 89 are closed (see FIGS. 18B and 23).

In the outside frame 182 of the developer cartridge 31, the protruding portion 76 is provided in the frame end portion 80 that initially crosses the corresponding inside passage hole 89 when the outside frame 182 is moved in the movement direction X from the open position to the closed position. The protruding portion 76 includes the front end 178A that is arranged close to the inside passage hole 89 and the damming portion 41 that protrudes from the front end 178A to the downstream side in the movement direction X at a position that is further away from the inside passage hole 89 than the front end 178A (that is, the outside position).

Therefore, even when the developer in the inside passage hole 89 is attached to the frame end portion 80 (specifically, the frame end surface 178) of the outside frame 182 while the outside frame 182 is moved from the open position to the closed position, the damming portion 41 of the protruding portion 76 can prevent the leakage of the developer to the outside. As a result, it is possible to prevent the developer from being scattered to the outside (see FIG. 18B).

The sheet 40 of the protruding portion 76 protrudes from the upstream side (the lower side) to the downstream side (the upper side) in the movement direction X at a position that is further away from the inside passage hole 89 than the front end 178A (that is, the outside position). In this way, the sheet 40 prevents the developer attached to the frame end portion 80 of the outside frame 182 from leaking to the outside. As a result, it is possible to prevent developer from being scattered to the outside.

Further, the sheet 40 has flexibility. Therefore, even when the frame end portion 80 is not flat, it is possible to closely attach the sheet 40 to the frame end portion 80 by bending the sheet 40. In this way, the sheet 40 can prevent the leakage of the developer attached to the frame end portion 80 to the outside.

The developer seal 92 (see FIG. 24) that is provided around the inside passage holes 89 on the outer surface of the inside frame 181 is positioned between the inside frame 181 (the inside circumferential wall 83) and the outside frame 182 (the outside circumferential wall 97) provided outside the inside frame 181.

The developer seal 92 is provided with the developer seal opposite portion 102 that is opposed to the outside frame 182 (specifically, the frame end portion 80) when the outside frame 182 is moved from the open position to the closed position. The outside frame 182 moved from the open position to the closed position can contact the developer seal opposite portion 102.

The first guide surface 103 that is inclined toward the inside passage hole 89 (the front side) from the downstream side (the upper side) to the upstream side (the lower side) in the movement direction X is formed in the developer seal opposite portion 102. Therefore, even when the outside frame 182 comes into contact with the developer seal opposite portion 102 while being moved from the open position to the closed position, the outside frame 182 is guided by the first guide surface 103 in the direction that is separated from the inside passage holes 89 (the direction that deviates from the developer seals 92, and the rear side in FIG. 18A). In this way, the outside frame 182 can be smoothly moved to the closed position without being caught by the developer seal opposite portion 102.

Further, the outside frame 182 that is moved from the open position to the closed position tightly contacts the developer seal opposite portion 102, which may cause the developer seal opposite portion 102 of the developer seal 92 to be damaged.

However, the developer cartridge 31 is provided with the developer seal protective film 104 having an elastic modulus that is higher than that of the developer seal 92 (high rigidity). Therefore, when the outside frame 182 is moved from the open position to the closed position, the developer seal protective film 104 is arranged between the developer seal opposite portion 102 and the outside frame 182 (specifically, the frame end portion 80). In this way, the developer seal protective film 104 can prevent the outside frame 182 from contacting the developer seal opposite portion 102, thereby protecting the developer seal 92.

As a result, when the outside frame 182 is moved from the open position to the closed position, it is possible to prevent the developer seal opposite portion 102 of the developer seal 92 from being damaged. In addition, since the outside frame 182 is prevented from being contacted with the developer seal opposite portion 102, it is possible to prevent the outside frame 182 from being caught by the developer seal opposite portion 102 and the developer seal 92 from being deformed. As a result, it is possible to smoothly move the outside frame 182 to the closed position.

In the process frame 22 of the process cartridge 17, when the developer cartridge 31 is accommodated in the cartridge housing part 33, the frame-side passage holes 34 of the process frame 22 can be opposed to the inside passage holes 89 of the developer cartridge 31. In this way, the developer in the developer cartridge 31 can be supplied to the process frame 22 through the inside passage holes 89 and the frame-side passage holes 34.

The cartridge housing part 33 is provided with the shutter 68, and the shutter 68 is moved together with the outside frame 182 of the developer cartridge 31 to open or close the frame-side passage holes 34. Specifically, the shutter 68 can open the frame-side passage holes 34 when the outside frame 182 is located at the open position (see FIG. 18A), and closes the frame-side passage holes 34 when the outside frame 182 is located at the closed position (see FIG. 20). Therefore, when the outside frame 182 is moved to open or close the inside passage holes 89, the frame-side passage holes 34 are also opened or closed. As a result it is possible to improve operability.

Further, the frame seal 162 is provided around the frame-side passage holes 34 between the process frame 22 (specifically, the partition wall 157) and the shutter 68. The frame seal 162 is provided with the frame seal opposite portion 121 that is opposite to the outside frame 182 (specifically, the frame end portion 80) and the shutter 68 (specifically, the shutter end portion 120) when the outside frame 182 and the shutter 68 are moved from the open position to the closed position. Therefore, the outside frame 182 and the shutter 68 that are moved from the open position to the closed position can contact the frame seal opposite portion 121.

The second guide surface 122 that is inclined toward the frame-side passage hole 34 (the rear side) from the downstream side (the upper side) to the upstream side (the lower side) in the movement direction X is formed in the frame seal opposite portion 121. Therefore, even when the outside frame 182 and the shutter 68 come into contact with the frame seal opposite portion 121 while being moved from the open position to the closed position, the outside frame 182 and the shutter 68 are guided by the second guide surface 122 in the direction that is separated from the frame-side passage holes 34 (the direction that deviates from the frame seal 162, and the front side in FIG. 18A). In this way, the outside frame 182 and the shutter 68 moved from the open position to the closed position are not caught by the frame seal opposite portion 121. As a result, the outside frame 182 can be smoothly moved to the closed position, and the shutter 68 can be smoothly moved together with the outside frame 182.

Further, the outside frame 182 and the shutter 68 that are moved from the open position to the closed position tightly contact the frame seal opposite portion 121, which may cause the frame seal opposite portion 121 of the frame seal 162 to be damaged.

However, the process cartridge 17 is provided with the frame seal protective film 123 having an elastic modulus that is higher than that of the frame seal 162 (high rigidity). Therefore, when the shutter 68 and the outside frame 182 are moved from the open position to the closed position, the frame seal protective film 123 is arranged between the frame seal opposite portion 121, and the outside frame 182 (the frame end portion 80) and the shutter 68 (the shutter end portion 120). In this way, the frame seal protective film 123 can prevent the outside frame 182 and the shutter 68 from contacting the frame seal opposite portion 121, thereby protecting the frame seal 162.

As a result, when the outside frame 182 is moved from the open position to the closed position, it is possible to prevent the frame seal opposite portion 121 of the frame seal 162 from being damaged. In addition, since the outside frame 182 and the shutter 68 are prevented from being contacted with the frame seal opposite portion 121, it is possible to prevent the outside frame 182 and the shutter 68 from being caught by the frame seal opposite portion 121 and the frame seal 162 from being deformed. As a result, it is possible to smoothly move the outside frame 182 and the shutter 68 to the closed position.

Further, in the outside frame 182 of the developer cartridge 31 according to the second exemplary embodiment, the developer seals 92 (see FIG. 24) that are provided on the outer surface of the inside frame 181 around the corresponding inside passage holes 89 are disposed between the inside frame 181 (the inside circumferential wall 83) and the outside frame 182 (the inside circumferential wall 97) arranged outside the inside frame 181.

The developer seal 92 is provided with the second developer seal portion 92B and the first developer seal portion 92A that come into slide contact with the inner circumferential surface of the outside circumferential wall 97 of the outside frame 182 that is moved in the movement direction X from the open position to the closed position.

The first developer seal portion 92A comes into slide contact with the outside frame 182 with a contact pressure that is higher than that of the second developer seal portion 92B. Therefore, even when developer in the inside passage holes 89 is attached to the outside frame 182 (specifically, the inner circumferential surface of the outside circumferential wall 97) while the outside frame 182 moved from the open position to the closed position crosses the inside passage holes 89, the developer is removed from the outside frame 182 by the first developer seal portions 92A. In this way, it is possible to prevent the developer attached to the outside frame 182 from being scattered.

The first developer seal portion 92A is pressed against the outside frame 182 (the inner circumferential surface of the outside circumferential wall 97) that is moved from the open position to the closed position. Therefore, the first developer seal portion 92A can come into slide contact with the outside frame 182 with a higher contact pressure than the second developer seal portion 92B.

The developer rib 126 is provided on the inside frame 181 so as to protrude to the outside frame 182. This simple structure makes it possible to firmly press the first developer seal portions 92A against the outside frame 182 that is moved from the open position to the closed position.

The developer seal 92 is provided with the developer seal opposite portion 102 that is opposed to the outside frame 182 (specifically, the frame end portion 80) when the outside frame 182 is moved from the open position to the closed position. The outside frame 182 moved from the open position to the closed position can contact the developer seal opposite portion 102.

The first guide surface 103 that is inclined toward the inside passage hole 89 (the front side) from the upstream side (the upper side) to the downstream side (lower side) in the movement direction X from the open position to the closed position is formed in the developer seal opposite portion 102. Therefore, even when the outside frame 182 comes into contact with the developer seal opposite portion 102 while being moved from the open position to the closed position, the outside frame 182 is guided by the first guide surface 103 in the direction that is separated from the inside passage holes 89 (the direction that deviates from the developer seals 92, and the rear side in FIG. 18). In this way, the outside frame 182 can be smoothly moved to the closed position without being caught by the developer seal opposite portion 102.

The first developer seal portion 92A coming into slide contact with the outside frame 182 with a high contact pressure (that is, the first developer seal portion 92A is provided in a portion of the developer seal 92 that is likely to be caught by the outside frame 182) is arranged at a position that is separated from the first guide surface 103 to the downstream side in the movement direction X. Therefore, the first developer seal portion 92A does not hinder the guide of the outside frame 182 by the first guide surface 103. In this way, the outside frame 182 can be smoothly guided by the first guide surface 103.

Further, the outside frame 182 (specifically, the frame end portion 80) moved from the open position to the closed position tightly contacts the developer seal opposite portion 102, which may cause the developer seal opposite portion 102 of the developer seal 92 to be damaged.

However, the developer cartridge 31 is provided with the developer seal protective film 104 having an elastic modulus that is higher than that of the developer seal 92 (high rigidity). Therefore, when the outside frame 182 is moved from the open position to the closed position, the developer seal protective film 104 is arranged between the developer seal opposite portion 102 and the outside frame 182. In this way, the developer seal protective film 104 can prevent the outside frame 182 from contacting the developer seal opposite portion 102, thereby protecting the developer seal 92.

As a result, when the outside frame 182 is moved from the open position to the closed position, it is possible to prevent the developer seal opposite portion 102 of the developer seal 92 from being damaged. In addition, since the outside frame 182 is prevented from being contacted with the developer seal opposite portion 102, it is possible to prevent the outside frame 182 from being caught by the developer seal opposite portion 102 and the developer seal 92 from being deformed. As a result, it is possible to smoothly move the outside frame 182 to the closed position.

In the outside frame 182, the protruding portion 76 is provided in the frame end portion 80 that initially crosses the corresponding inside passage hole 89 when the outside frame 182 is moved in the movement direction X. The protruding portion 76 includes the front end 178A that is arranged close to the inside passage hole 89 and the damming portion 41 that protrudes from the front end 178A to the downstream side in the movement direction X at a position that is further away from the inside passage hole 89 than the front end 178A (that is, the outside position).

Therefore, even when developer in the inside passage hole 89 is attached to the frame end portion 80 of the outside frame 182 while the outside frame 182 is moved from the open position to the closed position, the damming portion 41 of the protruding portion 76 can prevent the developer from leaking to the outside and from being scattered.

As shown in FIG. 18A, in the process frame 22 of the process unit 17, when the developer cartridge 31 is accommodated in the cartridge housing part 33, the frame-side passage holes 34 of the process frame 22 can be opposed to the inside passage holes 89 of the developer cartridge 31. In this way, the developer in the developer cartridge 31 can be supplied to the process frame 22 through the inside passage holes 89 and the frame-side passage holes 34.

The cartridge housing part 33 is provided with the shutter 68, and the shutter 68 is moved together with the outside frame 182 of the developer cartridge 31 to open or close the frame-side passage holes 34. Specifically, the shutter 68 can open the frame-side passage holes 34 when the outside frame 182 is located at the open position (see FIG. 18A), and closes the frame-side passage holes 34 when the outside frame 182 is located at the close position (see FIG. 20). Therefore, when the outside frame 182 is moved to open or close the inside passage holes 89, the frame-side passage holes 34 are also opened or closed. As a result it is possible to improve operability.

Further, the frame seal 162 is provided around the frame-side passage holes 34 between the process frame 22 (specifically, the partition wall 157) and the shutter 68. As shown in the enlarge view of FIG. 18A, the frame seal 162 is provided with the first frame seal portion 162A and the second frame seal portion 162B that come into slide contact with the rear surface of the shutter 68 when the outside frame 182 and the shutter 68 are moved from the open position to the closed position.

The first frame seal portion 162A comes into slide contact with the shutter 68 with a contact pressure that is higher than that of the second frame seal portion 162B. Therefore, even when the developer in the frame-side passage holes 34 is attached to the rear surface of the shutter 68 while the shutter 68 moved from the open position to the closed position crosses the frame-side passage holes 34, the developer is removed from the shutter 68 by the first frame seal portions 162A. In this way, it is possible to prevent the developer attached to the shutter 68 from being scattered.

The first frame seal portion 162A is pressed against the rear surface of the shutter 68 when the shutter 68 is moved from the open position to the closed position. Therefore, the first frame seal portion 162A can come into slide contact with the shutter 68 with a higher contact pressure than the second frame seal portion 162B.

The frame rib 125 is provided on the process frame 22 (specifically, the partition wall 157) so as to protrude to the shutter 68. This simple structure makes it possible to firmly press the first frame seal portions 162A against the shutter 68 when the outside frame 182 is moved from the open position to the closed position.

The frame seal 162 is provided with the frame seal opposite portion 121 that is opposed to the outside frame (specifically, the frame end portion 80) and the shutter 68 (specifically, the shutter end portion 120) when the outside frame 182 and the shutter 68 are moved in the movement direction X from the open position to the closed position. Therefore, the outside frame 182 and the shutter 68 moved from the open position to the closed position can contact the frame seal opposite portion 121.

The second guide surface 122 that is inclined toward the frame-side passage hole 34 (the rear side) from the downstream side (the upper side) to the upstream side (the lower side) in the movement direction X is formed in the frame seal opposite portion 121. Therefore, even when the outside frame 182 and the shutter 68 come into contact with the frame seal opposite portion 121 while being moved from the open position to the closed position, the outside frame 182 and the shutter 68 are guided by the second guide surface 122 in the direction that is separated from the frame-side passage holes 34 (the direction that deviates from the frame seal 162, and the front side in FIG. 18A). In this way, the outside frame 182 and the shutter 68 are not caught by the frame seal opposite portion 121. In this way, the outside frame 182 can be smoothly moved to the closed position, and the shutter 68 can be smoothly moved together with the outside frame 182.

The first frame seal portion 162A that comes into slide contact with the shutter 68 with a high contact pressure (that is, the first frame seal portion 162A is provided in a portion of the frame seal 162 that is likely to be caught by the shutter 68) is arranged at a position that is separated from the second guide surface 122 to the downstream side in the movement direction X. Therefore, the first frame seal portion 162A does not hinder the guide of the outside frame 182 and the shutter 68 by the second guide surface 122. In this way, the shutter 68 and the outside frame 182 can be smoothly guided by the second guide surface 122.

Further, the outside frame 182 (specifically, the frame end portion 80) and the shutter 68 (specifically, the shutter end portion 120) that are moved from the open position to the closed position tightly contact the frame seal opposite portion 121, which may cause the frame seal opposite portion 121 of the frame seal 162 to be damaged.

However, the process cartridge 17 is provided with the frame seal protective film 123 having an elastic modulus that is higher than that of the frame seal 162 (high rigidity). Therefore, when the shutter 68 and the outside frame 182 are moved from the open position to the closed position, the frame seal protective film 123 is arranged between the frame seal opposite portion 121, and the outside frame 182 and the shutter 68. In this way, the frame seal protective film 123 can prevent the outside frame 182 and the shutter 68 from contacting the frame seal opposite portion 121, thereby protecting the frame seal 162.

As a result, when the outside frame 182 and the shutter 68 are moved from the open position to the closed position, it is possible to prevent the frame seal opposite portion 121 of the frame seal 162 from being damaged. In addition, since the outside frame 182 and the shutter 68 are prevented from being contacted with the frame seal opposite portion 121, it is possible to prevent the outside frame 182 and the shutter 68 from being caught by the frame seal opposite portion 121 and the frame seal 162 from being deformed. As a result, it is possible to smoothly move the outside frame 182 and the shutter 68 to the closed position.

III. Modified Exemplary Embodiments (1) First Modification to the Exemplary Embodiments In the above-described exemplary embodiments, as shown in FIGS. 1 and 17, the process cartridge 17 integrally includes the photosensitive drum 25 and the developing roller 37, and the process cartridge 17 is removably mounted to the body casing 2. In addition, for example, the process cartridge 17 may be composed of a developing cartridge without having the photosensitive drum 25 and a unit (drum cartridge) having the photosensitive drum 25 may be additionally provided, where the developing cartridge may be removably mounted to the drum cartridge. Alternatively, only the developer cartridge 31 may be removably mounted to the body casing 2 while the process cartridge 17 is mounted to the body casing 2.

The body casing 2 may be provided with the photosensitive drum 25, the scorotron-type charger 26 and the transfer roller 28, and a developing cartridge may be removably mounted to the body casing 2. Here, the developer cartridge 31 may be removably mounted to the developing cartridge, and the developing cartridge may be provided with the shutter 68.

(2) Second Modification to the Exemplary Embodiments

Although exemplary embodiments of the inventive concept have been described in relation to a laser printer, the present inventive concept is not limited to a monochrome laser printer. Rather, the present inventive concept can also be applied to a color laser printer, including a tandem type and an intermediate transfer type printer.

(3) Third Modification to the Exemplary Embodiments

In the above-described exemplary embodiments, the inside housing 81 is rotated relative to the outside housing 82. Instead, the outside housing 82 may be rotated relative to the inside housing 81. Specifically, when the outside housing 82 is rotated between the open position and the closed position and the outside housing 82 is located at the open position, the inside passage holes 89 are opposed to the outside passage holes 109 so as to communicate therewith. In contrast, when the outside housing 82 is located at the closed position, the inside passage holes 89 are closed by portions of the outside circumferential wall 97 other than the outside passage hole 109.

(4) Fourth Modification to the Exemplary Embodiments

Figures 10A, 10B:
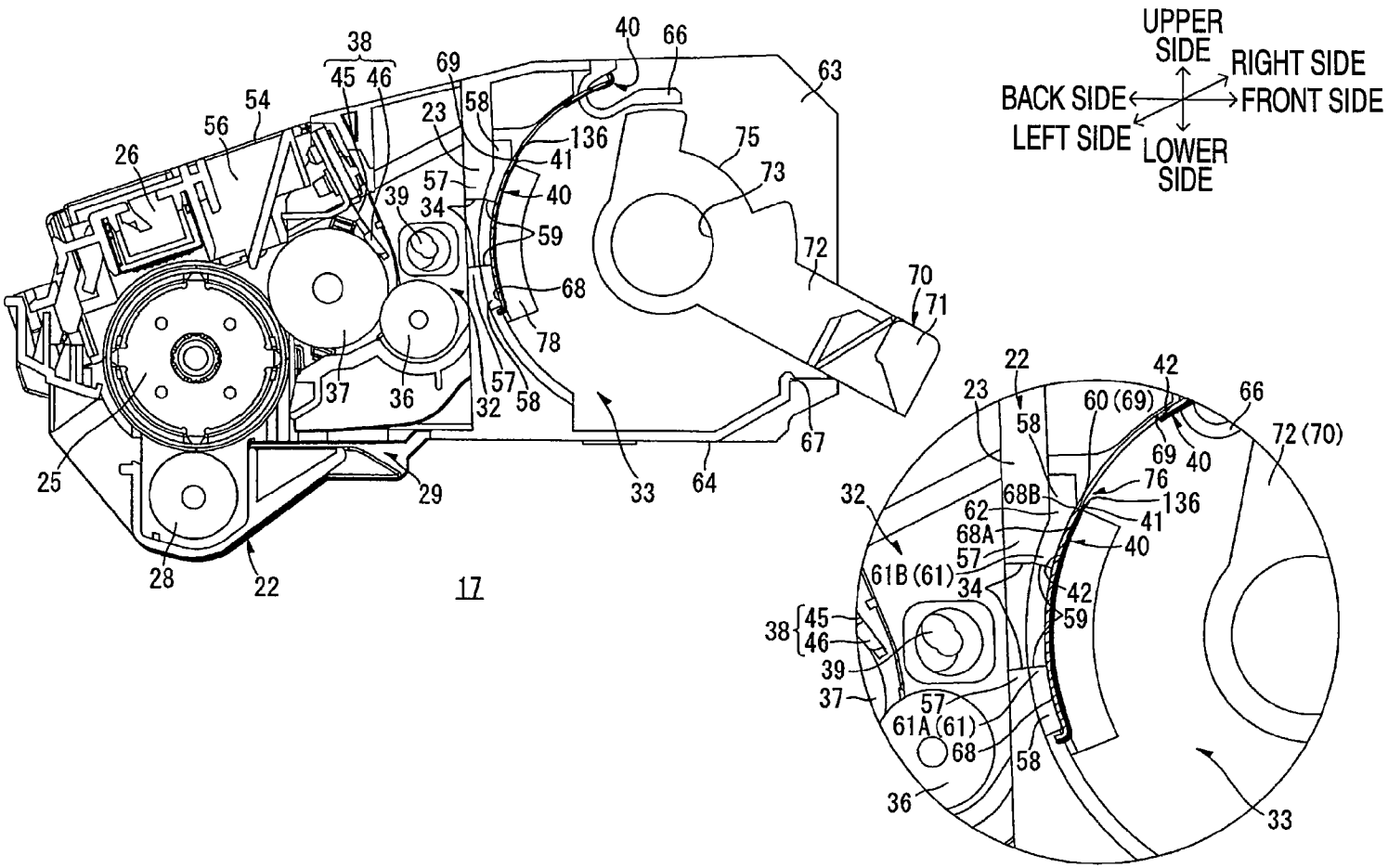
FIGS. 10A and 10B are diagrams showing a fourth modification to the exemplary embodiments applied to FIGS. 3A and 3B.

FIGS. 10A and 10B are diagrams showing a fourth modification to the exemplary embodiments applied to FIGS. 3A and 3B.

In the above-described exemplary embodiments, as shown in FIG. 3B, the adhesive surface 42 of the sheet 40 to the shutter 68 is adhered to a portion of the shutter 68 that is below the shutter openings 69. That is, since the sheet 40 is partially attached to the front side surface of the shutter 68, a step portion 135 is formed on the front surface of the shutter 68 by the circumferential edge of the sheet 40. Accordingly, the developer may remain in the step portion 135 and the shutter 68 may be contaminated by the developer. Therefore, as shown in FIGS. 10A and 10B, the shape of the sheet 40 may be substantially the same as the shape of the front surface of the shutter 68 (see FIG. 5). That is, the adhesive surface 42 of the sheet 40 may be adhered to substantially an entire front side surface of the shutter 68.

Accordingly, it is possible to prevent the step portion 135 from being formed on the front side surface of the shutter 68 by the sheet 40. Therefore, it is possible to prevent the shutter 68 from being contaminated due to the developer remaining on the step portion 135. In addition, since the adhesive surface 42 of the sheet 40 is adhered to substantially the entire front side surface of the shutter 68, the sheet 40 can be relatively firmly attached to the shutter 68.

Further, an inclined surface 136 shown in FIG. 10B may be formed in the sheet 40. The inclined surface 136 is formed at the top of the sheet 40, and is inclined downward toward the rear side. Accordingly, even when the developer is attached to the upper end of the sheet 40, the developer is guided to the rear side (toward the developing part 32) by the inclined surface 136, thereby preventing the developer from leaking to the developer accommodating unit 33.

(5) Fifth Modification to the Exemplary Embodiments

FIGS. 11A and 11B show a protruding portion according to a fifth modification to the exemplary embodiments, where FIG. 11A shows a first aspect thereof and FIG. 11B shows a second aspect thereof.

In the above-described exemplary embodiments, the protruding portion 76 is composed of the damming portion 41 of the sheet 40 and the lower circumferential edge portion 68A of the shutter 68 (see FIG. 3B). Instead, as shown in FIGS. 11A and 11B, the protruding portion 76 may be composed of only the lower circumferential edge portion 68A of the shutter 68, and the front end of the protruding portion 76 (close to the cartridge housing part 33) may protrude upward more than the rear end thereof.

In this case, for example, in the protruding portion 76 shown in FIG. 11A, the front end of the lower circumferential edge portion 68A protrudes upward more than the rear end thereof by one step.

The protruding portion 76 shown in FIG. 11B is provided with the inclined surface 136. In this case, the front end of the protruding portion 76 is made to protrude upward more than the rear end thereof, and the inclined surface 136 is inclined downward from the front end to the rear end.

Accordingly, the developer is hardly attached to the inclined surface 136. Even when the developer is attached to the inclined surface 136, the developer is guided from the front side to the rear side by the inclined surface 136. Therefore, it is possible to prevent developer from leaking to the developer accommodating unit 33 and from being scattered.

(6) Sixth Modification to the Exemplary Embodiments

Figure 12:
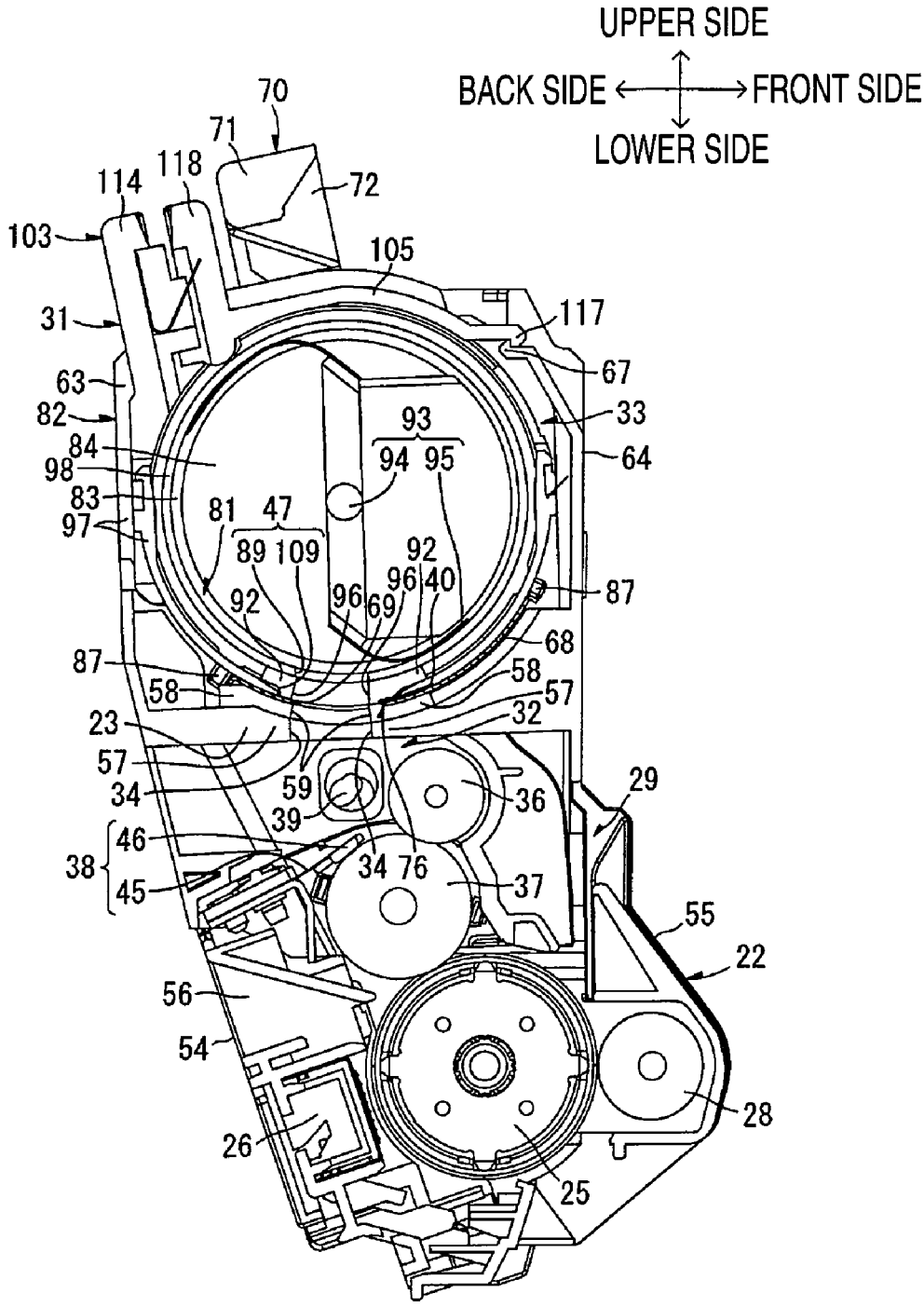
FIG. 12 is a left side sectional view of a process cartridge according to a sixth modification to the exemplary embodiments.

FIG. 12 is a left side sectional view showing a process cartridge according to a sixth modification to the exemplary embodiments.

In the process cartridge 17 according to the above-described exemplary embodiments, as shown in FIG. 2A, when the shutter 68 is located at the open position, the cartridge-side passage hole 47, the frame-side passage hole 34 and the shutter opening 69 are aligned with each other substantially in the horizontal direction. Instead, for example, when the shutter 68 is located at the open position as shown in FIG. 12, the cartridge-side passage hole 47, the frame-side passage hole 34 and the shutter opening 69 are aligned with each other substantially in the vertical direction. In this case, the shutter 68 is moved substantially in the horizontal direction (front-rear direction) (the shutter 68 closes the frame-side passage holes 34 by moving to the rear side in FIG. 12).

In this case, when the shutter 68 is moved to the rear side, the shutter opening 69 crosses the developer transport path (a path extending in the vertical direction between the cartridge-side passage hole 47 and the frame-side passage hole 34). Thus, the developer may be attached to the front side end portion of the shutter opening 69. However, by providing the protruding portion 76 on the front side end portion of the shutter opening 69 that is opposed to the cartridge-side passage hole 47 substantially in the horizontal direction, the protruding portion 76 prevents the flow of the developer attached to the end portion of the shutter opening 69 to the cartridge-side passage hole 47. Therefore, it is possible to prevent the developer from being scattered to the cartridge housing part 33.

(7) Seventh Modification to the Exemplary Embodiments

Figures 13A, 13B:
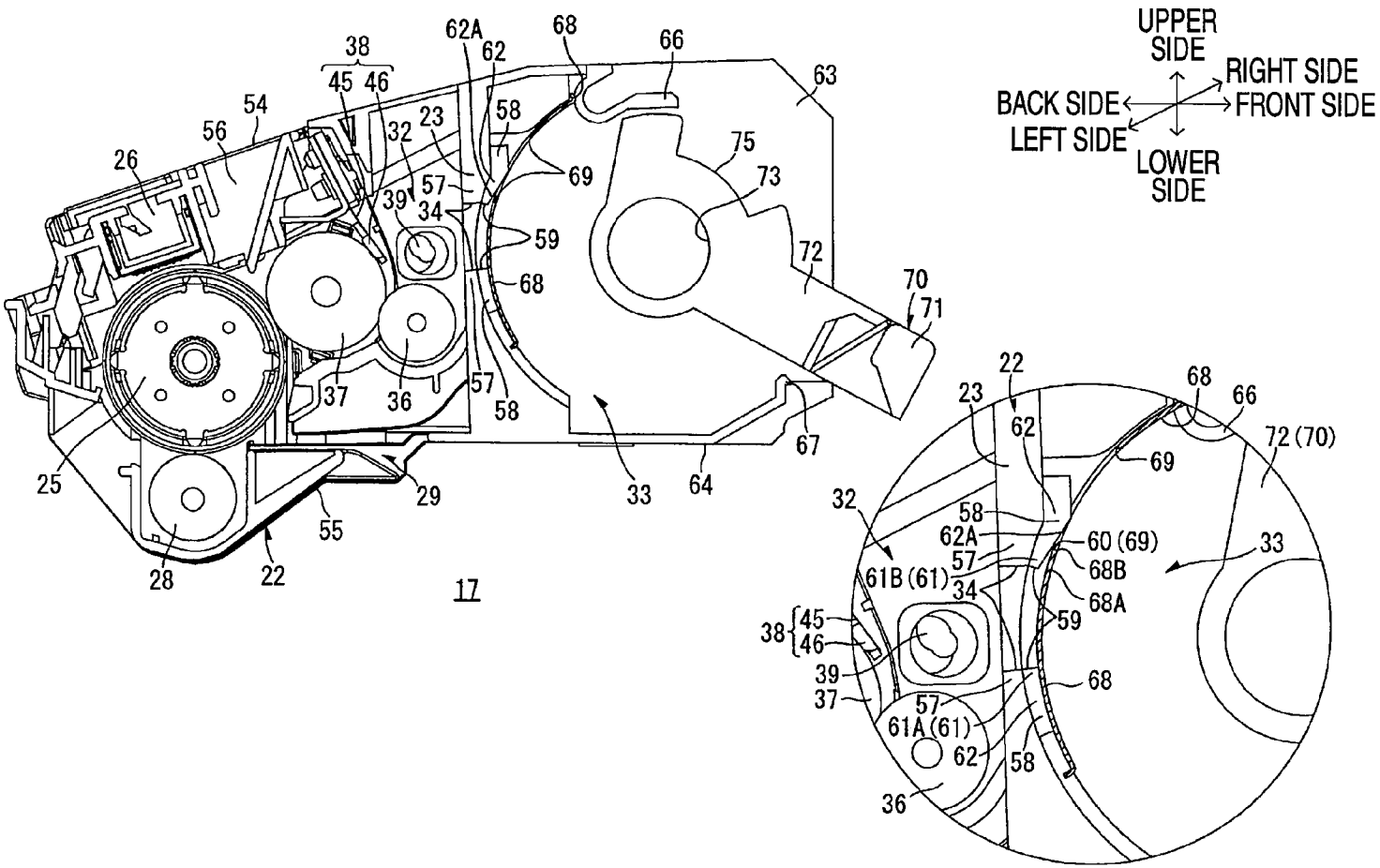
FIGS. 13A and 13B are diagrams showing a first aspect of a seventh modification to the exemplary embodiments applied to FIGS. 3A and 3B.
Figures 14A, 14B:
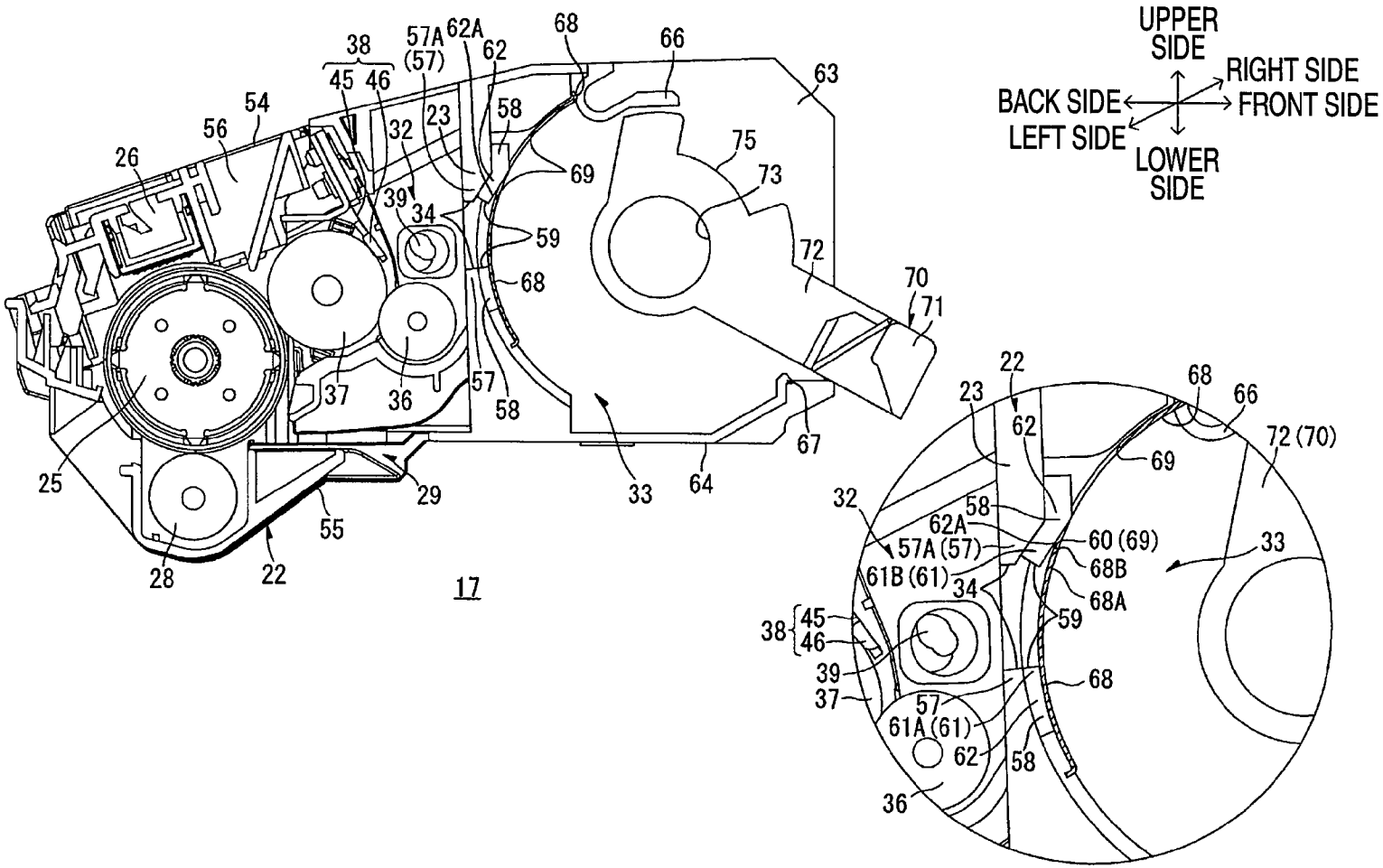
FIGS. 14A and 14B are diagrams showing a second aspect of the seventh modification applied to FIGS. 3A and 3B.
Figures 15A, 15B:
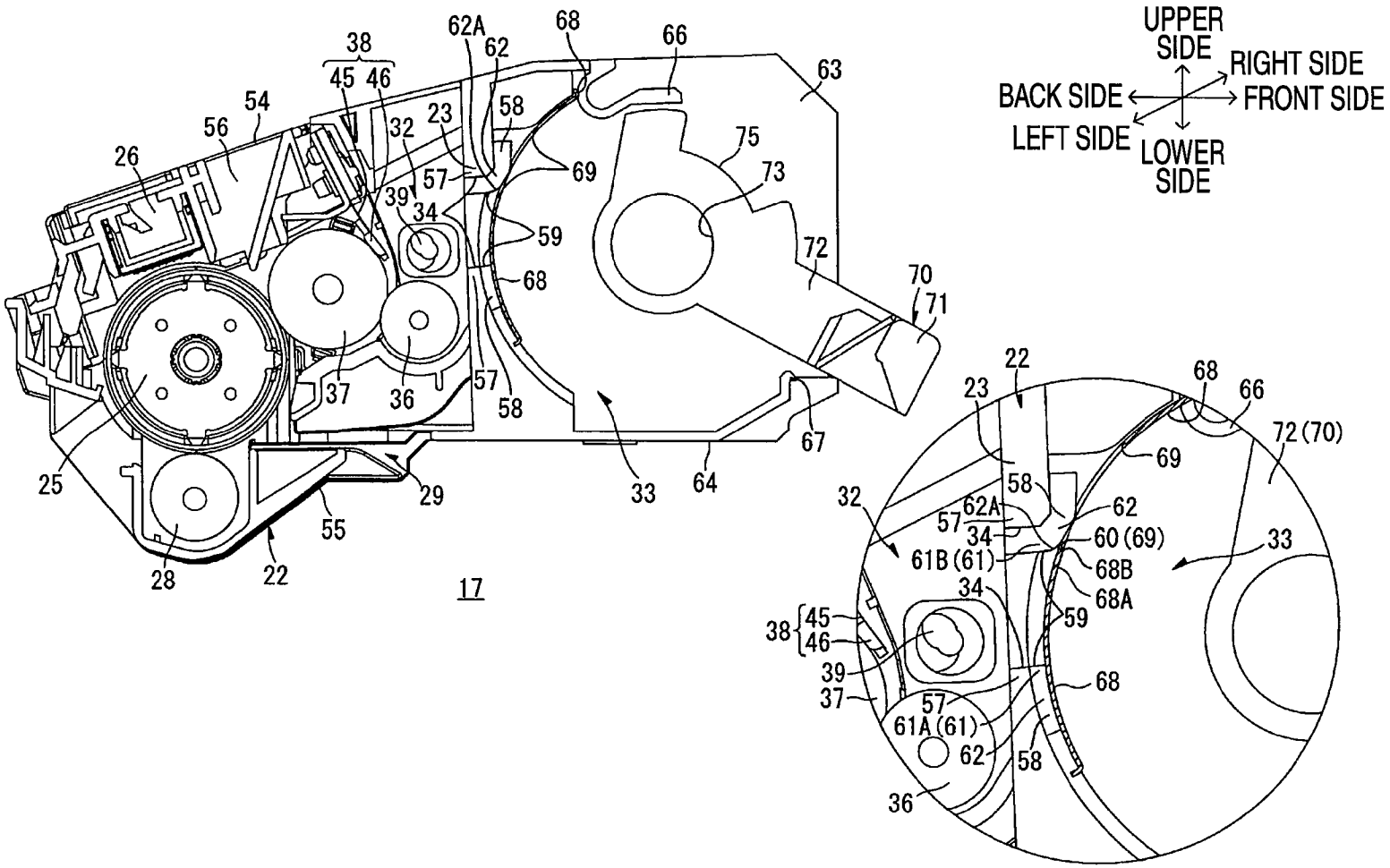
FIG. 15A and 15B are diagrams showing a third aspect of the seventh modification applied to FIGS. 3A and 3B.
Figures 16A, 16B:
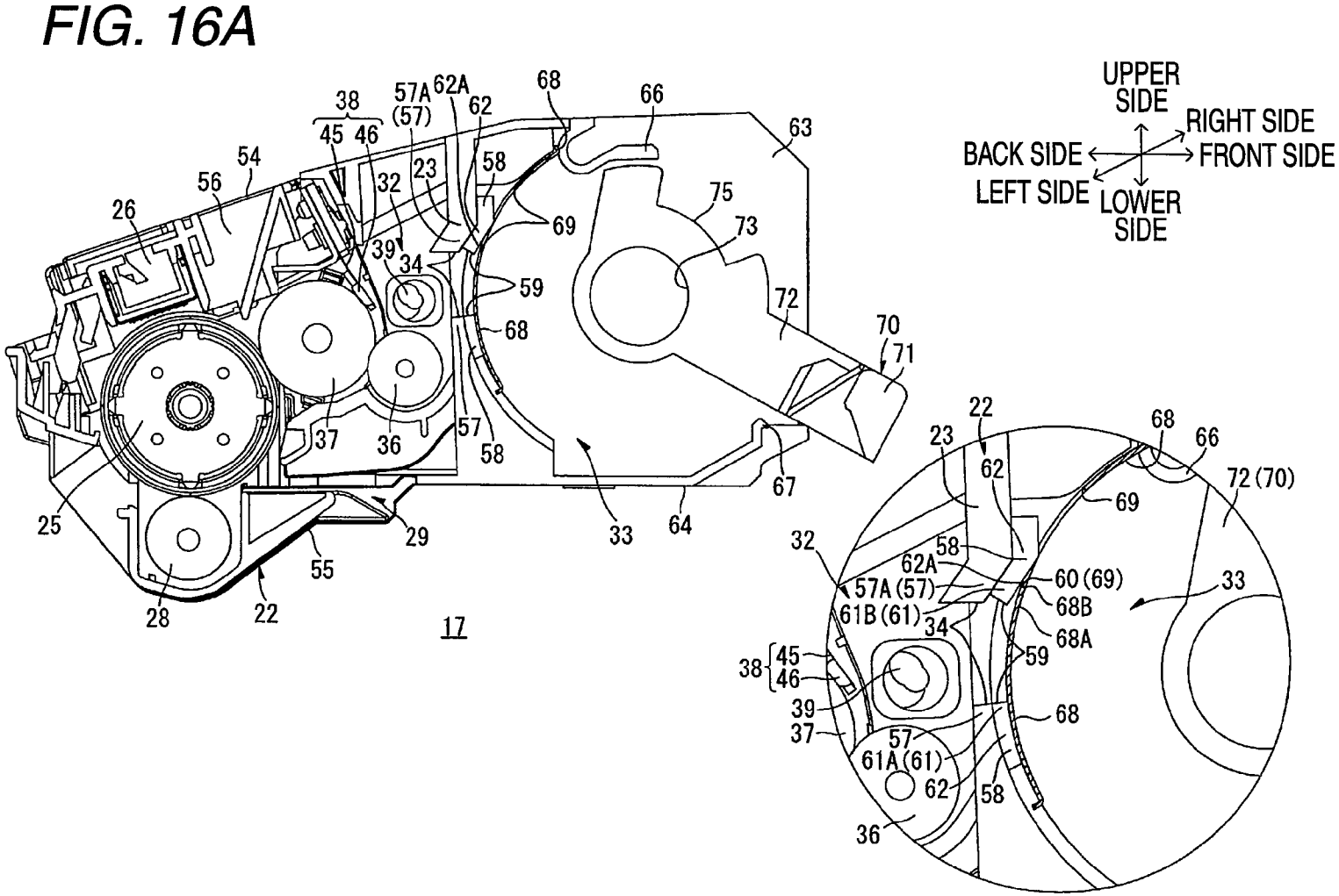
FIGS. 16A and 16B are diagrams showing a fourth aspect of the seventh modification applied to FIGS. 3A and 3B.

FIGS. 13A and 13B are diagrams showing a first aspect of a seventh modification to the exemplary embodiments applied to FIGS. 3A and 3B. FIGS. 14A and 14B are diagrams showing a second aspect of the seventh modification applied to FIGS. 3A and 3B. FIGS. 15A and 15B are diagrams showing a third aspect of the seventh modification applied to FIGS. 3A and 3B. FIGS. 16A and 16B are diagrams showing a fourth aspect of the seventh modification applied to FIGS. 3A and 3B. In FIGS. 13A to 16B, the sheets 40 and the shutter guide portions 78 shown in FIGS. 3A and 3B are omitted.

In the seventh modification, as shown in FIG. 13B, an inclined surface 62A as an example of a contact surface is formed in a portion (referred to as an upper portion 62) of a frame seal 58 above a cutout portion 59. The inclined surface 62A forms a front side surface below the upper portion 62, and is inclined downward toward the rear side (that is, toward the frame-side passage hole 34). Here, in the first aspect, the inclined surface 62A is formed such that a thickness of the upper portion 62 of the frame seal 58 (thickness in the front-rear direction) is set gradually decreased downward toward the frame-side passage hole 34.

When the shutter 68 is located at the open position, the inclined surface 62A faces an upper end 68B, which is a lower end of the shutter opening 69 of the shutter 68, from upside. Accordingly, when the shutter 68 is moved upward from the open position to the closed position, the inclined surface 62A comes into contact with the upper end 68B. At this time, the developer attached to the upper end 68B is guided to the inclined surface 62A. Accordingly, it is possible to remove the developer from the upper end 68B of the shutter 68 until the shutter 68 is moved to the closed position. As a result, when the shutter 68 is moved to the closed position and then the developer cartridge 31 is removed from the cartridge housing part 33, it is possible to prevent the developer from leaking from the upper end 68B of the shutter 68 to the cartridge housing part 33 and from being scattered.

As described above, the inclined surface 62A is inclined downward toward the rear side. That is, the inclined surface 62A is also inclined upward toward the front side. Therefore, the contact pressure of the inclined surface 62A against the upper end 68B gradually increases as the shutter 68 moves upward from the open position to the closed position. As a result, it is possible to prevent the developer attached to the upper ends 68B from being pushed and leaking to the cartridge housing part 33 due to a sudden contact of the inclined surface 62A with the upper end 68B of the shutter 68.

In this way, it is possible to increase the contact pressure of the inclined surface 62A against the upper end 68B as the shutter 68 moves from the open position to the closed position by gradually reducing the thickness of the inclined surface 62A of the frame seal 58 (the upper portion 62) in the downward direction toward the frame-side passage hole 34.

In a second aspect, as shown in FIGS. 14A and 14B, in the curved portion 57 of the partition wall 23, a thickness of a portion that supports a portion of the frame seal 58 corresponding to the inclined surface 62A (which is referred to as a supporting portion 57A) is made to reduce downward toward the frame-side passage hole 34. In this case, even when the thickness of the upper portion 62 of the frame seal 58 is not made to decrease unlike the first aspect, the upper portion 62 is arranged so as to lean to the frame-side passage hole 34 along the supporting portion 57A having a decreasing thickness. Accordingly, the inclined surface 62A can be formed, thereby increasing the contact pressure of the inclined surface 62A against the upper end 68B as the shutter 68 moves from the open position to the closed position.

As shown in FIG. 2B, when the shutter 68 is located at the open position, a portion of the shutter 68 above the shutter opening 69 is arranged between the upper circumferential portion 130B of the developer seal 92 and the upper circumferential portion 61B of the frame seal 58. Therefore, even when the thickness of the upper portion 62 of the frame seal 58 is reduced (see FIGS. 13A and 13B), or even when the thickness of the supporting portion 57A of the process frame 22 is reduced (see FIGS. 14A and 14B), it is possible to supplement the reduced thickness with the thickness of a portion of the shutter 68 above the shutter opening 69. Accordingly, formation of an unnecessary gap can be prevented, and the leakage of developer can be prevented.

In addition to the structure in which the thickness of the supporting portion 57A is gradually decreased downward toward the frame-side passage hole 34 (see FIGS. 14A and 14B), a fourth aspect may be considered in which the supporting portion 57A is obliquely bent toward the frame-side passage hole 34 (the developing part 32) without reducing the thickness as it goes down (that is, the supporting portion 57A is obliquely bend backward), as shown in FIGS. 16A and 16B. In this case, the inclined surface 62A can increase the contact pressure of the inclined surface 62A against the upper end 68B as the shutter 68 moves from the open position to the closed position.

Furthermore, as a third aspect, as shown in FIGS. 15A and 15B, the upper portion 62 of the frame seal 58 extends to the frame-side passage hole 34 such that the inclined surface 62A extends to the inside (upper circumferential edge portion) of the frame-side passage hole 34, thereby covering the upper circumferential portion of the frame-side passage hole 34. Accordingly, the inclined surface 62A inclined obliquely to the rear downside in a curved shape is formed in the upper portion 62 in the circumference of a front angular portion of the curved portion 57 of the partition wall 23 that forms the upper circumferential edge portion of the frame-side passage hole 34.

Accordingly, even when the thickness of the upper portion 62 of the frame seal 58 is not reduced, and even when the thickness of the process frame 22 is not reduced, it is possible to increase the contact pressure of the inclined surface 62A against the upper end 68B of the shutter opening 69 of the shutter 68 as the shutter 68 is moved from the open position to the closed position.

(8) Eighth Modification to the Exemplary Embodiments

Figures 26A, 26B, 26C, 26D, 26E, 26F:
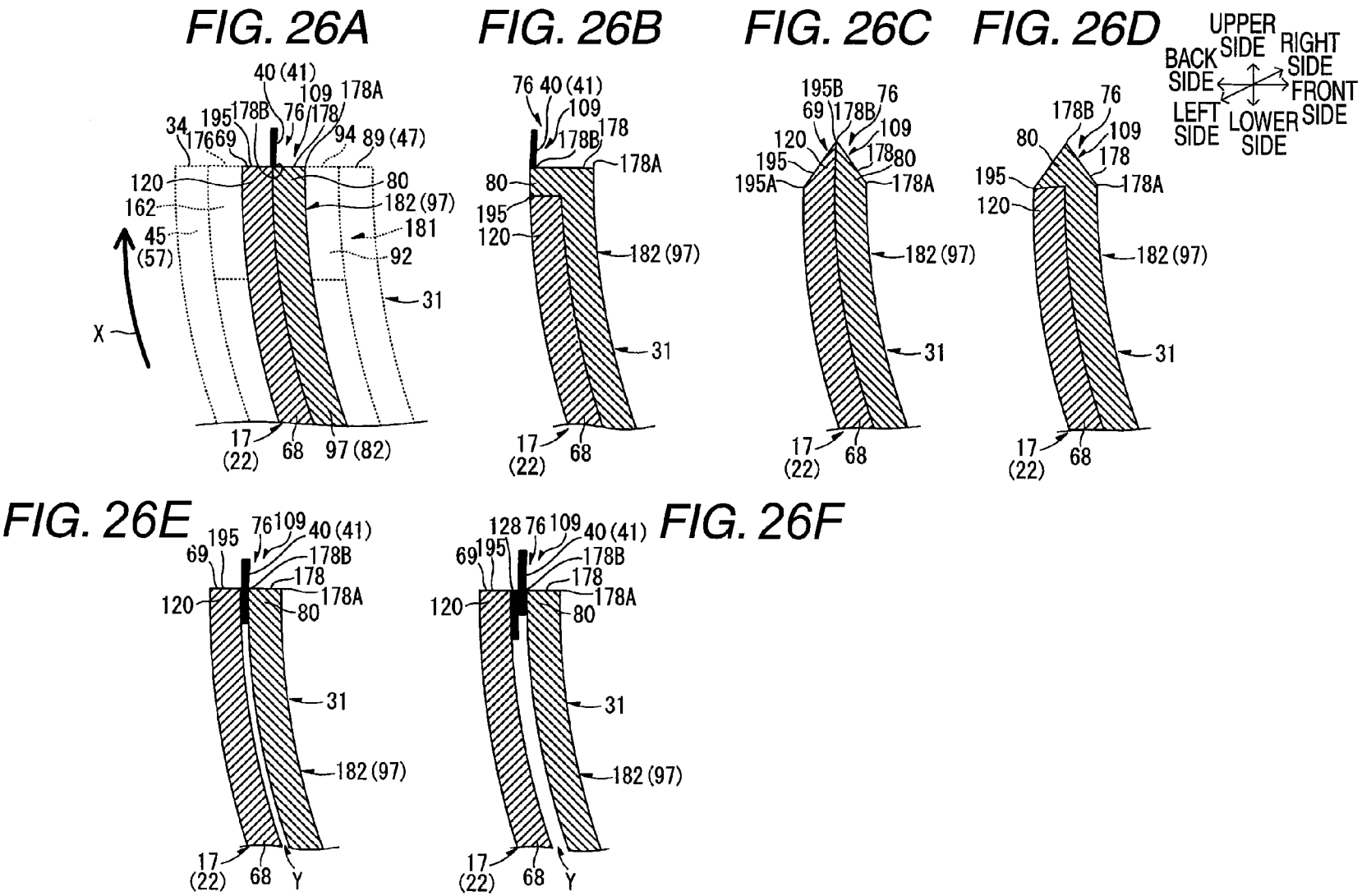
FIGS. 26A to 26F are partial enlarged views showing a shutter and an outside frame that are located at an open position according to an eighth modification of the exemplary embodiments, where

FIGS. 26A to 26F are partial enlarged views showing a shutter and an outside frame that are located at an open position according to an eighth modification of the exemplary embodiments, where FIG. 26A shows a first aspect thereof, FIG. 26B shows a second aspect thereof, FIG. 26C shows a third aspect thereof, FIG. 26D shows a fourth aspect thereof, FIG. 26E shows a fifth aspect thereof, and FIG. 26F shows a sixth aspect thereof.

In the above-described exemplary embodiments, as shown in FIG. 25, the sheet 40 is attached to the outer surface of the outside circumferential wall 97 of the outside frame 182 such that the damming portion 41 of the protruding portion 76 that is provided in the frame end portion 80 of the outside frame 182 protrudes downward into the outside passage hole 109.

In addition, as shown in FIG. 26A, the sheet 40 may protrude into the outside passage hole 109 from a rear end 178B of a frame end surface 178 that borders the lower end of the outside passage hole 109 in the frame end portion 80, without attaching the sheet 40 to the outer surface (in this case, the rear surface) of the outside circumferential wall 97. In this case, the entire sheet 40 serves as the damming portion 41.

As shown in FIG. 26B, the edge of the frame end portion 80 of the outside circumferential wall 97 may be formed in a hook shape such that the frame end portion 80 protrudes from the other portions to the shutter 68 in the outside circumferential wall 97. In this case, when the developer cartridge 31 is mounted to the process frame 22, the interposing protrusions 87 of the outside circumferential wall 97 hold the shutter 68 therebetween (see FIG. 18A) and the frame end portion 80 is engaged with the shutter 68 (specifically, the shutter end portion 120), as described above. Therefore, the outside frame 182 and the shutter 68 are firmly connected to each other, and they can be reliably moved together.

As shown in FIG. 26C, the protruding portion 76 may not include the sheet 40. In this case, the rear end 178B of the frame end surface 178 serves as an example of a second end. The frame end surface 178 is inclined from the upstream side (the lower side) to the downstream side (the upper side) in the movement direction X as it extends from the front end 178A to the rear end 178B, and serves as an example of an inclined surface. That is, the frame end portion 80 having the protruding portion 76 is pointed at the end. In this way, even when developer contacts the frame end surface 178, the developer is guided from the rear end 178B to the front end 178A (the front side) by the frame end surface 178 and returns to the inside passage hole 89 (see FIG. 18A). Therefore, developer is less likely to be attached to the frame end portion 80 of the outside frame 182. As a result, it is possible to prevent developer from leaking to the outside of the developer cartridge 31 and from being scattered.

A portion of the shutter 68 that is opposed to the rear side of the frame end portion 80, that is, the shutter end portion 120 that borders the lower end of the shutter opening 69 is pointed at the end so as to correspond to the pointed frame end portion 80. Specifically, an end surface of the shutter end portion 120 that actually borders the lower end of the shutter opening 69 (a surface of the shutter end portion 120 that connects the front surface and the rear surface of the shutter 68, which is referred to as a shutter end surface 195) is inclined upward as it extends from a rear end 195A thereof to a front end 195B thereof.

In this way, when the developer cartridge 31 is mounted to the process frame 22 and the outside circumferential wall 97 of the outside frame 182 is closely attached to the shutter 68, the rear end 178B of the frame end surface 178 is continuously connected to the front end 195B of the shutter end surface 195, and the frame end surface 178 and the shutter end surface 195 are inclined upward, thereby forming a triangular shape. Therefore, even when developer contacts the frame end surface 178 or the shutter end surface 195, the developer is guided to the corresponding end surface, and then dropped on the end surface. In this way, the developer is removed from both the frame end portion 80 and the shutter end portion 120.

The edge of the frame end portion 80 of the outside circumferential wall 97 shown in FIG. 26C may be formed in a hook shape shown in FIG. 26D, similar to the structure shown in FIG. 26B.

Further, when the developer cartridge 31 is mounted to the process frame 22, as described above, the outside circumferential wall 97 of the outside frame 182 is closely attached to the shutter 68 (see FIG. 18A). However, actually, as shown in FIG. 26E, a little gap Y is formed between the outside circumferential wall 97 and the shutter 68. In this case, when the sheet 40 is attached to the outer surface (the rear surface in FIG. 26E) of the outside circumferential wall 97 of the outside frame 182, the sheet 40 is arranged between the shutter 68 and the outside circumferential wall 97 to fill the gap Y That is, the sheet 40 can prevent the leakage of developer between the shutter 68 and the outside frame 182 (to the gap Y) by filling the gap, in addition to preventing the developer attached to the frame end portion 80 of the outside frame 182 from being scattered to the outside when the outside frame 182 is moved from the open position to the closed position, as described above.

Figures 27A, 27B:
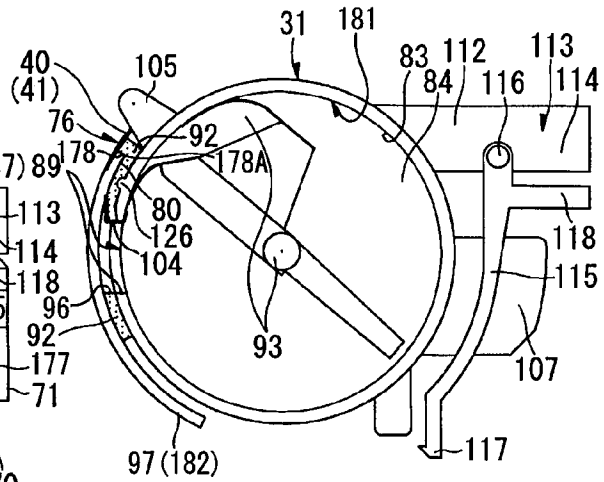
FIGS. 27A and 27B are diagrams showing a ninth modification of the exemplary embodiments applied to FIGS. 18A and 18B.

Further, as shown in FIG. 26F, a seal member 128 may be provided on a surface of the shutter 68 that is opposed to the outside circumferential wall 97, and the seal member 128 may come into contact with the sheet 40 to fill up the gap Y (9) Ninth Modification to the Exemplary Embodiments FIGS. 27A and 27B are diagrams showing a ninth modification of the exemplary embodiments applied to FIGS. 18A and 18B.

In the above-described exemplary embodiments, as shown in FIG. 22, the outside passage holes 109 are formed in the outside frame 182 (see FIG. 25) having a substantially cylindrical shape, and the inside passage holes 89 of the inside frame 181 are opposed to the outside passage holes 109 such that they communicate with each other, when the outside frame 182 is moved to the open position.

The outside frame has a substantially cylindrical shape. Instead, as shown in FIG. 27, an outside frame 182 may be formed of a curved plate similar to the shutter 68 (see FIG. 20).

The outside passage holes 109 (see FIG. 25) may not be formed in the outside frame 182, and the shutter openings 69 (see FIG. 20) may not be formed in the shutter 68. That is, the outside frame 182 and the shutter 68 according to the third modification may be formed of plate members without openings through which developer passes.

In this case, as shown in FIG. 27A, the entire outside frame 182 that is disposed at the open position is arranged below the inside passage holes 89, and the entire shutter 68 that is disposed at the open position is arranged below the frame-side passage holes 34.

Therefore, when the outside frame 182 is moved in the movement direction X from the open position to the closed position, the upper end portion of the outside frame 182 is moved upward while initially crossing the inside passage holes 89. That is, the upper end portion of the outside frame 182 corresponds to the frame end portion 80. Therefore, when the shutter 68 is moved in the movement direction (the movement direction X) from the open position to the closed position, the upper end portion of the shutter 68 is moved upward while initially crossing the frame-side passage holes 34. That is, the upper end portion of the shutter 68 corresponds to the shutter end portion 120.

The protruding portion 76 may be formed at the upper end portion of the outside frame 182.

Further, the protruding portion 76 may be provided in both the outside frame 182 and the shutter 68. In this case, it is possible to prevent developer attached to an end portion of the shutter 68 that initially crosses the frame-side passage holes 34 when the shutter 68 is moved from the open position to the closed position from being scattered to the outside (the inside of the cartridge housing part 33).

(10) Tenth Modification to the Exemplary Embodiments

As shown in the enlarged view of FIG. 18A, in the above-described exemplary embodiments, the frame rib 125 is provided to bring the first frame seal portion 162A into slide contact with the shutter 68 that is moved from the open position to the closed position with a higher contact pressure than the second frame seal portion 162B in the frame seal 162.

Further, for example, the frame rib 125 may not be provided, and a portion of the frame seal 162 corresponding to the first frame seal portion 162A may be formed of a material (for example, hard rubber) having an elastic modulus that is higher than that of a portion corresponding to the second frame seal portion 162B.

That is, the elastic modulus of the first frame seal portion 162A is higher than that of the second frame seal portion 162B (in other words, the first frame seal portion 162A is harder than the second frame seal portion 162B). This simple structure makes it possible to bring the first frame seal portion 162A into slide contact with the shutter 68 with a higher contact pressure than the second frame seal portion 162B.

Similarly, the developer rib 126 may not be provided in the developer cartridge 31, and a portion of the developer seal 92 corresponding to the first developer seal portion 92A may be formed of a material (for example, hard rubber) having an elastic modulus that is higher than that of a portion corresponding to the second developer seal portion 92B. In this case, the elastic modulus of the first developer seal portion 92A is higher than that of the second developer seal portion 92B (in other words, the first developer seal portion 92A is harder than the second developer seal portion 92B). This simple structure makes it possible to bring the first developer seal portion 92A into slide contact with the outside frame 182 with a higher contact pressure than the second developer seal portion 92B.

Incidentally, in the above-described exemplary embodiments, the process cartridge 17 is configured to a two-point separation process cartridge in which the developer cartridge 31 is removably mounted to the process frame 22. In addition, the process cartridge 17 may be configured to a three-point separation process cartridge in which the developer cartridge 31, a developing unit including the developing roller 37, and a drum cartridge including the photosensitive drum 25 are separatable. Further, the two-point separation process cartridge may be configured such that a developing cartridge integrally including the developer cartridge 31 and the developing unit is removably mounted to the drum cartridge.

According to another aspect of the invention, when the shutter is located at the open position, the protruding portion is located more upstream than upstream ends of the first opening and the second opening in the movement direction.

According thereto, when the shutter is disposed at the open position, the protruding portion is arranged below the upstream ends of the first opening and the second opening in the movement direction. In this way, the protruding portion can deviate from the flow path of the developer moved between the first opening and the second opening. Therefore, the protruding portion makes it possible to smoothly move the developer between the developer cartridge and the housing (for example, a developing part provided with a developing roller) without hindering the flow of the developer. Since the upstream end portion of the third opening as well as the protruding portion deviates from the flow path of the developer moved between the first opening and the second opening, it is possible to prevent the developer from being attached to the upstream end portion of the third opening.

According to still another aspect of the invention, the protruding portion comprises an inclined surface that is inclined downstream in the movement direction as approaching from the second end toward the first end.

According thereto, the inclined surface included in the protruding portion is inclined from the upstream side to the downstream side in the movement direction as it extends from an end of the protruding portion that is close to the first opening to another end that is close to the second opening. Therefore, developer is less likely to be attached to the inclined surface. Even though the developer is attached to the inclined surface, the developer is guided from the first opening to the second opening by the inclined surface. Therefore, it is possible to prevent the developer from leaking to the cartridge housing part and from being scattered.

According to still another aspect of the invention, the protruding portion comprises a flexible sheet protruding into the third opening from the upstream end portion of the third opening in the movement direction at the side close to the first opening.

According thereto, the sheet included in the protruding portion protrudes into the third opening at a portion of the shutter below the third opening that is opposed to the first opening and prevents the developer attached to the lower end portion of the third opening from leaking from the first opening. As a result, it is possible to prevent the developer from leaking to the cartridge housing part and from being scattered.

Further, the sheet has flexibility. Therefore, even when the shutter has a curved shape, it is possible to closely attach the sheet to the shutter. In this way, the sheet can prevent the developer attached to the lower end portion of the third opening from leaking from the first opening.

According to still another aspect of the invention, the sheet comprises an adhesive surface attached to a portion of the shutter upstream of the third opening in the movement direction.

According thereto, it is possible to easily attach the sheet to the shutter by attaching the adhesive surface of the sheet to a portion of the shutter below the third opening.

According to still another aspect of the invention, the sheet comprises an adhesive surface attached to substantially entire surface of the shutter facing the first opening.

According thereto, the adhesive surface of the sheet is attached to substantially the entire surface of the shutter that faces the first opening. Therefore, it is possible to prevent a step portion from being formed on the surface of the shutter facing the first opening due to the sheet. Therefore, it is possible to prevent the shutter from being contaminated due to the developer remaining on the step portion. In addition, since the adhesive surface of the sheet is attached to substantially the entire surface of the shutter facing the first opening, it is possible to relatively firmly attach the sheet to the shutter.

According to still another aspect of the invention, when the shutter is located at the open position, the first opening, the second opening and the third opening are arranged in a substantially horizontal direction, and the movement direction is upward.

According thereto, when the shutter is located at the open position, the first, second, and third openings are aligned with each other substantially in the horizontal direction, and the movement direction is the upward direction. Therefore, there is a fear that developer will be attached to a lower end portion of the third opening, which is an upstream end portion in the movement direction.

However, the protruding portion is provided in the lower end portion of the third opening. Therefore, the protruding portion can prevent the developer attached to the lower end portion of the third opening from leaking from the first opening. As a result, it is possible to prevent the developer from leaking to the cartridge housing part and from being scattered.

According to still another aspect of the invention, when the shutter is located at the open position, the first opening, the second opening and the third opening are arranged in a substantially vertical direction, and the movement direction is a substantially horizontal direction.

According thereto, when the shutter is located at the open position, the first opening, the second opening, and the third opening are aligned with each other substantially in the vertical direction. In this case, the movement direction is substantially the same as the horizontal direction. Therefore, there is a fear that developer will be attached to an end portion of the third opening substantially in the horizontal direction.

However, the protruding portion is provided in the end portion of the third opening substantially in the horizontal direction. Therefore, the protruding portion can prevent the developer attached to the end portion of the third opening from leaking from the first opening. As a result, it is possible to prevent the developer from leaking to the cartridge housing part and from being scattered.

According to still another aspect of the invention, the protruding portion comprises an inclined surface that is inclined downstream in the movement direction as approaching from the first end toward the second end.

According thereto, the inclined surface included in the protruding portion is inclined from the upstream side to the downstream side in the movement direction as it extends from the first end to the second end. In this way, even though developer is attached to the inclined surface, the developer is guided from the second end to the first end by the inclined surface and returns to the first opening. Therefore, the developer is less likely to be attached to the second frame. As a result, it is possible to prevent the developer from leaking and being scattered to the outside.

According to still another aspect of the invention, the protruding portion comprises a flexible sheet that is provided in the position getting more apart from the first opening than the first end and protrudes from the upstream side to the downstream side in the movement direction.

According thereto, the sheet included in the protruding portion protrudes from the upstream side to the downstream side in the movement direction at the position that is further away from the first opening than the first end (that is, the outside position). Therefore, it is possible to prevent the developer attached to the end portion of the second frame from leaking to the outside. As a result, it is possible to prevent the developer from being scattered to the outside.

Further, the sheet has flexibility. Therefore, even when the end portion of the second frame is not flat, it is possible to closely attach the sheet to the end portion of the second frame by bending the sheet. In this way, the sheet can prevent the developer attached to the end portion of the second frame from leaking to the outside.

According to still another aspect of the invention, the developer cartridge further comprises: a first seal member that is provided around the first opening on an outer surface of the first frame for preventing the developer from leaking from the first opening; a first seal-side opposite portion that is provided in the first seal member and is opposed to the second frame when the second frame moves from the open position to the closed position; and a first guide surface that is provided in the first seal-side opposite portion and is inclined to the first opening as approaching from the downstream side to the upstream side in the movement direction.

According thereto, the first seal member that is provided around the first opening on the outer surface of the first frame is positioned between the first frame and the second frame provided outside the first frame.

The first seal member is provided with the first seal-side opposite portion that is opposed to the second frame when the second frame is moved from the open position to the closed position, and the second frame moved from the open position to the closed position can come into contact with the first seal-side opposite portion.

The first guide surface that is inclined toward the first opening as it extends from the downstream side to the upstream side in the movement direction is formed in the first seal-side opposite portion. Therefore, even when the second frame comes into contact with the first seal-side opposite portion while being moved from the open position to the closed position, the second frame is guided by the first guide surface in the direction in which it is separated from the first opening (the direction in which it deviates from the first seal member). Therefore, the second frame can be smoothly moved to the closed position without being caught by the first seal-side opposite portion.

According to still another aspect of the invention, the developer cartridge further comprises: a first seal member that is provided around the first opening on an outer surface of the first frame for preventing the developer from leaking from the first opening; a first seal-side opposite portion that is provided in the first seal member and is opposed to the second frame when the second frame moves from the open position to the closed position; and a first protective member that has an elastic modulus higher than that of the first seal member and is provided between the second frame and the first seal-side opposite portion for protecting the first seal member.

According thereto, the first seal member that is provided around the first opening on the outer surface of the first frame is positioned between the first frame and the second frame provided outside the first frame.

Therefore, the first seal member is provided with the first seal-side opposite portion that is opposed to the second frame when the second frame is moved from the open position to the closed position. In this case, the second frame that is moved from the open position to the closed position tightly contacts the first seal-side opposite portion, which may cause the first seal-side opposite portion of the first seal member to be damaged.

However, the developer cartridge is provided with the first protective member having an elastic modulus that is higher than that of the first seal member (high rigidity). Therefore, when the second frame is moved from the open position to the closed position, the first protective member is arranged between the first seal-side opposite portion and the second frame. In this way, the first protective member can prevent the second frame from contacting the first seal-side opposite portion, thereby protecting the first seal member.

As a result, when the second frame is moved from the open position to the closed position, it is possible to prevent the first seal-side opposite portion of the first seal member from being damaged.

According to still another aspect of the invention, the second contact portion is pressed against the second frame that is moved from the open position to the closed position.

According thereto, the second contact portion is pressed against the second frame that is moved from the open position to the closed position. Therefore, the second contact portion can come into slide contact with the second frame with a higher contact pressure than the first contact portion.

According to still another aspect of the invention, the developer cartridge further comprises: a first protrusion, which is provided on the first frame, which protrudes toward the second frame, and which presses the second contact portion against the second frame.

According thereto, the first protrusion is provided on the first frame so as to protrude to the second frame. This simple structure makes it possible to firmly press the second contact portion against the second frame that is moved from the open position to the closed position.

According to still another aspect of the invention, the second contact portion has an elastic modulus that is higher than that of the first contact portion.

According thereto, the elastic modulus of the second contact portion is higher than that of the first contact portion (in other words, the second contact portion is harder than the first contact portion). This simple structure makes it possible to bring the second contact portion into slide contact with the second frame with a higher contact pressure than the first contact portion.

According to still another aspect of the invention, the developer cartridge further comprises: a first seal-side opposite portion that is provided in the first seal member and is opposed to the second frame when the second frame moves from the open position to the closed position; and a first guide surface that is provided in the first seal-side opposite portion and is inclined to the first opening as approaching from a downstream side to an upstream side in a movement direction of the second frame from the open position to the closed position, wherein the second contact portion is provided in a position apart from the first guide surface at a downstream side of the first guide surface in the movement direction of the second frame.

According thereto, the first seal member is provided with the first seal-side opposite portion that is opposed to the second frame when the second frame is moved from the open position to the closed position. The second frame that is moved from the open position to the closed position can come into contact with the first seal-side opposite portion.

The first guide surface that is inclined to the first opening as it extends from the downstream side to the upstream side in a movement direction from the open position to the closed position (hereinafter, simply referred to as a "movement direction") is formed in the first seal-side opposite portion. Therefore, even when the second frame comes into contact with the first seal-side opposite portion while being moved from the open position to the closed position, the second frame is guided by the first guide surface in the direction in which it is separated from the first opening (the direction in which it deviates from the first seal member). Therefore, the second frame can be smoothly moved to the closed position without being caught by the first seal-side opposite portion.

The second contact portion that comes into slide contact with the second frame with a high contact pressure (that is, the second contact portion is provided in a portion of the first seal member that is likely to be caught by the second frame) is arranged at a position that is separated from the first guide surface to the downstream side in the movement direction. Therefore, the second contact portion does not hinder the guide of the second frame by the first guide surface. In this way, the second frame can be smoothly guided by the first guide surface.

According to still another aspect of the invention, the developer cartridge further comprises: a first seal-side opposite portion that is provided in the first seal member and is opposed to the second frame when the second from moves from the open position to the closed position; and a first protective member that has an elastic modulus higher than that of the first seal member and is provided between the second frame and the first seal-side opposite portion for protecting the first seal member.

According thereto, the first seal member is provided with the first seal-side opposite portion that is opposed to the second frame when the second frame is moved from the open position to the closed position. In this case, the second frame that is moved from the open position to the closed position tightly contacts the first seal-side opposite portion, which may cause the first seal-side opposite portion of the first seal member to be damaged.

However, the developer cartridge is provided with the first protective member having an elastic modulus that is higher than that of the first seal member (high rigidity). Therefore, when the second frame is moved from the open position to the closed position, the first protective member is arranged between the first seal-side opposite portion and the second frame. In this way, the first protective member can prevent the second frame from contacting the first seal-side opposite portion, thereby protecting the first seal member.

As a result, when the second frame is moved from the open position to the closed position, it is possible to prevent the first seal-side opposite portion of the first seal member from being damaged.

According to still another aspect of the invention, the developer cartridge further comprises: an end portion provided at an upstream side in a movement direction of the second frame from the open position to the closed position; a protruding portion that is provided at the end portion of the second frame and comprises: a first end provided at a side close to the first opening; and a second end that is provided in a position getting more apart from the first opening than the first end and protrudes more downstream in the movement direction than the first end.

According thereto, a protruding portion is provided on an end portion of the second frame that initially crosses the first opening when the second frame is moved is the movement direction (hereinafter, simply referred to an "end portion"). The protruding portion includes a first end that is close to the first opening and a second end that protrudes to the downstream side of the first end in the movement direction at a position that is further away from the first opening than the first end (that is, the outside position).

Therefore, even when the developer in the first opening is attached to the end portion of the second frame when the second frame is moved from the open position to the closed position, the second end of the protruding portion prevents the developer from leaking to the outside. As a result, it is possible to prevent the developer from being scattered to the outside.

According to still another aspect of the invention, the fourth contact portion is pressed against the shutter when the second frame moves from the open position to the closed position.

According thereto, the fourth contact portion is pressed against the shutter when the second frame is moved from the open position to the closed position. Therefore, the fourth contact portion can come into slide contact with the shutter with a higher contact pressure than the third contact portion.

According to still another aspect of the invention, the developing unit further comprises: a second protrusion, which is provided on the housing, which protrudes toward the shutter, and which presses the fourth contact portion against the shutter.

According thereto, the second protrusion is provided on the housing so as to protrude toward the shutter. This simple structure makes it possible to reliably press the fourth contact portion against the shutter when the second frame is moved from the open position to the closed position.

According to still another aspect of the invention, the fourth contact portion has an elastic modulus that is higher than that of the third contact portion.

According thereto, the elastic modulus of the fourth contact portion is higher than that of the third contact portion (in other words, the fourth contact portion is harder than the third contact portion). This simple structure makes it possible to bring the fourth contact portion into slide contact with the shutter with a higher contact pressure than the third contact portion.

According to still another aspect of the invention, the developing unit further comprises: a second seal-side opposite portion that is provided in the second seal member and is opposed to the second frame and the shutter when the second frame moves from the open position to the closed position; and a second guide surface that is provided in the second seal-side opposite portion and is inclined toward the second opening as approaching from a downstream side to an upstream side in a movement direction of the second frame from the open position to the closed position, wherein the fourth contact portion is provided in a position apart from the second guide surface in the movement direction of the second frame.

According thereto, the second seal member is provided with the second seal-side opposite portion that is opposed to the second frame and the shutter when the second frame is moved from the open position to the closed position. The second frame and the shutter that are moved from the open position to the closed position can come into contact with the second seal-side opposite portion.

The second guide surface that is inclined to the second opening as it extends from the downstream side to the upstream side in the movement direction is formed in the second seal-side opposite portion. Therefore, even when the second frame comes into contact with the second seal-side opposite portion while being moved from the open position to the closed position, the second frame and shutter are guided by the second guide surface in the direction in which they are separated from the second opening (the direction in which they deviate from the second seal member). Therefore, the second frame and the shutter are not caught by the second seal-side opposite portion. As a result, the second frame can be smoothly moved to the closed position, and the shutter can also be smoothly moved together with the second frame.

The fourth contact portion that comes into slide contact with the shutter with a high contact pressure (that is, the fourth contact portion is provided in a portion of the second seal member that is likely to be caught by the shutter) is arranged at a position that is separated from the second guide surface to the downstream side in the movement direction. Therefore, the fourth contact portion does not hinder the guide of the shutter by the second guide surface. In this way, the second frame and the shutter can be smoothly guided by the second guide surface.

According to still another aspect of the invention, the developing unit further comprises: a second seal-side opposite portion that is provided in the second seal member and is opposed to the second frame and the shutter when the second frame moves from the open position to the closed position; a second protective member for protecting the second seal member, the second protective member having an elastic modulus higher than that of the second seal member and provided between the second seal-side opposite portion and a group of the second frame and the shutter.

According thereto, the second seal member is provided with the second seal-side opposite portion that is opposed to the second frame and the shutter when the second frame is moved from the open position to the closed position. In this case, the second frame and the shutter that are moved from the open position to the closed position tightly contact the second seal-side opposite portion, which may cause the second seal-side opposite portion of the second seal member to be damaged.

However, the developing unit is provided with the second protective member having an elastic modulus that is higher than that of the second seal member (high rigidity). Therefore, when the second frame is moved from the open position to the closed position, the second protective member is arranged between the second seal-side opposite portion, and the second frame and the shutter. In this way, the second protective member can prevent the second frame and the shutter from contacting the second seal-side opposite portion, thereby protecting the second seal member.

As a result, when the second frame is moved from the open position to the closed position, it is possible to prevent the second seal-side opposite portion of the second seal member from being damaged.

What is claimed is:

1. A developing unit comprising:

a developer cartridge that is configured to accommodate developer and comprises a first opening for enabling communication between an inside of the developer cartridge and an outside of the developer cartridge;

a housing comprising:

a cartridge housing part for housing the developer cartridge; and a second opening that is provided in a position opposite to the first opening and is formed on the cartridge housing part;

a shutter that comprises a third opening, the shutter being movable between an open position where the third opening is located at a position between the first opening and the second opening and a closed position where the third opening is apart from the positions of the first opening and the second opening; and a protruding portion comprising a flexible sheet that protrudes into the third opening from an upstream end portion of the third opening in a movement direction of the shutter from the open position to the closed position at the side close to the first opening, the protruding portion further comprising a first end at a side close to the first opening and a second end at a side close to the second opening, the first end protruding more downstream in the movement direction than the second end.

2. The developing unit according to claim 1, wherein when the shutter is located at the open position, the protruding portion is located more upstream than upstream ends of the first opening and the second opening in the movement direction.

3. The developing unit according to claim 1, wherein the protruding portion comprises an inclined surface that is inclined downstream with respect to the movement direction.

4. The developing unit according to claim 1, wherein the sheet comprises an adhesive surface attached to a portion of the shutter upstream of the third opening in the movement direction.

5. The developing unit according to claim 1, wherein the sheet comprises an adhesive surface attached to substantially entire surface of the shutter facing the first opening.

6. The developing unit according to claim 1, wherein when the shutter is located at the open position, the first opening, the second opening and the third opening are arranged in a substantially horizontal direction, and wherein the movement direction is upward.

7. The developing unit according to claim 1, wherein when the shutter is located at the open position, the first opening, the second opening and the third opening are arranged in a substantially vertical direction, and wherein the movement direction is a substantially horizontal direction.

8. A developer cartridge comprising:

a first frame that is configured to accommodate developer and comprises a first opening for enabling communication between an inside of the first frame and an outside of the first frame;

a second frame that is provided outside of the first frame and is movable between an open position where the first opening is opened and a closed position where the first opening is closed, the second frame comprising an end portion at an upstream side in a movement direction of the second frame from the open position to the closed position; and a protruding portion that is provided at the end portion of the second frame and comprises:

a first end provided at a side close to the first opening; and a second end that is provided in a position further apart from the first opening than the first end, the second end protruding more downstream in the movement direction than the first end.

9. The developer cartridge according to claim 8, wherein the protruding portion comprises an inclined surface that is inclined with respect to the movement direction.

10. The developer cartridge according to claim 8, wherein the protruding portion comprises a flexible sheet that is provided in the position further apart from the first opening than the first end and protrudes from the upstream side to the downstream side in the movement direction.

11. The developer cartridge according to claim 8, further comprising:

a first seal member that is provided around the first opening on an outer surface of the first frame for preventing the developer from leaking from the first opening;

a first seal-side opposite portion that is provided in the first seal member and located downstream of the first opening in the movement direction; and a first guide surface that is provided in the first seal-side opposite portion and is inclined to the first opening as approaching from the downstream side to the upstream side in the movement direction.

12. The developer cartridge according to claim 8, further comprising:

a first seal member that is provided around the first opening on an outer surface of the first frame for preventing the developer from leaking from the first opening;

a first seal-side opposite portion that is provided in the first seal member and located downstream of the first opening in the movement direction; and a protective member that has an elastic modulus higher than that of the first seal member and is provided between the second frame and the first seal-side opposite portion for protecting the first seal member.

13. A developing unit comprising:

the developer cartridge according to claim 10, a housing comprising:

a cartridge housing part for housing the developer cartridge; and a second opening that is provided in a position opposite to the first opening and is formed on the cartridge housing part; and a shutter that is provided in the cartridge housing part and is movable together with the second frame so as to open and close the second opening, wherein the sheet is configured to fill a gap between the shutter and the second frame.

14. A developing unit comprising:

the developer cartridge according to claim 8, a housing comprising:

a cartridge housing part for housing the developer cartridge; and a second opening that is provided in a position opposite to the first opening and is formed on the cartridge housing part;

a shutter that is provided in the cartridge housing part, the shutter being movable together with the second frame so as to open the second opening when the second frame is located at the open position and close the second opening when the second frame is located at the closed position;

a second seal member that is provided around the second opening between the housing and the shutter for preventing the developer from leaking from the second opening;

a second seal-side opposite portion that is provided in the second seal member and is opposed to the second frame and the shutter when the second frame moves from the open position to the closed position; and a second guide surface that is provided in the second seal-side opposite portion and is inclined to the second opening with respect to the movement direction.

15. A developing unit comprising:

the developer cartridge according to claim 8, a housing comprising:

a cartridge housing part for housing the developer cartridge; and a second opening that is provided in a position opposite to the first opening and is formed on the cartridge housing part;

a shutter that is provided in the cartridge housing part and is movable together with the second frame so as to open the second opening when the second frame is located at the open position and close the second opening when the second frame is located at the closed position;

a second seal member that is provided around the second opening between the housing and the shutter for preventing the developer from leaking from the second opening;

a second seal-side opposite portion that is provided in the second seal member and is opposed to the second frame and the shutter when the second frame moves from the open position to the closed position; and a protective member for protecting the second seal member, the protective member having an elastic modulus higher than that of the second seal member and provided between the second seal-side opposite portion and a group of the second frame and the shutter.

16. A developer cartridge comprising:

a first frame that is configured to accommodate developer and comprises a first opening for enabling communication between an inside of the first frame and an outside of the first frame;

a second frame that is provided outside of the first frame and is movable between an open position where the first opening is opened and a closed position where the first opening is closed; and a first seal member that is provided around the first opening on an outer surface of the first frame for preventing the developer from leaking from the first opening, the first seal member comprising:

a first contact portion that is slide contactable with the second frame moved from the open position to the closed position; and a second contact portion that is slide contactable with the second frame moved from the open position to the closed position at a contact pressure higher than that of the first contact portion, wherein the first contact portion and the second contact portion are positioned on a downstream side in a direction in which the second frame is moved from the open position to the closed position.

17. The developer cartridge according to claim 16, wherein the second contact portion is pressed against the second frame that is moved from the open position to the closed position.

18. The developer cartridge according to claim 17, further comprising:

a first protrusion, which is provided on the first frame, which protrudes toward the second frame, and which presses the second contact portion against the second frame.

19. The developer cartridge according to claim 16, wherein the second contact portion has an elastic modulus that is higher than that of the first contact portion.

20. The developer cartridge according to claim 16, further comprising:

a first seal-side opposite portion that is provided in the first seal member and is opposed to the second frame when the second frame moves from the open position to the closed position; and a first guide surface that is provided in the first seal-side opposite portion and is inclined to the first opening in a movement direction of the second frame from the open position to the closed position, wherein the second contact portion is provided in a position apart from the first guide surface at a downstream side of the first guide surface in the movement direction of the second frame.

21. The developer cartridge according to claim 16, further comprising:

a first seal-side opposite portion that is provided in the first seal member and is opposed to the second frame when the second from moves from the open position to the closed position; and a protective member that has an elastic modulus higher than that of the first seal member and is provided between the second frame and the first seal-side opposite portion for protecting the first seal member.

22. The developer cartridge according to claim 16, further comprising:

an end portion provided at an upstream side in a movement direction of the second frame from the open position to the closed position;

a protruding portion that is provided at the end portion of the second frame and comprises:

a first end provided at a side close to the first opening; and a second end that is provided in a position further apart from the first opening than the first end and protrudes more downstream in the movement direction than the first end.

23. A developing unit comprising:

the developer cartridge according to claim 16, a housing comprising:

a cartridge housing part for housing the developer cartridge; and a second opening that is provided in a position opposite to the first opening and is formed on the cartridge housing part;

a shutter that is provided in the cartridge housing part and is movable together with the second frame so as to open the second opening when the second frame is located at the open position and close the second opening when the second frame is located at the closed position; and a second seal member that is provided around the second opening between the housing and the shutter for preventing the developer from leaking from the second opening, the second seal member comprising:

a third contact portion that is slide contactable with the shutter when the second frame moves from the open position to the closed position; and a fourth contact portion that is slide contactable with the shutter when the second frame moves from the open position to the closed position at a contact pressure higher than that of the third contact portion.

24. The developing unit according to claim 23, wherein the fourth contact portion is pressed against the shutter when the second frame moves from the open position to the closed position.

25. The developing unit according to claim 24, further comprising:

a second protrusion, which is provided on the housing, which protrudes toward the shutter, and which presses the fourth contact portion against the shutter.

26. The developing unit according to claim 23, wherein the fourth contact portion has an elastic modulus that is higher than that of the third contact portion.

27. The developing unit according to claim 23, further comprising:

a second seal-side opposite portion that is provided in the second seal member and is opposed to the second frame and the shutter when the second frame moves from the open position to the closed position; and a second guide surface that is provided in the second seal-side opposite portion and is inclined toward the second opening in a movement direction of the second frame from the open position to the closed position, wherein the fourth contact portion is provided in a position apart from the second guide surface in the movement direction of the second frame.

28. The developing unit according to claim 23, further comprising:

a second seal-side opposite portion that is provided in the second seal member and is opposed to the second frame and the shutter when the second frame moves from the open position to the closed position;

a protective member for protecting the second seal member, the second protective member having an elastic modulus higher than that of the second seal member and provided between the second seal-side opposite portion and a group of the second frame and the shutter.

* * * * *